US008756843B1

(12) United States Patent
Cantrell

(10) Patent No.: US 8,756,843 B1
(45) Date of Patent: Jun. 24, 2014

(54) HANDHELD FIREARMS WITH INDEXED MAGAZINE AND COMPACT FIRING MECHANISM

(71) Applicant: Daniel Cantrell, Yulee, FL (US)

(72) Inventor: Daniel Cantrell, Yulee, FL (US)

( * ) Notice: Subject to any disclaimer, the term of this patent is extended or adjusted under 35 U.S.C. 154(b) by 0 days.

(21) Appl. No.: 13/843,284

(22) Filed: Mar. 15, 2013

Related U.S. Application Data

(60) Provisional application No. 61/694,854, filed on Aug. 30, 2012, provisional application No. 61/645,671, filed on May 11, 2012.

(51) Int. Cl.

| | |
|---|---|
| ***F41A 9/61*** | (2006.01) |
| ***F41A 9/65*** | (2006.01) |
| ***F41A 9/70*** | (2006.01) |
| ***F41A 9/69*** | (2006.01) |

(52) U.S. Cl.
CPC ... *F41A 9/65* (2013.01); *F41A 9/70* (2013.01); *F41A 9/69* (2013.01)
USPC ..... 42/6; 42/49.01

(58) Field of Classification Search
USPC ..... 42/49.01–49.1, 17–18, 21–22, 24, 29, 42/33, 35, 37, 39, 6
See application file for complete search history.

(56) References Cited

U.S. PATENT DOCUMENTS

| | | | | |
|---|---|---|---|---|
| 4,159,670 | A * | 7/1979 | Turner | 89/155 |
| 5,081,778 | A * | 1/1992 | Switzer | 42/50 |
| 7,047,686 | B2 * | 5/2006 | Zimmermann | 42/75.1 |
| 7,318,294 | B2 * | 1/2008 | Zimmermann | 42/7 |
| 8,037,805 | B1 * | 10/2011 | Neroni | 89/196 |
| 8,485,083 | B1 * | 7/2013 | Care | 89/33.02 |
| 2005/0257413 | A1 * | 11/2005 | Zimmermann | 42/75.1 |
| 2006/0272192 | A1 * | 12/2006 | Zimmermann | 42/7 |
| 2013/0125441 | A1 * | 5/2013 | Westwood et al. | 42/70.05 |

* cited by examiner

*Primary Examiner* — Michael David
(74) *Attorney, Agent, or Firm* — Mark Young, P.A.

(57) ABSTRACT

New handgun configurations are enabled by a multiple cartridge magazine that includes the firing chamber for each cartridge. The magazine is indexed mechanically through the stock, with full index on trigger pull or full index on trigger release or part of the index period on trigger release and the remainder on trigger pull, thus aligning each successive cartridge with the barrel for firing. A sliding trigger mechanism with an index finger pull portion actuates both the magazine indexing and the firing mechanism. The firing mechanism employs a trigger actuated spring-loaded hammer with a wedge portion, which impacts a corresponding wedge shaped anvil which may contain an eccentric adjustable firing pin for firing center fire or rim fire cartridges.

20 Claims, 82 Drawing Sheets

HANDHELD FIREARMS WITH INDEXED MAGAZINE AND COMPACT FIRING MECHANISM

RELATED APPLICATIONS

This application is a nonprovisional and claims the benefit of priority of U.S. Provisional Application 61694854 filed Jul. 21, 2012, and U.S. Provisional Application 61645671 filed May 11, 2012, the entire contents of which are incorporated herein by this reference and made a part hereof.

FIELD OF THE INVENTION

This invention relates generally to handheld firearms and more particularly to compact light weight handheld firearms with an indexed magazine and compact firing mechanism that enable various compact configurations, including but not limited to configurations that reduce torque from recoil.

BACKGROUND

Shortcomings with conventional handguns are numerous. As an example, many handguns contain extremely complex firing mechanism with several interconnected parts that are conducive to failure. Housing such firing mechanisms requires considerable space and limits the location of other components.

Concomitantly, conventional handguns that use a magazine contain extremely complex mechanisms to move a cartridge from the magazine to a firing chamber. These mechanisms also contain several interconnected parts that are conducive to failure. Additionally, housing such mechanisms requires additional space and further limits the location of other components. Moreover, the firing chamber cannot be changed in such handguns.

As an example of the limitation regarding location of other components, conventional handguns locate the barrel and firing chamber considerably above the handgrip. In this conventional configuration, the backward momentum of recoil typically causes the shooter's wrist and/or arm to bend with the gun barrel pivoting upwards. It would be preferable if a handgun transmitted recoil, not above the shooter's hand, but rather directly through a shooter's hand and forearm. Such a configuration would reduce or eliminate the unintended pivoting, which would reduce stress and allow a shooter to stay on target.

The invention is directed to overcoming one or more of the problems and solving one or more of the needs as set forth above.

SUMMARY OF THE INVENTION

The purpose of this invention is to provide a very compact, lightweight, simple handheld firearm wherein the bulk of the mass of the firearm is held within the shooters hand. It is also a purpose of this invention to make this handheld firearm a multi-shot firearm with an easily loaded magazine and the capability of changing cartridge calibers by merely changing the magazine and the barrel. It is a further purpose of this invention to provide a compact handheld firearm wherein the centerline of recoil is near or at the center of the palm of the shooters hand and along the centerline of the shooters arm, thus eliminating the undesirable "barrel flip" associated with conventional handheld firearms where the centerline of recoil is above the shooters hand.

To solve one or more of the problems set forth above, an exemplary handgun according to principles of the invention includes a magazine. The magazine has a prismatic housing with a plurality of aligned spaced firing chambers, each firing chamber being shaped and sized to hold a cartridge for firing and having a shape and size that is compatible with cartridges matching the barrel of the firearm. The magazine has a top, a bottom, a front and a back, and an outer cam side and a second side. A cam track is provided on the outer cam side of the magazine between the magazine front and the magazine back. The cam track includes a three dimensional waveform channel extending from about the magazine bottom to about the magazine top and includes a waveform cycle for each firing chamber. Each cycle includes a track segment with a bend that changes direction from the first edge to the second edge of the magazine. Each cycle has a wavelength corresponding to the index distance between its associated firing chamber in the magazine. The cam track may, by way of example, define a zigzag, straight, serpentine, sinusoidal, cycloid and triangular path of travel. The gun includes a stock (i.e., handle) with a bottom, top, and a passage extending from the bottom to the top. The passage is shaped and sized to receive the magazine and allow the magazine to progress linearly through the passage. The passage includes a front surface, a rear surface, a first side surface and a second side surface, with a barrel opening in the front surface between the top and bottom of the stock. A barrel through which a bullet of a cartridge fired from one of the firing chambers may travel extends from the barrel opening in the front surface of the passage. A trigger includes a finger actuatable lever, the trigger being movable from an at rest position to a firing position. A firing pin strikes the cartridge for firing when the firing chamber containing the cartridge is aligned with the barrel at the firing position and the trigger is moved to the firing position. A cam follower rides in the cam track. The cam follower may comprise a pin, protrusion or roller sized to ride in the cam track. The cam follower is operably coupled to (i.e., functionally controlled by) the trigger. The cam follower urges the magazine towards the top of the stock (or toward the bottom of the stock if so configured) when the trigger is moved to the firing position. The cam follower urges the firing chamber containing the cartridge to be fired into alignment with the barrel at the barrel opening when the trigger is moved to the firing position. The cam track on the outer cam side of the magazine may include a step between each waveform cycle. The step impedes backward motion of the cam follower.

Each waveform cycle may include a dwell segment. In such embodiments, the cam follower does not move the magazine when the cam follower is riding through the dwell segment.

In a double barrel embodiment, the firearm may include two independently operated parallel magazines.

A cam follower arm operably coupled to the trigger is biased to urge the cam follower towards the cam track. The cam follower is attached at a terminus of the cam follower arm.

The cam follower arm may include a pivoting joint and a spring such as a torsion spring or a leaf spring biased to urge the cam follower towards the cam track and a spring biased to urge the cam follower arm to pivot towards the cam track thereby urging the cam follower towards the cam track.

An extractor may be provided for each firing chamber. The extractor includes a plurality of C-shaped grippers, one gripper per firing chamber. The grippers grip the rim of each cartridge in the firing chambers. The grippers are movable from a first position abutting the magazine to a position away from the magazine to eject each spent case.

A firing anvil with a front side and an opposite back side is attached to the firing pin. The back side of the firing anvil may have an inclined plane striking surface. A striking lug is aligned with the inclined plane striking surface. The striking lug, which includes a wedge shaped leading edge, moves from a position apart from the striking surface into collision with the striking surface with the wedge shaped leading edge colliding against the inclined plane striking surface and thereby driving the firing pin into the cartridge aligned with the barrel at the firing position. The striking lug (or hammer) is actuated by the trigger. Movement of the trigger to the firing position causes the wedge shaped leading edge to collide against the inclined plane striking surface. A sear disposed between the trigger and striking lug holds the striking lug until the trigger reaches the firing position, upon which the sear releases the striking lug causing the wedge shaped leading edge to collide against the inclined plane striking surface.

Optionally, the trigger includes an articulating trigger pull with a trigger slide and a trigger pull connected to the trigger slide by a pivot pin. The trigger pull articulates about an axis perpendicular to a longitudinal axis of the trigger slide, which facilitates pulling the trigger.

In some exemplary embodiments, the trigger is below the top of the stock and above the barrel.

BRIEF DESCRIPTION OF THE DRAWINGS

The foregoing and other aspects, objects, features and advantages of the invention will become better understood with reference to the following description, appended claims, and accompanying drawings, where:

FIG. 47 shows this assembly with extensions in an up or retracted position.

FIG. 55 shows the mechanism in its "at rest" position.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
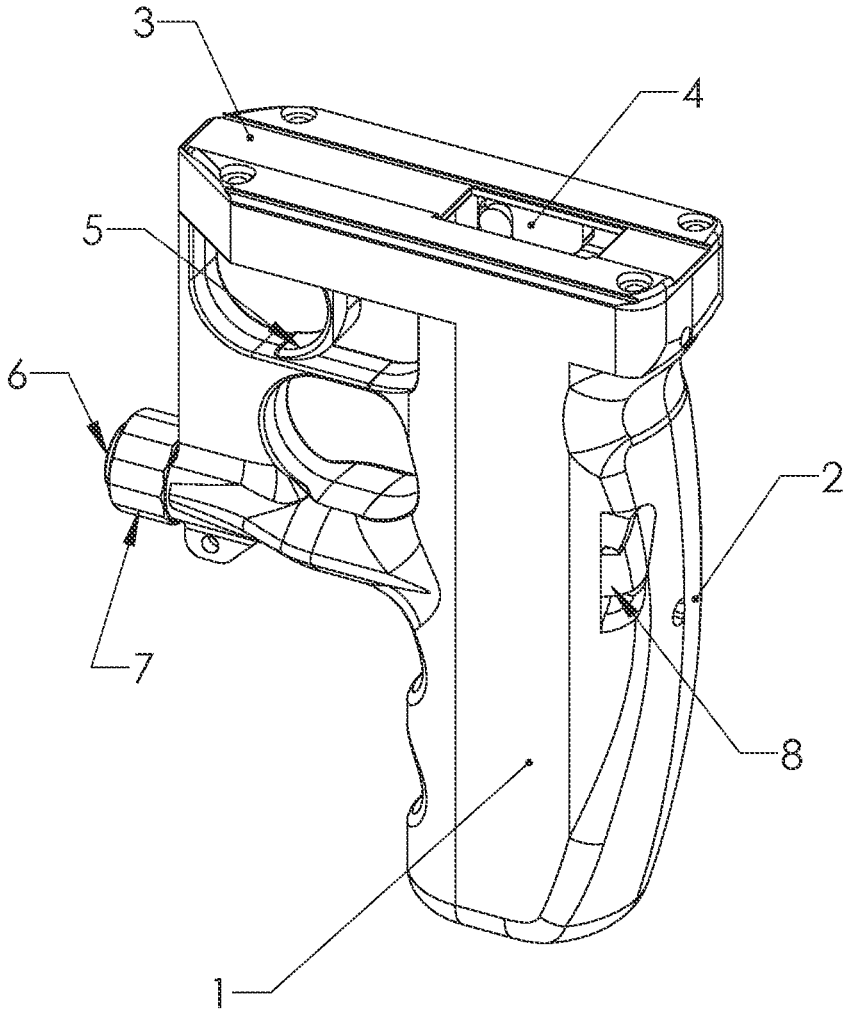
FIG. 1 is a schematic drawing that illustrates a perspective view of a completely assembled handgun according to one embodiment of the invention.

Referring to FIG. 1; 1 is the left-hand side of two-piece handgun housing and 2 is the right-hand side of that same housing. These pieces may be joined together with screws and located with dowels or joined by suitable means. Item 3 is a top plate mounted to the two frame halves, in this embodiment, with screws. Top plate 3 shown is made with two Picatinny rails (MIL-STD-1913, STANAG 2324, or tactical rails) to mount sites and accessories. 4 is the magazine opening which extends down all the way through the handgun handle grip. 5 is the trigger pull which is articulating and mounted to the trigger slide mechanism (not visible, see FIG. 3, item 22). 6 is a barrel which may be a quick change element. 7 is a gland nut that secures the barrel to the frame. 8 is an operating lever for a cam which disengages the magazine indexing arm to eject or release a magazine (not visible, see FIG. 3, item 9).

Figure 2:
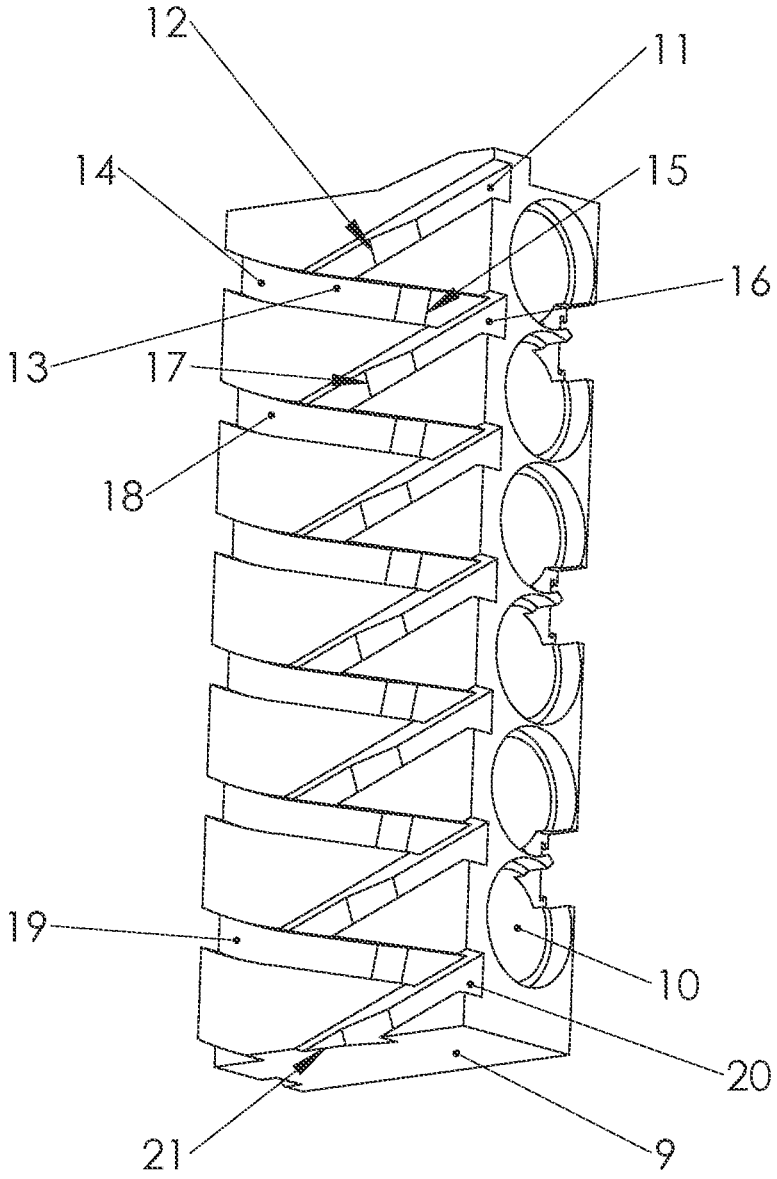
FIG. 2 is a schematic drawing that illustrates an embodiment of a cartridge magazine including a possible indexing cam track according to disclosures of the invention.

Referring to FIG. 2, this is a schematic drawing of a magazine and 9 is the body of that magazine. 10 are the individual cartridge chambers in the magazine. 11 is the first section of a "zigzag" cam track which extends down the side of the magazine to affect indexing and accurate positioning of the magazine. This cam track and associated cam follower (not shown here but shown in FIG. 3, item 35) maintain total control of the magazine at all times during the magazine indexing travel. 12 is a ramp at a transition point of the cam track. Said ramp forces the cam follower 35 latterly outward from the bottom of a cam track and allows it to drop into a succeeding cam track section 14 and prevent cam follower 35 from traveling back up a cam track section lion the return stroke of cam follower 35. A cam track section 14 is also a "dwell" section of the cam track and locates and locks magazine 9 into place in the firing position during a considerable portion of the final trigger pull before the gun fires. 15 is another ramp in the base of a cam track at the next transition. Ramp 15 similarly forces cam follower 35 latterly outward and then allows it to drop into the succeeding cam track section 16 which prevents cam follower 35 from traveling back up cam track section 14 in its progression toward the bottom of the magazine. 17 is another ramp at a transition section between cam track section 16 and cam track section 18. Cam track section 18 is also a dwell section the same as cam track section 14. This sequence of cam track sections and ramps may proceed down the length of the magazine. Cam track sections 11 and 16 and all corresponding cam track sections indicate a half index position between successive cartridge chambers 10. When trigger 5 is in its released or at rest position cam follower 35 is in one of these sections and magazine 9 is in a half index position. Cam track section 14 and 18 and all similar sections represent the firing position of a magazine wherein the cartridge chambers 10 are in line with a barrel 6 and a firing mechanism (illustrated in FIG. 5 thru 10 below) of the gun. The magazine is indexed one half of (or any part of) its index during the trigger release cycle and the final half of (or final portion of) the index cycle and into firing position during the trigger pull cycle. This half (or partial-partial) index sequence provides a much smaller smoother motion and allows for a softer trigger pull. The cam design may also be configured to give full index on trigger pull only and dwell on trigger release or full index on trigger release and dwell on trigger pull. When the final cartridge is fired from chamber 10 the cam follower will be in cam track section 19. When the trigger is released from the final firing the cam follower will be in cam track section 20. One more dry pull of the trigger will bring the cam follower over ramp 21 and will disengage the magazine from the indexing mechanism and allow it to be removed from the gun.

Figure 3:
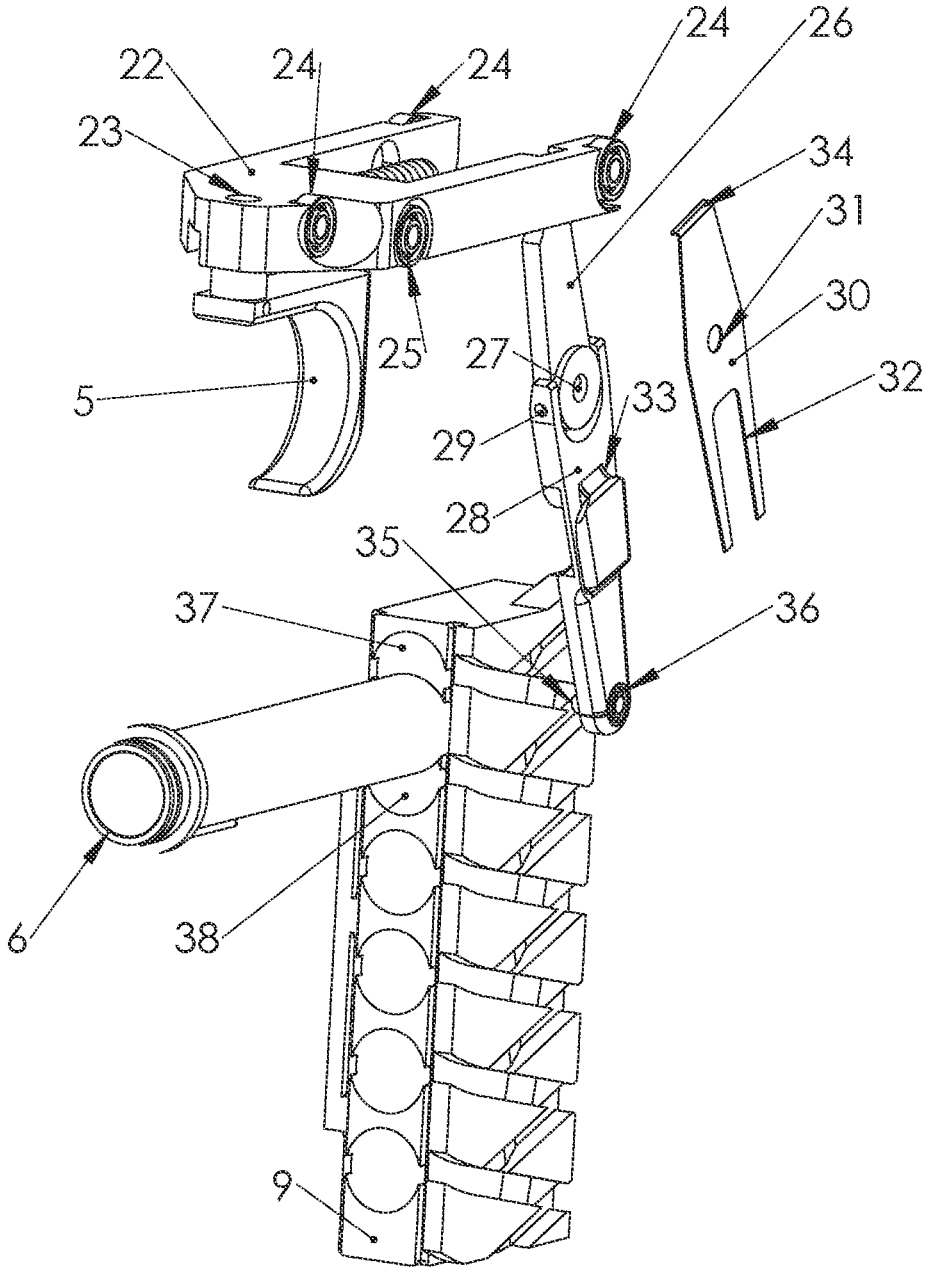
FIG. 3 is a schematic drawing that illustrates a free floating assembly view of a magazine indexing mechanism operated by a trigger mechanism according to one embodiment of the invention.

FIG. 3 is a free-floating subassembly schematic drawing of a magazine indexing system illustrating the interaction of the trigger mechanism and a relative location of a barrel 6. 22 is a trigger slide which runs in a cavity in the top portion of the handgun frame. 5 is the trigger finger pull which is mounted to trigger slide 22 by pivot pin 23. Trigger pull 5 is free to swivel about the axis of pivot pin 23 which prevents the curling motion of the shooters trigger finger from imparting side forces or torque on the trigger mechanism and the handgun during trigger pull. Trigger slide 22 may simply slide in the handgun housing or it may be carried on bearing sets 24 and 25. Bearings 24 are offset from the center of trigger slide 22 such that they run on the top portion of the frame cavity only and do not touch the bottom portion of the frame cavity. Bearing 25 and a corresponding bearing, not visible but located on the opposite side of trigger slide 22, are offset in position so that they run only on the bottom portion of the frame cavity and do not engage the top portion of the frame cavity. This offset arrangement allows for all bearings to run on mating surfaces and eliminate any clearance or backlash in the trigger slide mechanism to affect a very smooth precise movement. 26 is an upper portion of a magazine indexing arm and is pivotally engaged in a slot on the inside of a trigger slide extension. The upper portion of magazine indexing arm 26 may be pivoted at point 27 and mounted to the handgun frame at that point. 28 is a lower portion of a magazine indexing arm and may be pivotally mounted to an upper portion 26 of a magazine indexing arm by a pivot pin 29. 30 is a flat spring which may bias the lower portion of a magazine indexing arm forcing a cam follower 35 into cam tracks along the side of magazine 9. The spring 30 is shown out of position for clarity. When fully assembled, flat spring 30 would be mounted with its pivot point 31 matching pivot point 27 and fork 32 engaged into locating tab 33 and upper spring contact tab 34 would be engaged with and press against upper portion of the magazine index arm 26. 36 are two tandem-mounted ball bearings which may mount cam follower 35 to lower magazine index arm 28. The assembly drawing is shown with the trigger in its released or relaxed position which places magazine 9 in a half index position. In this position barrel 6 is located halfway between cartridge chamber 37 and cartridge chamber 38. On the next trigger pull, trigger slide 22 would travel back to the right of the drawing and magazine index arm 26 and 28 would swing forward which would propel cam follower 35 along a cam track, thus raising magazine 9 up half of its index period and place magazine cartridge chamber 38 in line with barrel number 6 for the next cartridge firing.

As shown in the illustration, the magazine moves from the lower end of the handgun to the upper end. The direction of the magazine movement can be changed to move from the top of the handgun to the bottom by merely changing the sequence of ramps in the bottoms of each cam track.

Figure 4:
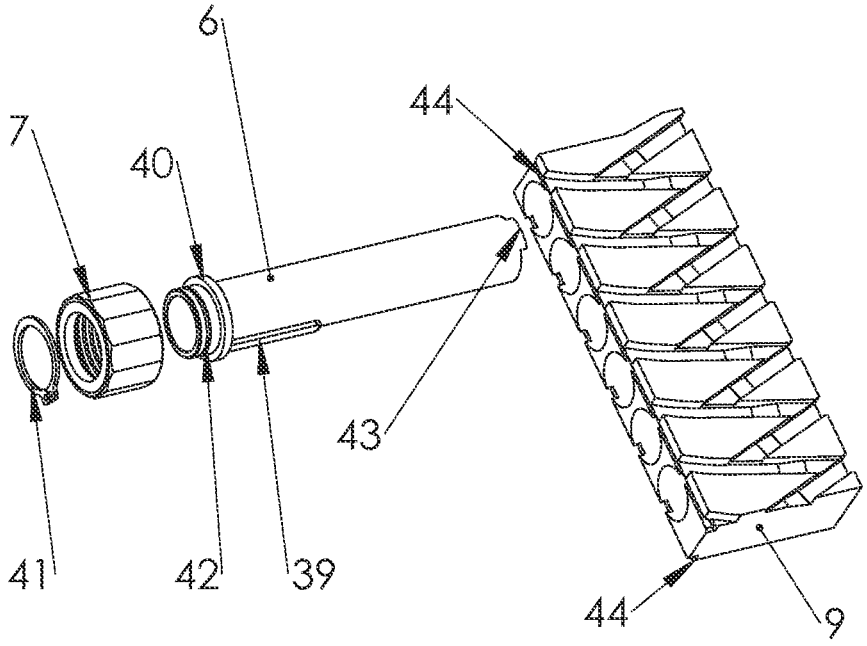
FIG. 4 is a schematic drawing that illustrates an exploded view of a possible quick-change barrel configuration and a magazine and barrel tongue and groove matching system to prevent mismatching calibers.

FIG. 4 illustrates a quick change barrel and magazine mating system. Quick change barrel 6 is equipped with a locating key 39 which engages a matching keyway in a handgun frame (not shown). Barrel 6 is also equipped with a retaining flange 40 which mates with a handgun frame. Barrel 6 is retained in the handgun frame by gland nut 7 which clamps flange 40 to handgun frame utilizing internal threads in gland nut 7 and external threads on the handgun frame. Gland nut 7 may be retained on barrel 6 by snap ring 41 which engages groove 42. Barrel 6 may also be equipped with two parallel tabs 43, one shown and one not visible on the opposite side of the barrel. Tabs 43 may mate with corresponding parallel grooves 44 in magazine 9. The width and spacing of tabs 43 and corresponding grooves 44 may be unique to each caliber size and corresponding barrel and magazine combination. The uniqueness of the size and spacing of the tabs and grooves prevent mismatching barrels and magazines of different caliber.

Figure 5:
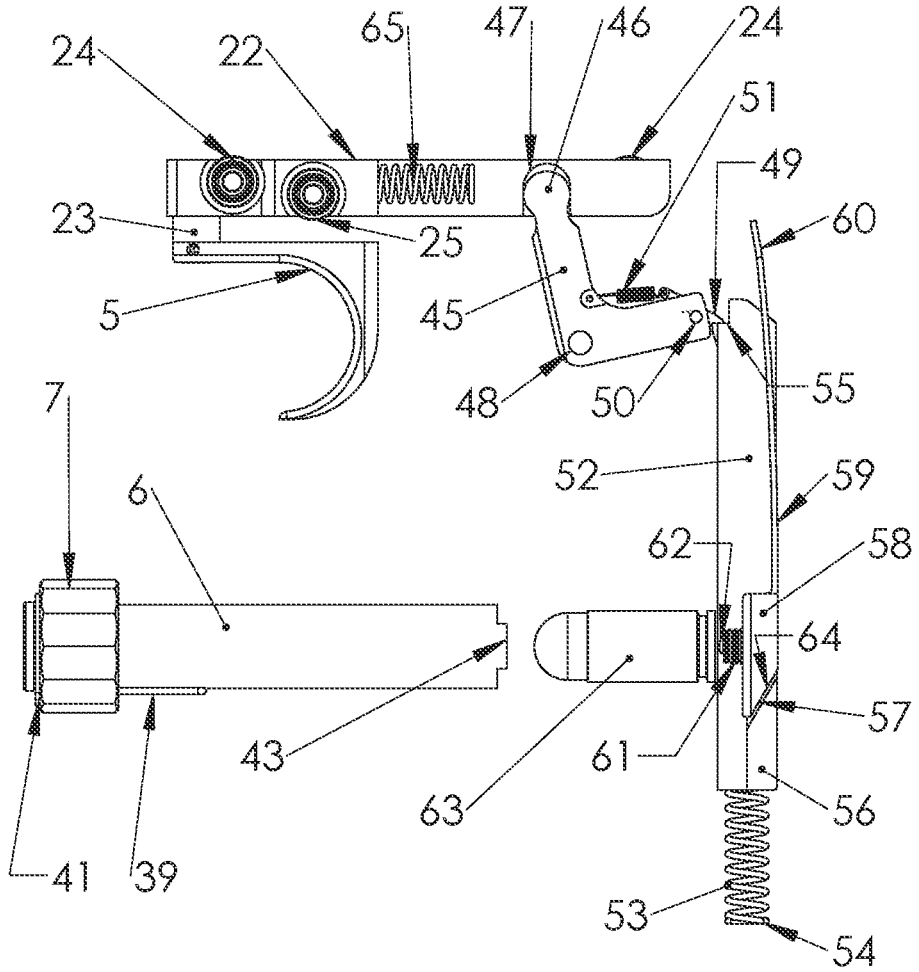
FIG. 5 is a schematic free floating assembly drawing of a firing mechanism and corresponding trigger mechanism in and "at rest" position.

FIG. 5 is a free-floating subassembly drawing that illustrates the trigger, hammer and firing mechanism. FIG. 5 is shown with the trigger in its "at rest" or non-firing position with trigger return springs 65 in their relaxed or extended position. Hammer actuating arm 45 has a cylindrical portion 46 which engages slot 47 in trigger slide 22. Hammer actuating arm 45 may be pivoted at point 48 and mounted to a handgun frame (not shown). Sear 49 may be pivotally mounted to hammer actuating arm 45 by pin 50. Sear 49 may be biased in its engaged or counterclockwise position by spring 51. 52 is a hollow cylindrical tubular hammer with an internal spring 53 which may be mated at its bottom end 54 against the bottom of a spring pocket in a handgun frame (not shown). Spring 53 urges hammer 52 upward. Surface 55 of hammer 52 engages sear 49. The eccentric firing pin 61 may be manually adjusted to fire either center fire cartridges or rim fire cartridges. Plunger 62 is aligned with primer cap of cartridge 63, which cartridge would be enclosed in a firing chamber in a handgun magazine 9 (not shown for clarity). Firing anvil 58 is also equipped with an inclined or wedge-shaped surface 64 that matches the inclined wedge-shaped surface 57 of firing hammer 52.

Figure 6:
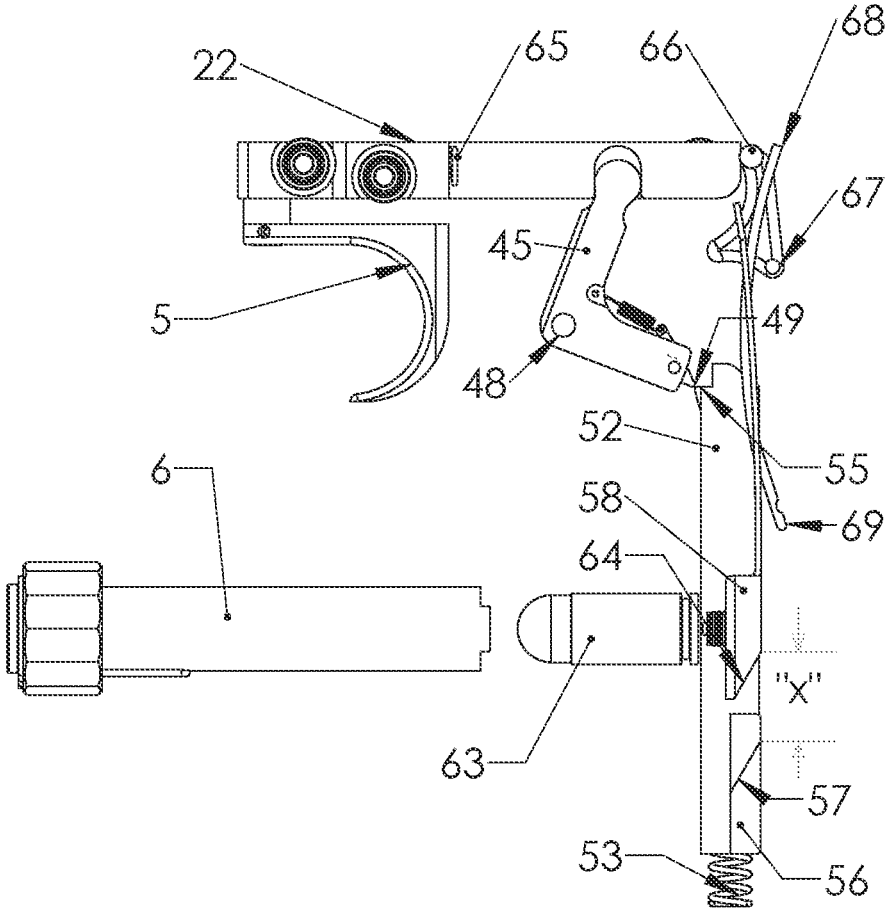
FIG. 6 is a schematic free floating assembly drawing of a firing mechanism and corresponding trigger mechanism at the "trigger trip" position just before firing.

FIG. 6 is a free-floating subassembly drawing similar to FIG. 5 with the trigger 22 pulled to the position just prior to trigger trip and handgun firing. The rightward motion of trigger 22 has rotated arm 45 about its pivot point 48 and sear 49 has depressed Hammer 52 downward compressing spring 53. Sear 49 has moved across surface 55 of hammer 52 to a point just prior to slipping off of surface 55. This action has created a gap "X" between wedge surface 57 on hammer 52 and wedge surface 64 on anvil 58. Hammer release lever 66 is pivoted about axis 67 and has been depressed and rotated clockwise by the engagement of trigger slide 22 and the rounded upper surface of lever 66. Hammer release lever 66 is urged counterclockwise toward trigger 22 by tension leaf spring 68. Leaf spring 68 is rigidly mounted at point 69 in the handgun frame 2 (not shown for clarity).

Figure 7:
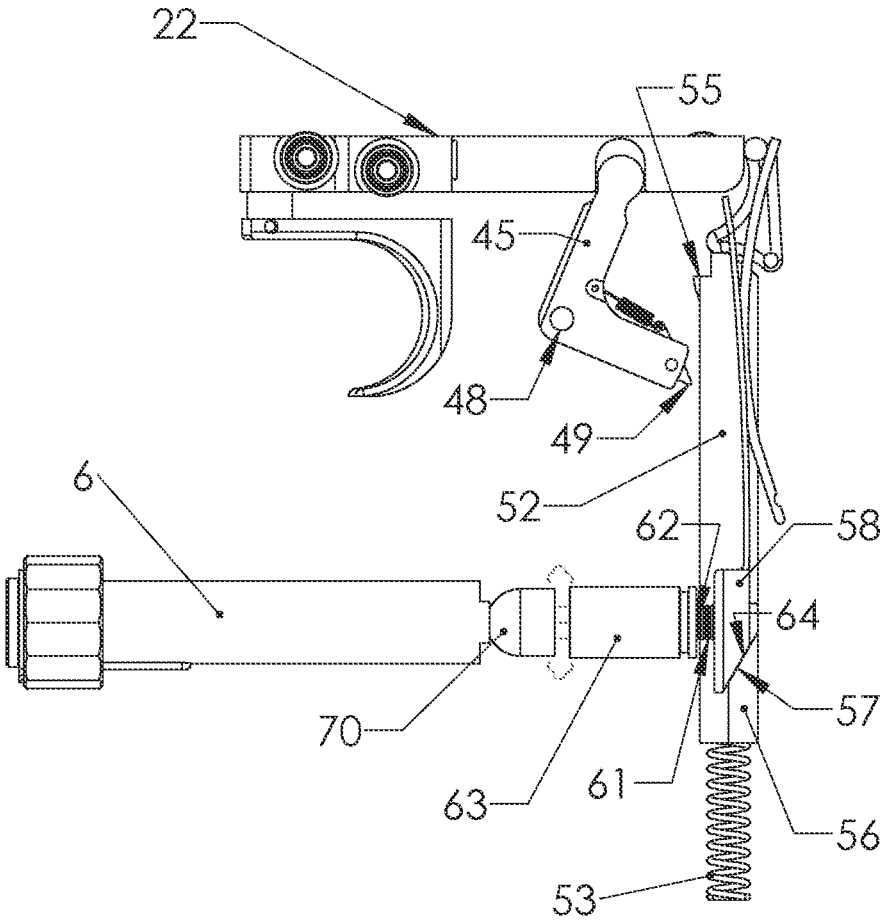
FIG. 7 is a schematic free floating assembly drawing of a firing mechanism and corresponding trigger mechanism in the "just fired" position. This drawing also shows the hammer intermediate refraction mechanism in its retracted or "firing" position.

FIG. 7 is a free-floating subassembly drawing similar to FIGS. 5 and 6, with the firing assembly in its "just fired" position. Trigger 22 has moved farther to the right rotating lever 45 farther and causing sear 49 to slip off of surface 55 of hammer 52. Under the pressure of spring 53, hammer 52 has slammed upward causing inclined surface 57 of lug 56 on hammer 52 to engage inclined surface 64 on anvil 58 which in turn has driven anvil 58 and firing pin 61 and plunger point 62 to the left into the firing primer of cartridge 63 thus exploding the charge in cartridge 63 and expelling bullet 70.

Figure 8:
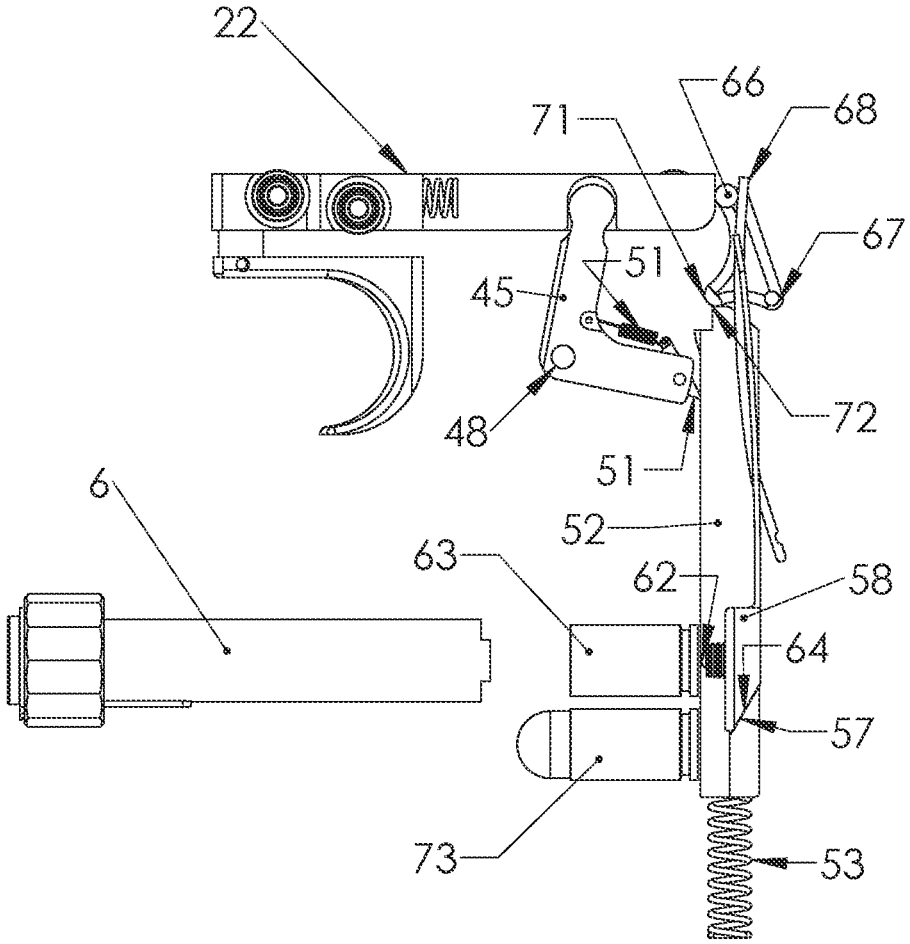
FIG. 8 is a schematic free floating assembly drawing of a firing mechanism and corresponding trigger mechanism with the trigger in its partially returned position and the hammer intermediate refraction mechanism in its "forward/activated" or "safe" position.

FIG. 8 is a free-floating subassembly drawing similar to FIG. 7. The firing assembly is shown with trigger 22 partially returned from its firing position. Lever 45 has rotated counterclockwise about pivot point 48 and sear 49 has come in contact with the sidewall of hammer and 52 and rotated clockwise extending spring 51. The leftward travel of trigger slide 22 has released hammer release lever 66 which, under the urging of spring 68, has rotated counterclockwise about pivot point 67 causing surface 71 of lever 66 to engage a top surface 72 of hammer 52. Under the power of spring 68, the action of lever 66 on hammer 52 has driven hammer 52 down sufficiently such that inclined surface 57 has slightly separated from inclined surface 64 allowing anvil 58 to retract and move to the right away from cartridge 63. Plunger point 62 is now clear of cartridge 63 allowing it to be indexed, along with magazine 9 (not shown) to bring the next cartridge, 73 into position for firing.

Figure 9:
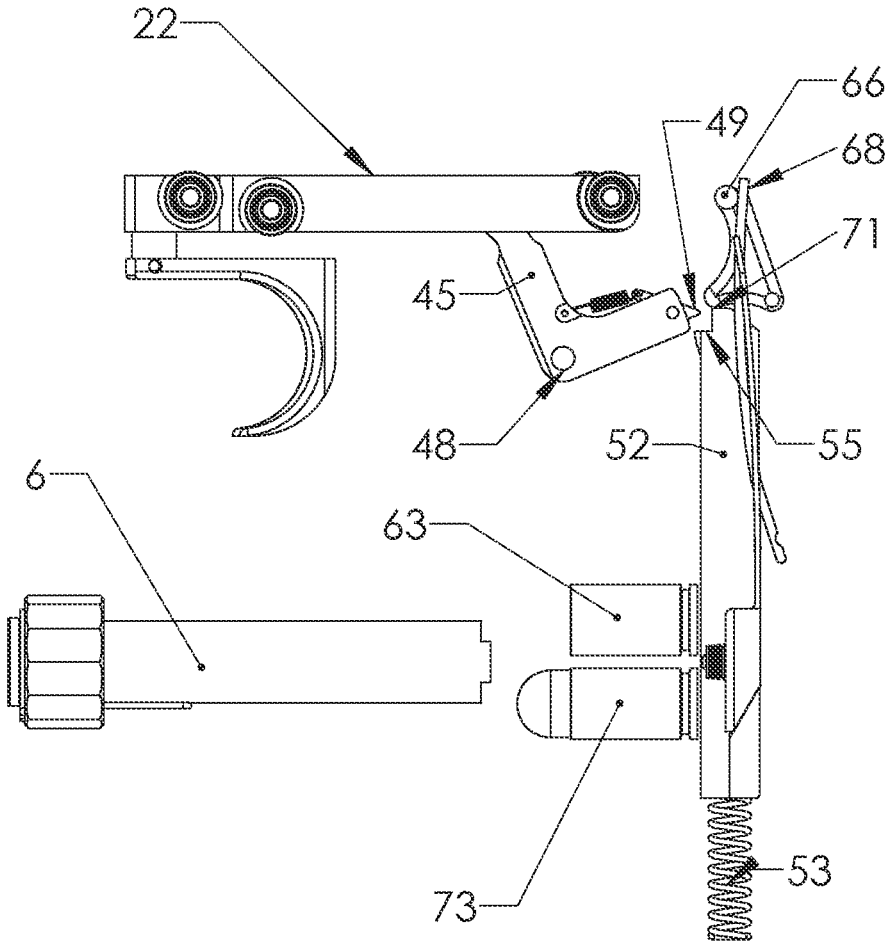
FIG. 9 is a schematic free floating assembly drawing of a firing mechanism and corresponding trigger mechanism with the trigger in its fully returned position and the hammer intermediate retraction mechanism in its full "forward/activated" or "safe" position.

FIG. 9 is a free floating subassembly drawing similar to FIG. 8 with the assembly shown with trigger 22 fully returned to its relaxed position. Lever 45 has rotated counterclockwise about pivot point 48 and sear 49 has cleared surface 55 of hammer 52 and has been returned to its full counterclockwise and locked position by spring 51. Magazine 9 (not shown for clarity) has been indexed up one half of the index period moving spent cartridge 63 to a one half position above barrel 6 and the firing position and has moved cartridge 73 into a one half stage position below barrel 6 and the firing position.

Figure 10:
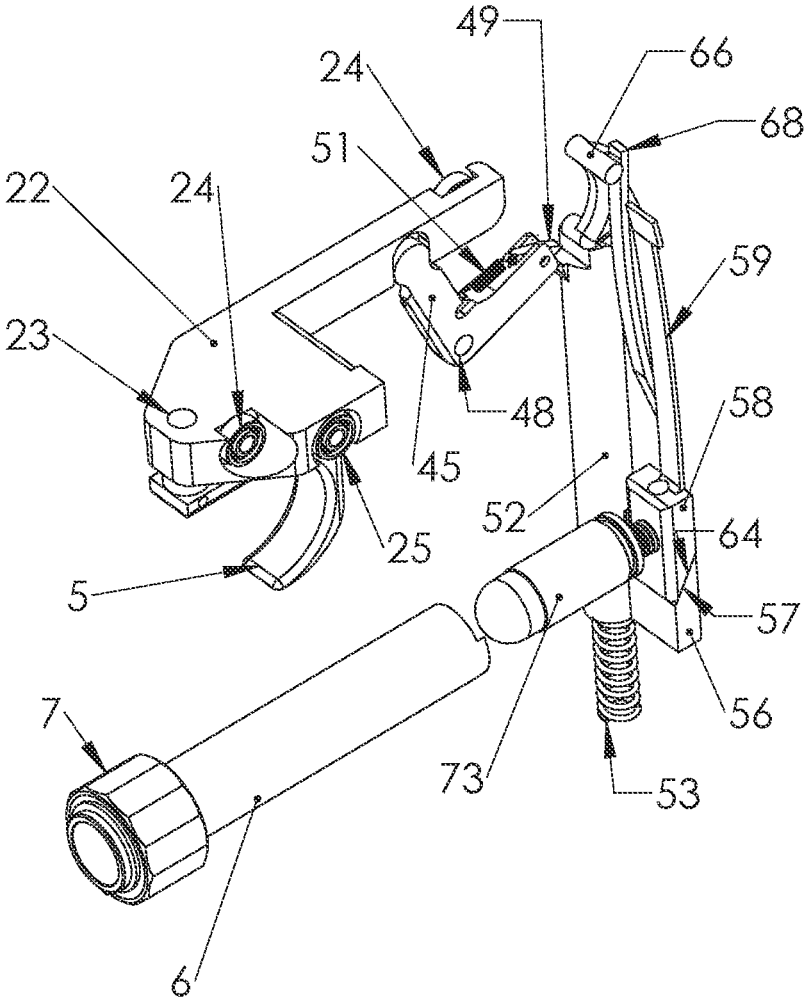
FIG. 10 is a schematic free floating isometric assembly drawing that illustrates a firing mechanism and trigger mechanism with the trigger fully returned to its "at rest" and "safe" position.

FIG. 10 is an isometric view of a free-floating subassembly drawing that illustrates the trigger and firing mechanism described in FIG. 5 through FIG. 9 above.

Figure 11:
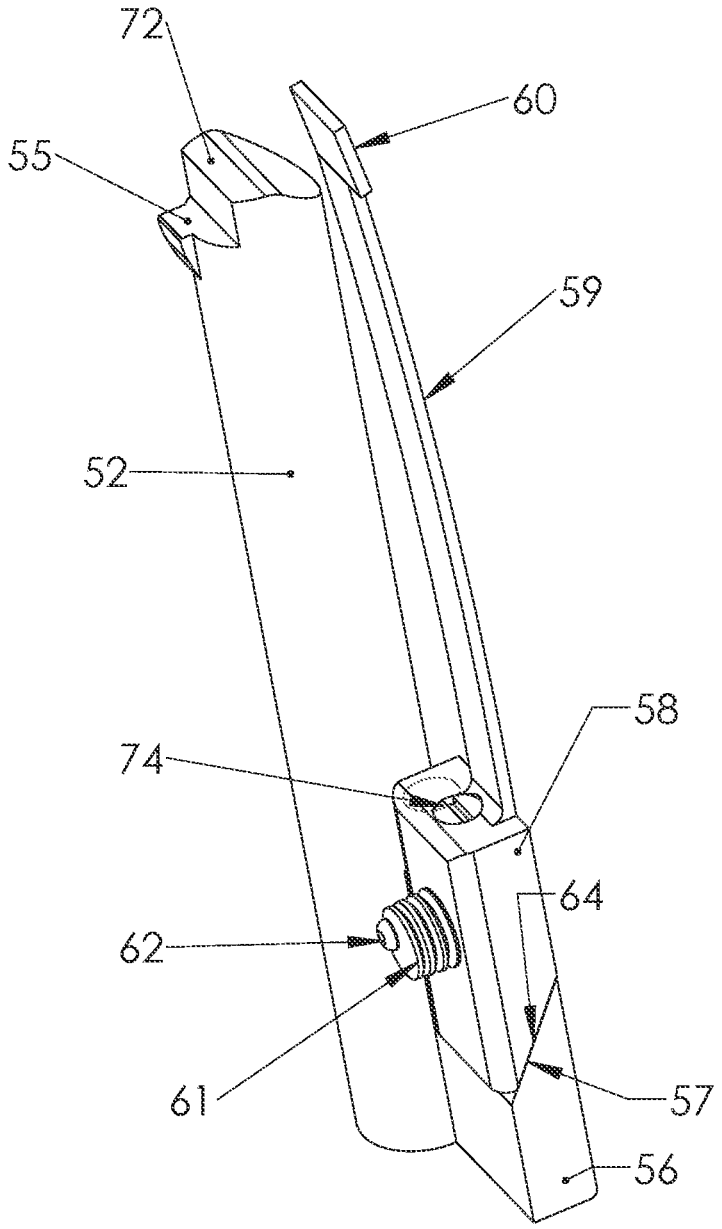
FIG. 11 is a schematic free floating isometric assembly drawing that illustrates a firing hammer and a firing anvil along with an eccentric firing pin.

FIG. 11 is isometric view of a free-floating subassembly drawing showing close up views of the hammer and anvil components of the firing mechanism. 52 is the body of the hammer and 55 is the surface on which the sear rides to drive the hammer to its cocked position. 72 is the top surface of hammer 52 that engages the hammer release lever. 56 is a lug attached to hammer 52 which contains inclined upper surface 57 which drives mating inclined surface 64 of anvil 58. The angle of the two inclined surfaces 57 and 64 determine the mechanical advantage with which the hammer strikes the anvil. 61 is an eccentric firing pin and 62 a plunger point which actually engages and fires the cartridge primer. 74 is a spring-loaded ball detent or spring plunger detent, which engages notches (see FIG. 12 below) in the eccentric firing pin 61 and locates the firing pin in either the center fire position or the 180° rotated rim fire position.

Figure 12:
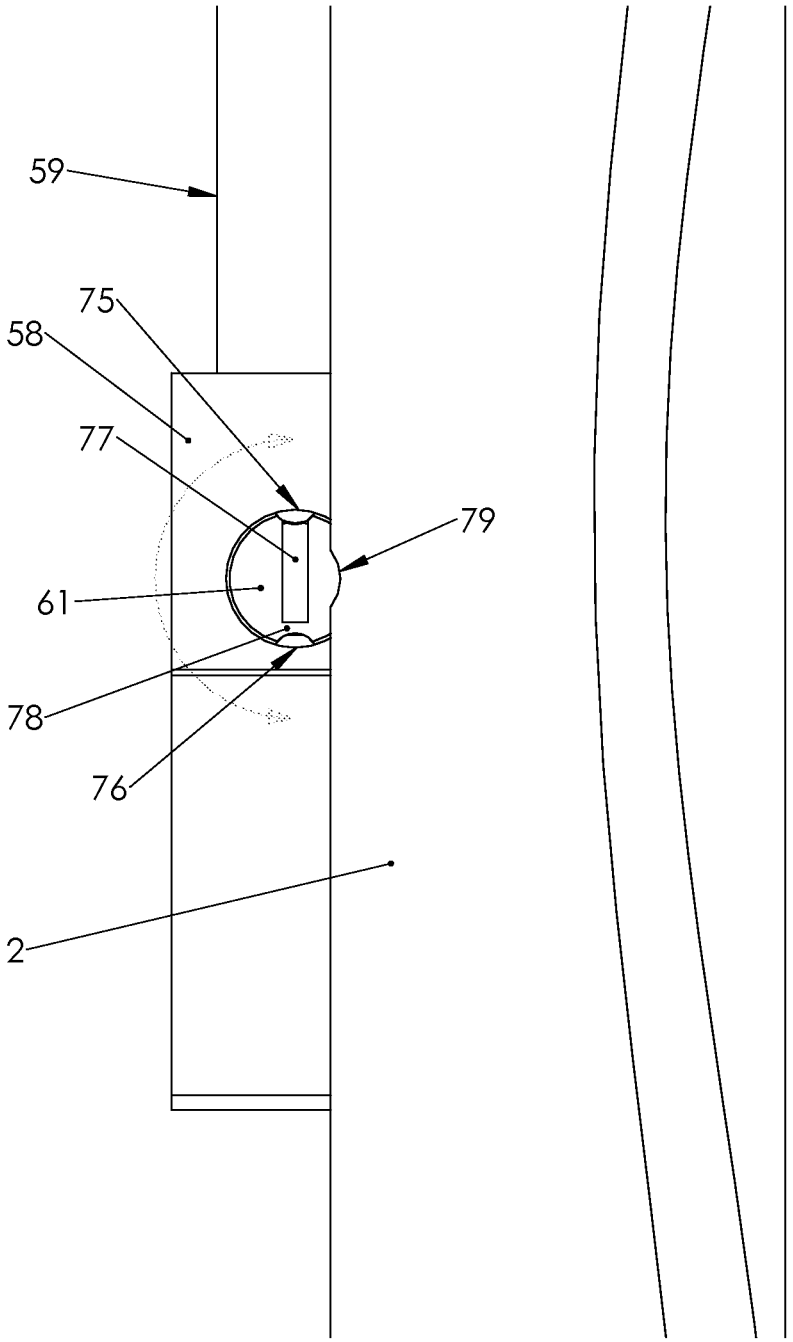
FIG. 12 is a schematic drawing that illustrates a 180° rotation limiting eccentric firing pin adjustment slot.

FIG. 12 is a schematic drawing that illustrates the manual adjustment of an eccentric firing pin 61 from a center fire position to a rim fire position. 2 is the right half of a handgun frame with the left half not shown for clarity. 58 is a firing anvil with its support spring 59. 75 is a locking notch in eccentric firing pin 61 which engages detent pin 74 (not shown, see FIG. 11) and 76 is a locking notch to lock eccentric firing pin 61 in the rim fire position by engaging 74. 77 is an offset screwdriver slot in eccentric firing pin 61 and 78 represents a block in slot 77 to locate a screwdriver in an upward offset position. 79 is a clearance radius in gun frame 2 which will clear the lower end of screwdriver slot 77 when rotated counterclockwise only. If it is attempted to rotate eccentric firing pin 61 clockwise using slot 77, the upper portion of the blade of the screwdriver would strike gun frame 2 above clearance radius 79 and said screw driver could not be rotated in the clockwise direction. Thus eccentric firing pin 61 can only be rotated 180° which will allow proper alignment for either a center fire position or a rim fire position.

Figure 13:
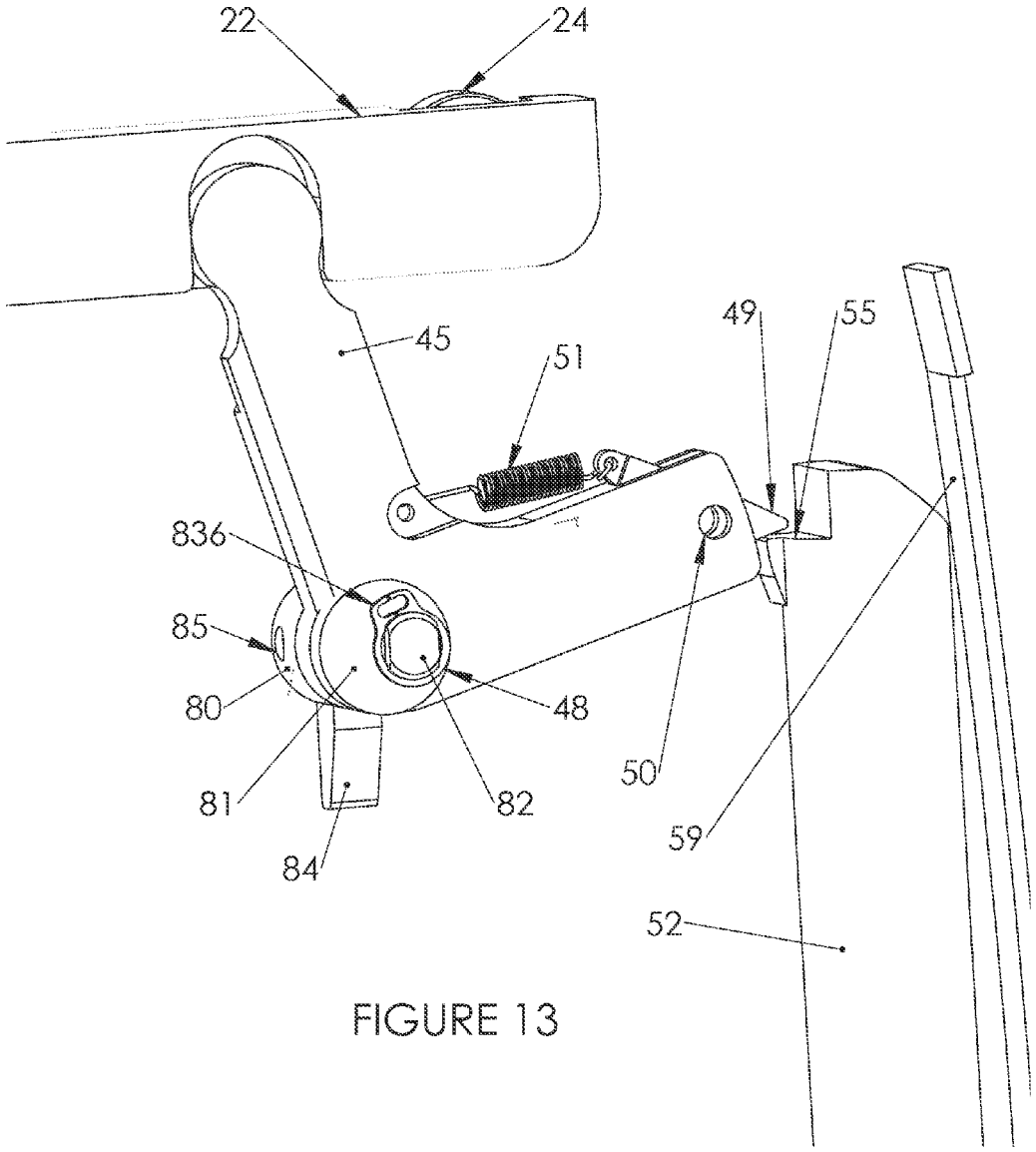
FIG. 13 is an isometric schematic free floating assembly drawing showing a trigger mechanism with an eccentric pivot axis safety device in its "activated" or "firing" position.

FIG. 13 is a schematic free-floating subassembly drawing that illustrates a safety device. Trigger 22 engages Lever 45 which is pivoted about an axis 48. Sear 49 is attached to lever 45 by pin joint 50 and retained in its counterclockwise or driving position by spring 51. Sear 49 engages hammer 52 at surface 55 to affect depression and cocking of hammer 52. Pivot shaft 80 is rotatably mounted in the right half 2 of a gun frame (not shown for clarity) and has eccentric pin 82 which extends through pivot joint 48 on Lever 45. Thumb Lever 84 is pivotally mounted to pivot shaft 80 at pin joint 85. Thumb Lever 80 is exposed on the outside of the gun frame and is used to manually rotate and lock the eccentric pivoting assembly from an active position to a safe position. Eccentric pin 82 is supported by eccentric bushing 81 which is also mounted in an inner wall of a gun frame 2 (not shown for clarity). Pivot shaft 80 and its eccentric Journal 82 are retained in Lever 45 by a snap ring 83. In the position shown, with eccentric pin 82 rotated toward hammer 52, sear 49 will engage surface 55 of hammer 52 and press it down when trigger slide 22 is moved to the right and rotates Lever 45. This is the active state of the safety mechanism.

Figure 14:
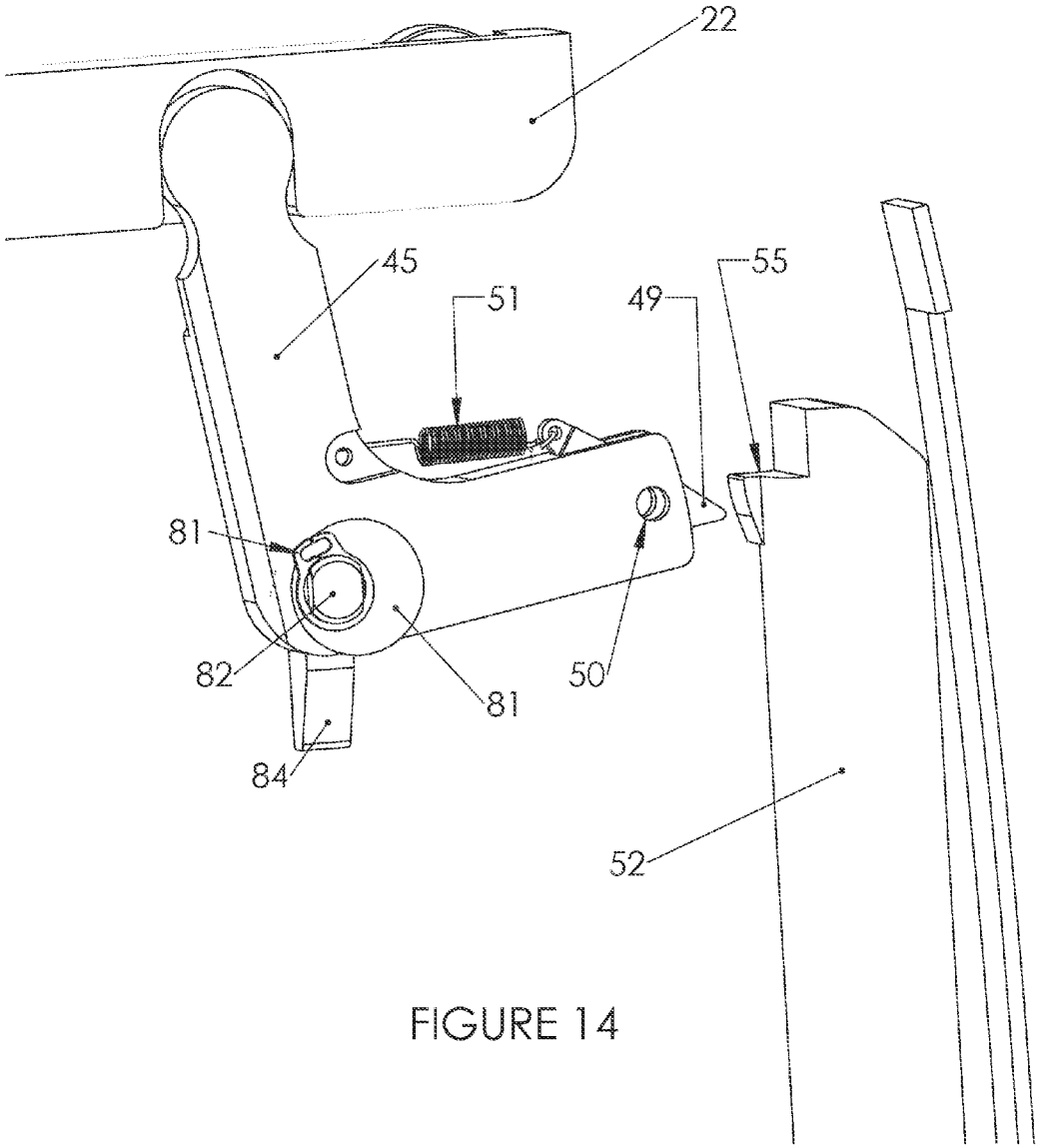
FIG. 14 is an isometric schematic free floating assembly drawing showing a trigger mechanism with an eccentric pivot axis safety device in its "retracted" or "safe" position.

FIG. 14 is a schematic free-floating subassembly drawing that illustrates the safety device described and illustrated in FIG. 13 above with the device rotated to its safety position. Eccentric pin 82 has been rotated 180° which positions the pivot axis of lever 45 away from hammer 52 thereby preventing sear 49 from reaching surface 55 and engaging hammer 52 for cocking and weapon firing.

Figure 15:
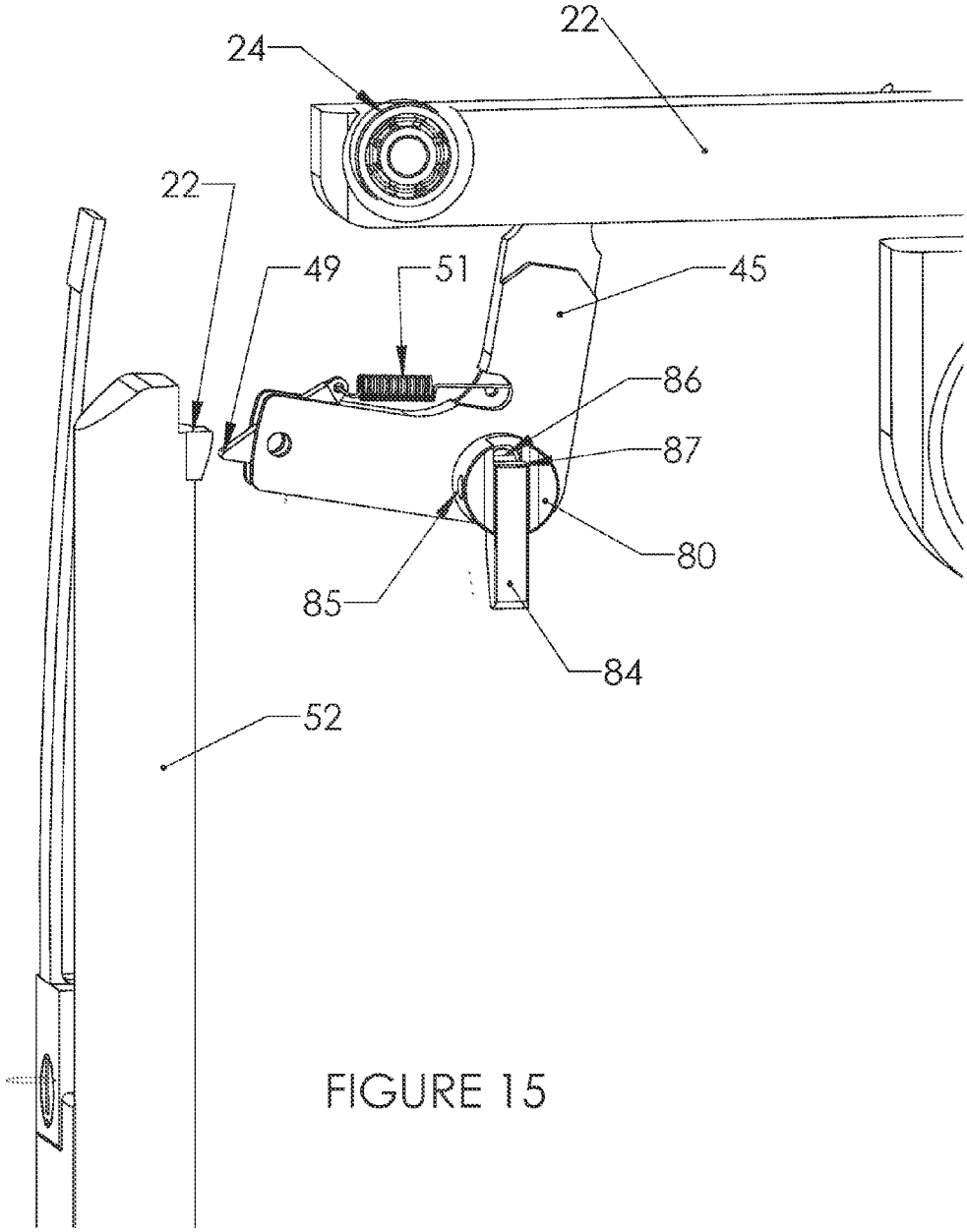
FIG. 15 is an isometric schematic free-floating assembly drawing showing a trigger mechanism with an eccentric pivot axis safety device in its "retracted" or "safe" position from the opposite perspective as that shown in FIG. 14.

FIG. 15 is a free-floating isometric subassembly drawing that illustrates safety device described and illustrated in FIG. 13 and FIG. 14 above. FIG. 15 shows the safety device from the opposite side (right hand side, outside of the gun) illustrating the actuating thumb Lever 84 in its down and locked position with eccentric shaft 80 rotated to place the pivot axis of lever 45 out of reach of hammer 52 and in its safe position. In the down position shown for thumb Lever 84 it would be engaged in a slot in the right half of gun frame 2 (not shown for clarity) which would lock lever 84 in position. Thumb Lever 84 has flat surfaces 87 which engage flat detent spring 86 to hold thumb Lever 84 in either a down and locked position or rotated up 90° about pivot pin 85 to a manually operable position.

Figure 16:
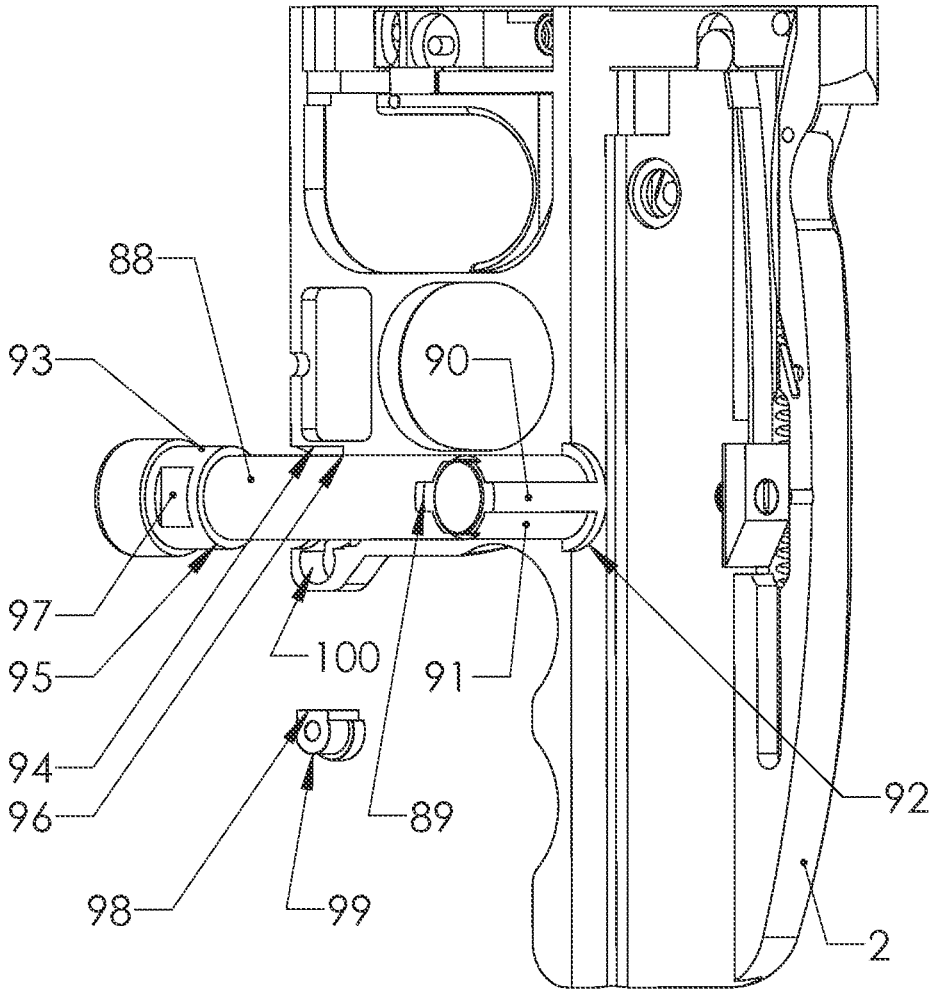
FIG. 16 is an isometric schematic assembly drawing that illustrates a quick change barrel in its partially assembled position.

FIG. 16 is a schematic assembly drawing that illustrates a different quick change barrel arrangement from that described in FIG. 4 above. Barrel 88 has two locking ears 89 at the interior end of barrel 88. Gun frame 2 has two grooves 90 milled longitudinally along the sides of barrel bore 91. Gun frame 2 has undercut diameter 92 at the interior end of barrel bore 91. Barrel 88 also has an enlarged pilot diameter 93 which accurately fits into bore 94 in gun frame 2. Shoulder 95 of pilot diameter 93 accurately abuts against shoulder 96 in gun frame 2 at the end of pilot bore 94 and accurately locates barrel 88 longitudinally. With barrel 88 fully inserted into housing 2 it may be rotated 90° allowing ears 89 to engage counter bore 92. The engagement of ears 89 and counter bore 92 lock the barrel in place in a longitudinal direction. Flat 97 is milled into diameter 93 and will align with bore 100 in gun frame 2 when barrel 88 is fully engaged in gun frame 2. Locking key 99 has a flat locating surface 98 which will engage flat 97 when barrel 88 is fully engaged in handgun frame 2 and key 99 is inserted into bore 100.

Figure 17:
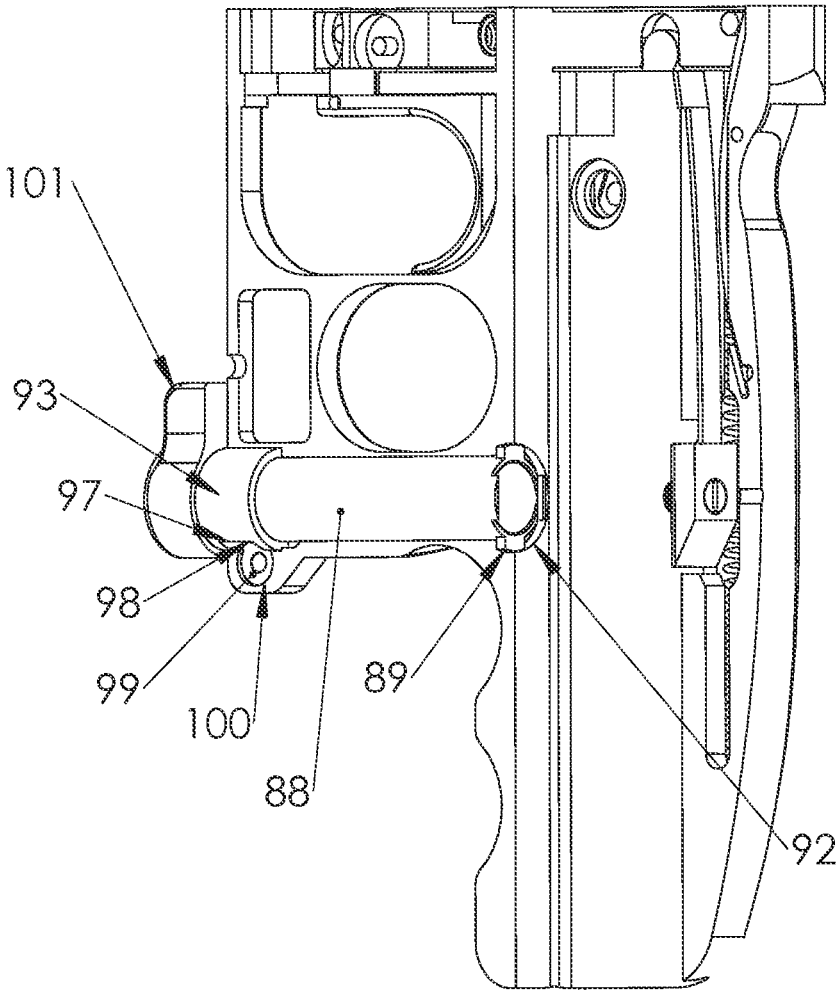
FIG. 17 is an isometric schematic assembly drawing that illustrates a quick change barrel in its fully assembled position.

FIG. 17 is a schematic assembly drawing that illustrates the quick change barrel system described in FIG. 16 above with the barrel in its fully engaged position. Barrel 88 has been moved longitudinally to the right to the fully engaged position and rotated 90° thus engaging ears 89 and counter bore 92. Locking key 99 has been engaged in bore 100 of gun frame 2 and flat surface 98 of locking key 99 is engaging flat groove 97 in pilot diameter 93. 101 is a thumb lug integral with the outer end of barrel 88 to facilitate turning and locating barrel 88 into its locked position.

Figure 18:
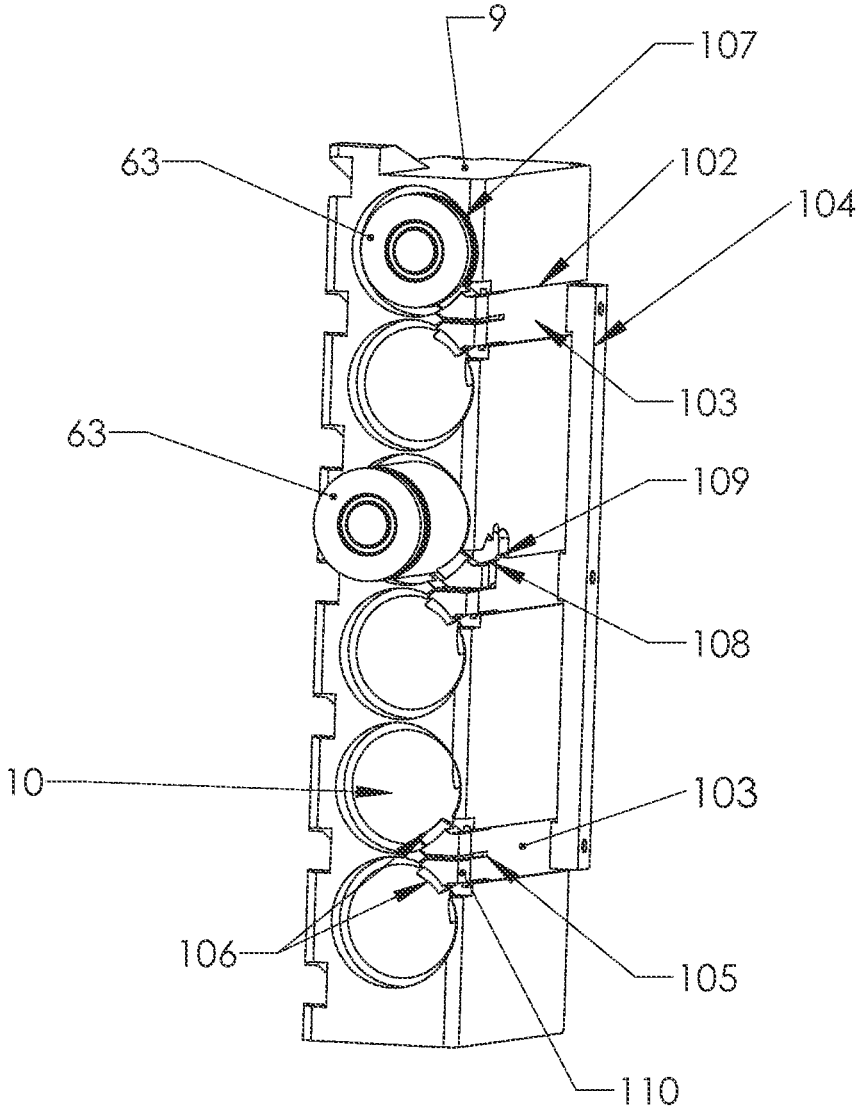
FIG. 18 is an isometric schematic drawing that illustrates a magazine with cartridge ejection fingers which also served as a locking device to hold automatic style ammunition in a firing chamber style magazine.

FIG. 18 is a schematic assembly drawing that illustrates a cartridge retention and ejection system incorporated into the cartridge magazine. Magazine 9 has a plurality of undercut slots 102 cut into the side of the magazine between alternate pairs of cartridge bores 10. A plurality of spring strip ejection bars 103 fit into respective slots 102 and is bound together by ejection finger pull 104. Ejection spring bars 103 are bifurcated on their free end by slots 105. A plurality of tabs 106 are attached to the bifurcated ends of ejection bars 103. Tabs 106 engage ejection slots 107 in cartridges 63. The outer edges 108 of ejection bars 103 are relieved at the end near the bifurcated slot 105. This relief allows the bifurcated spring ends of ejection bars 103 to be clear of the undercut 109 in the magazine wall and allow the spring ends of bars 103 to spring outward allowing the insertion of cartridges 63. When magazine 9 is inserted into the handgun, machined pads 110 are adjacent to the handgun frame magazine wall and prevent spring fingers 103 from springing outward and thus keep tabs 106 firmly engaged in cartridge notches 107. This arrangement allows the use of non-flanged automatic type ammunition in a revolver type magazine which normally requires flanged ammunition.

Figure 19:
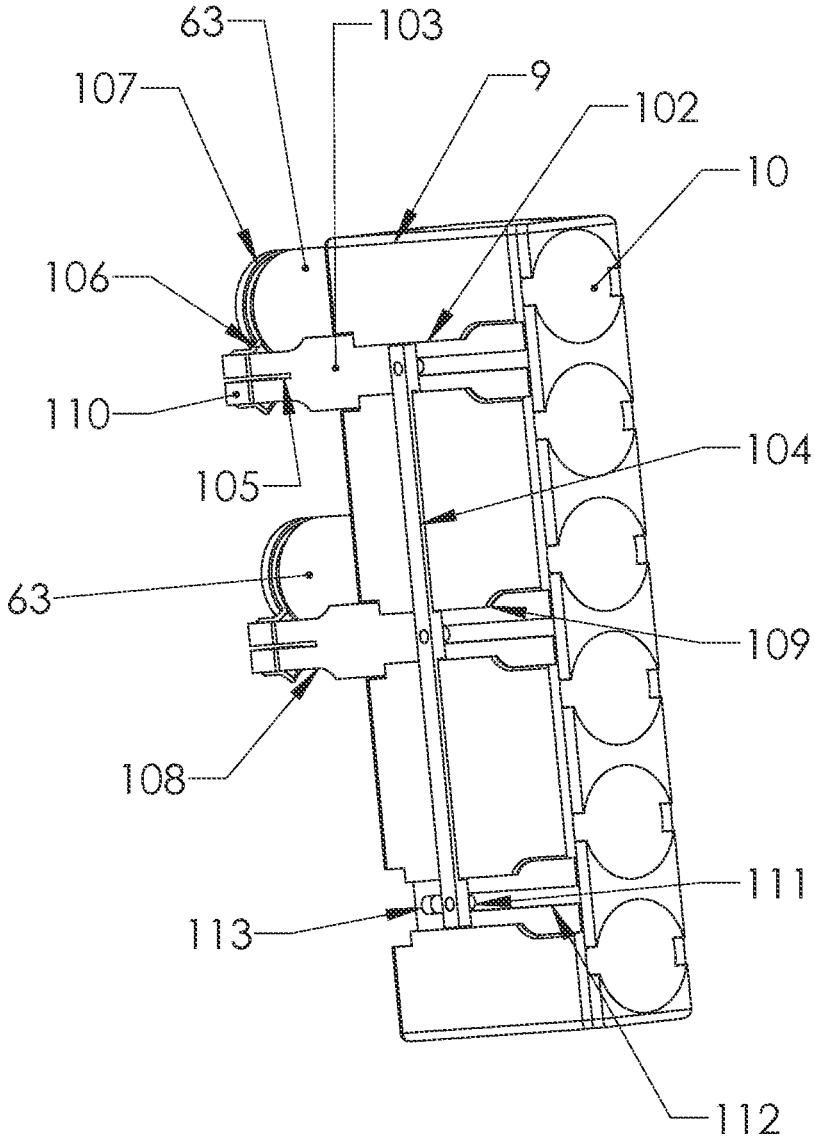
FIG. 19 is an isometric schematic drawing that illustrates the magazine assembly of FIG. 18 above with cartridges partially ejected.

FIG. 19 is a schematic assembly drawing that illustrates magazine 9 with cartridges 63 partially ejected from their respective firing chambers 10 by the ejection finger system. Ejection finger pull 104 and spring strip ejection bars 103 have been moved to the left guided by slots 102 and undercuts 109 in magazine 9. Tabs 106 are engaged in cartridge grooves 107 and have partially extracted cartridges 63 from magazine 9. Attached to the ejection finger pull 104 are pins 111 which ride in slots 112 machined into the body of magazine 9. The ejection finger subassembly, consisting of ejection bars 103 and ejection finger pull 104, is retained in magazine 9 by pins 111 encountering the ends 113 of slots 112, thus preventing the subassembly from being slid out of magazine 9.

Figure 20:
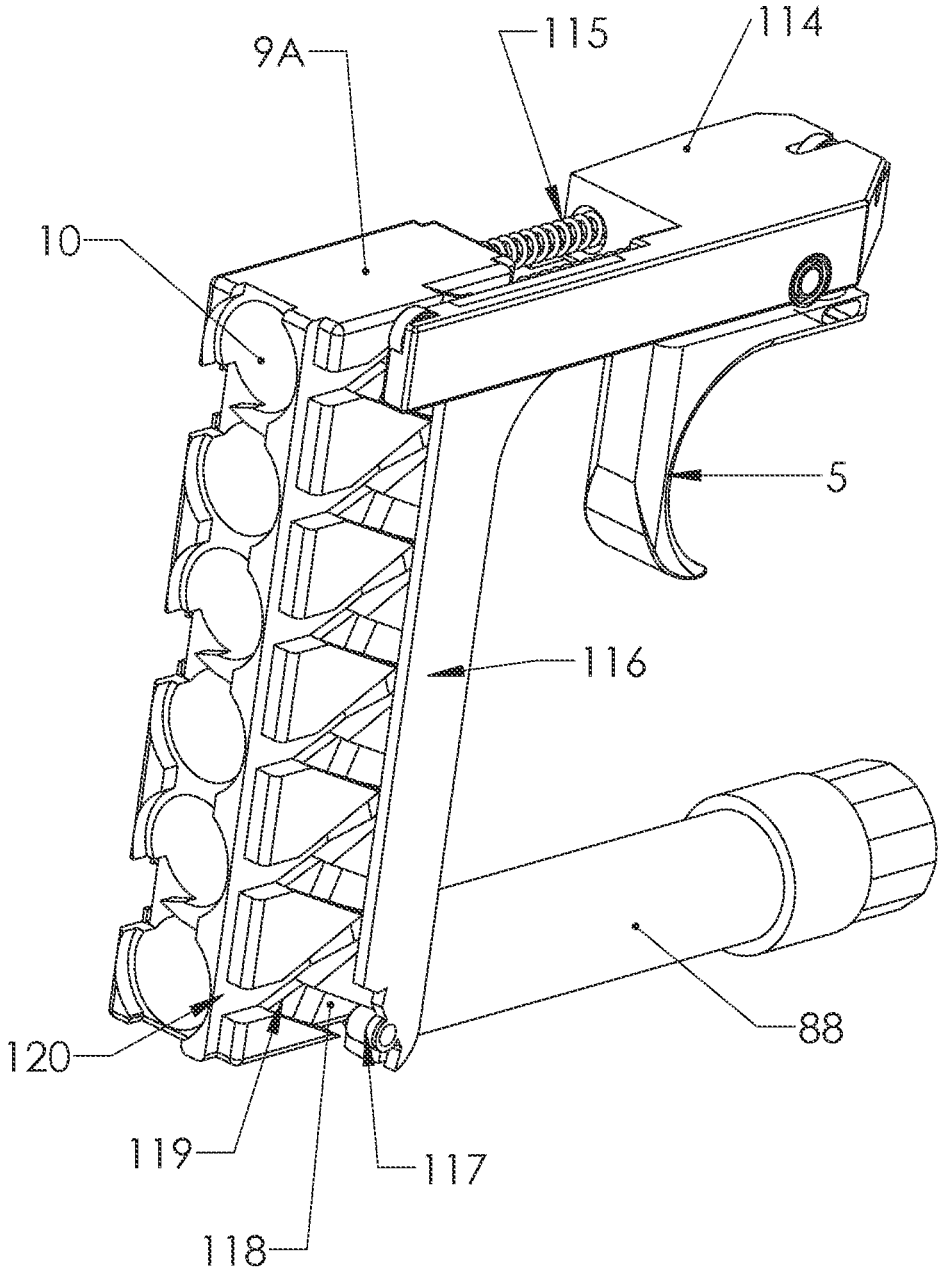
FIG. 20 is a free-floating schematic assembly drawing that illustrates an alternative embodiment of a magazine indexing system.

FIG. 20 is a free-floating subassembly schematic drawing that illustrates another embodiment of a trigger actuated magazine indexing system. 9A is a multi-cartridge magazine similar to the magazine illustrated in FIG. 2 with the exception that 9A has been inverted and feeds in from the top of the gun to the bottom. 114 is a trigger carriage which may either slide or roll in the handgun housing (not shown). Trigger finger pull 5 is attached to trigger carriage 114 with a pivot pin similar to the arrangement described in FIG. 5. Springs 115 are mounted in pockets in trigger carriage 114 and butt against a handgun frame (not shown) and return trigger carriage 114 to its forward position. Leaf spring 116 is rigidly attached to trigger carriage 114 and extends down beside magazine 9A. Cylindrical cam follower 117 is rotatably mounted (or rigidly mounted) in leaf spring 116 and engages cam track 118 in magazine 9A. As trigger carriage 114 travels back during trigger pull, cam follower 117 rides in cam track 118 in magazine 9A sequentially indexing magazine 9A down through the handgun, sequentially aligning cartridge chambers 10 with barrel 88. When cam follower 117 encounters ramp 119 in the bottom of cam track 118, leaf spring number 116 flexes outward allowing cam follower 117 to ride over ramp 119 and fall into cam track 120. Cam track 120 is a dwell portion which aligns cartridge chambers 10 with barrel 88 during a significant part of the trigger stroke prior to gun firing. Cam track 120 is slightly different from cam track 14 in that the motion of cam follower 117 is straight line wherein the motion of cam follower 36 is an arc motion created by the pivoted motion of arm 28. Magazine 9A may be indexed in one half period steps (or partial—partial period steps) similar to the operation described in FIG. 3, depending on the design of the cam tracks in the side of the magazine.

Figure 21:
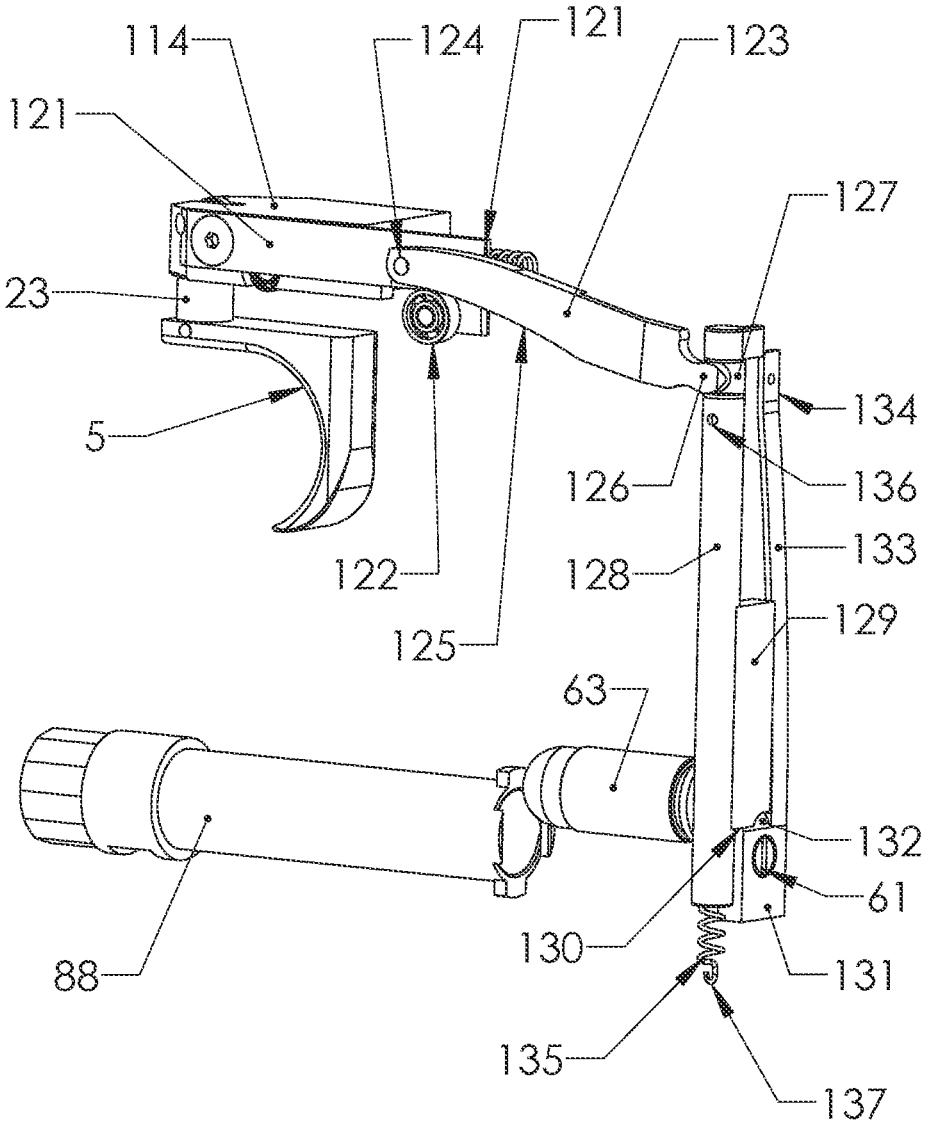
FIG. 21 is a free-floating assembly schematic drawing that illustrates an alternative embodiment of a trigger/hammer firing mechanism in its initial "at rest" position.

FIG. 21 is a free-floating assembly schematic drawing that illustrates an embodiment of a trigger/hammer firing mechanism. Leaf spring 121 is rigidly attached to trigger carriage 114. Cam follower 122 is rotatably attached to leaf spring 121. Cam lever 123 is pivotally attached to a gun frame (not shown) at pivot point 124. Cam follower 122 is engaged with cam arm 123 and rides along cam surface 125. Finger 126 of cam lever 123 is mated in notch 127 in tubular cylindrical hammer 128. Lug 129 is rigidly attached to cylindrical tubular hammer 128. Lower edge of lug 129 is a wedge-shaped surface 130. Firing anvil 131 is fitted with a firing pin 61 and an inclined wedge shaped surface 132 which mates with the inclined wedge surface 130 of hammer lug 129. Firing anvil 131 is integrally attached to leaf spring 133 which is rigidly mounted to a gun frame (not shown) at point 134. Hammer extension spring 135 is fitted inside tubular hammer 128 and attached at the top inside tubular hammer 128 at pin 136. The lower end of hammer extension spring 135 is attached to a gun frame (not shown) at loop 137. The trigger/hammer mechanism assembly illustrated in FIG. 21 is shown in an "at rest position" with trigger carriage 114 in its fully forward position.

Figure 22:
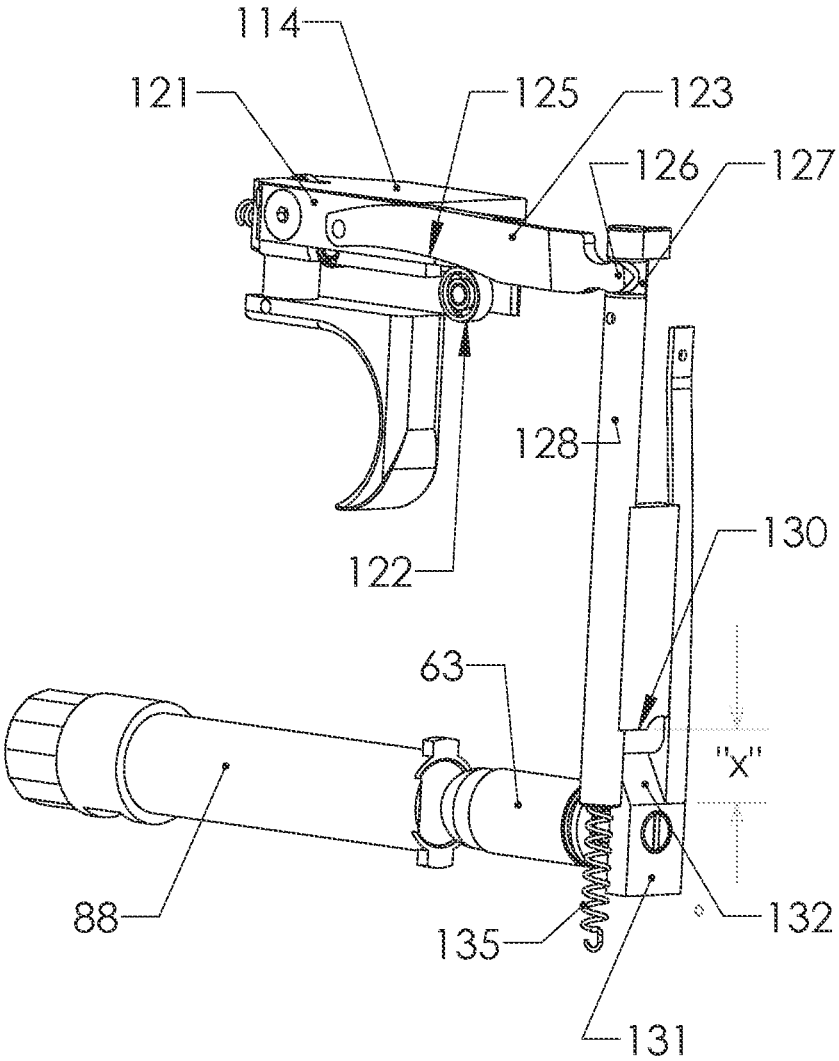
FIG. 22 is a free-floating assembly schematic drawing of the trigger/hammer firing mechanism illustrated in FIG. 21 above with the firing mechanism positioned just before firing.

FIG. 22 is a free-floating assembly drawing that illustrates the trigger/hammer firing mechanism shown in FIG. 21 above with the trigger carriage 114 pulled back to a "just-before-firing" position. Cam follower 122 has rolled along cam surface 125 and lifted cam arm 123 near its top position. Cam arm 123 has in turn raised tubular hammer 128 to an elevated position, bringing wedge shaped surface 130 of hammer 128 a distance "X" above wedge shaped surface 132 of firing anvil 131. Hammer extension spring 135 has been extended and is now under tension ready to drive hammer 128 into firing anvil 131.

Figure 23:
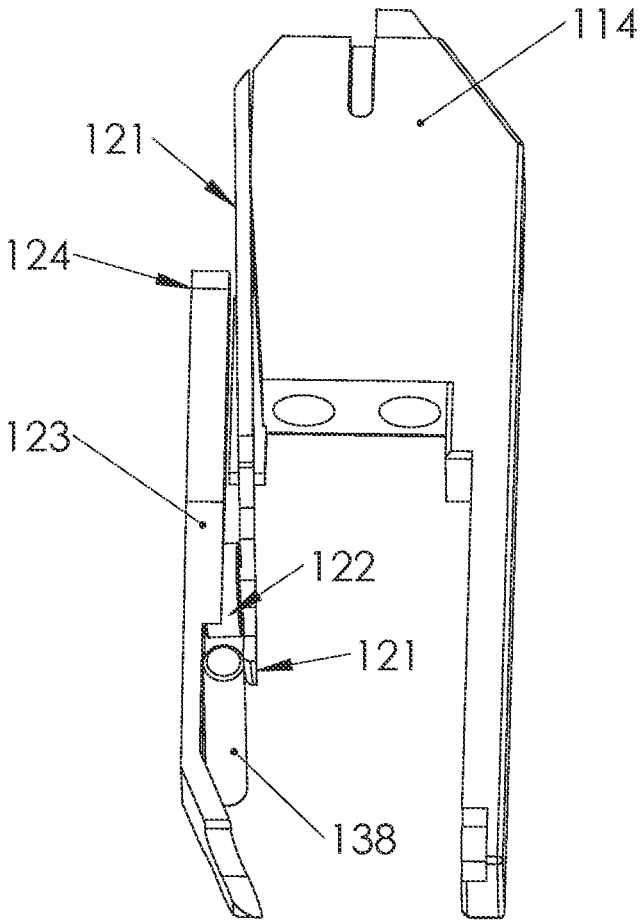
FIG. 23 is a top assembly view of the firing mechanism illustrated in FIG. 22 above, illustrating the "trigger trip" operation.

FIG. 23 is the top view of a free-floating assembly schematic drawing that illustrates the trigger/hammer firing system shown in FIG. 22 in its "just-fired' position. Trigger carriage 114 has been moved back and leaf spring 121 has encountered stationary tripping cam 138 and has been driven laterally to the right pulling cam follower 122 out from under cam arm 123. Tripping cam 138 is illustrated as a simple dowel pin pressed into a gun housing (not shown) that could be any suitable shape and could be made adjustable to allow fine-tuning of the trigger point.

Figure 24:
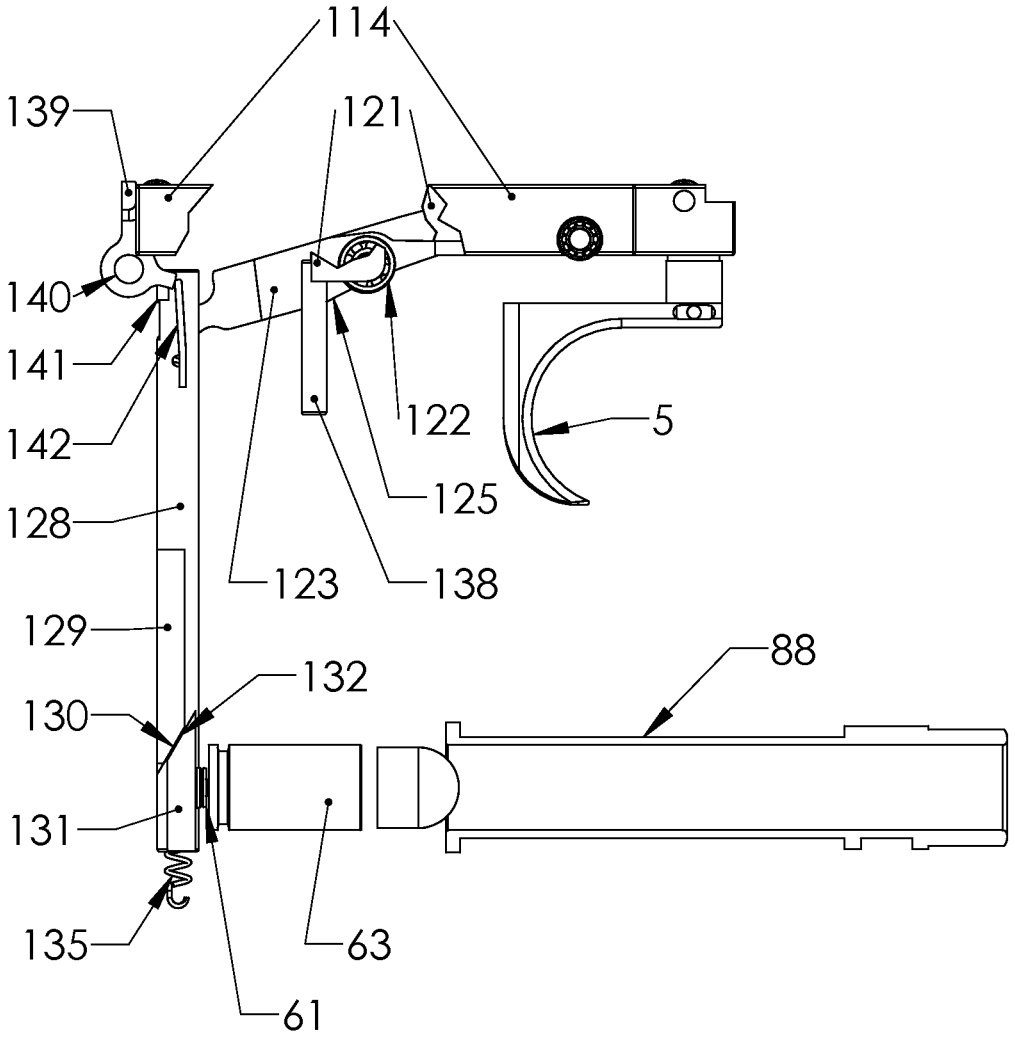
FIG. 24 is a free-floating assembly schematic drawing that illustrates the trigger/hammer firing mechanism illustrated in FIG. 21 through 23 above with the firing mechanism in a "just fired" position.

FIG. 24 is a free-floating assembly schematic drawing that illustrates the trigger/hammer firing mechanism illustrated in FIGS. 22 and 23 above. FIG. 24 is an internal view clearly illustrating the relative position of the parts with the gun in the "just fired from" position. Leaf spring 121 (shown broken for clarity) has been driven laterally by stationary tripping cam 138 forcing cam follower 122 off of surface 125 of cam arm 123. With the loss of support of cam follower 122, the force of hammer extension spring 135 has driven tubular hammer 128 and cam arm 123 downward. Wedge cam surface 130 on lug 129 of hammer 128 has impacted mating wedge surface 132 of firing anvil 131 driving firing anvil 131 and firing pin 61 forward impacting the primer cap of cartridge 63 and firing said cartridge. During the last portion of travel of trigger carriage 114 prior to the firing sequence just described, trigger carriage 114 (shown broken for clarity) engaged hammer latch lever 139 and rotated it about pivot point 140 thereby engaging hammer latch lever 139 with hammer latch spring 142 and moving spring 142 forward sufficiently for it to clear lug 141 attached to tubular hammer 128 to allow hammer 128 to descend during the firing sequence.

Figure 25:
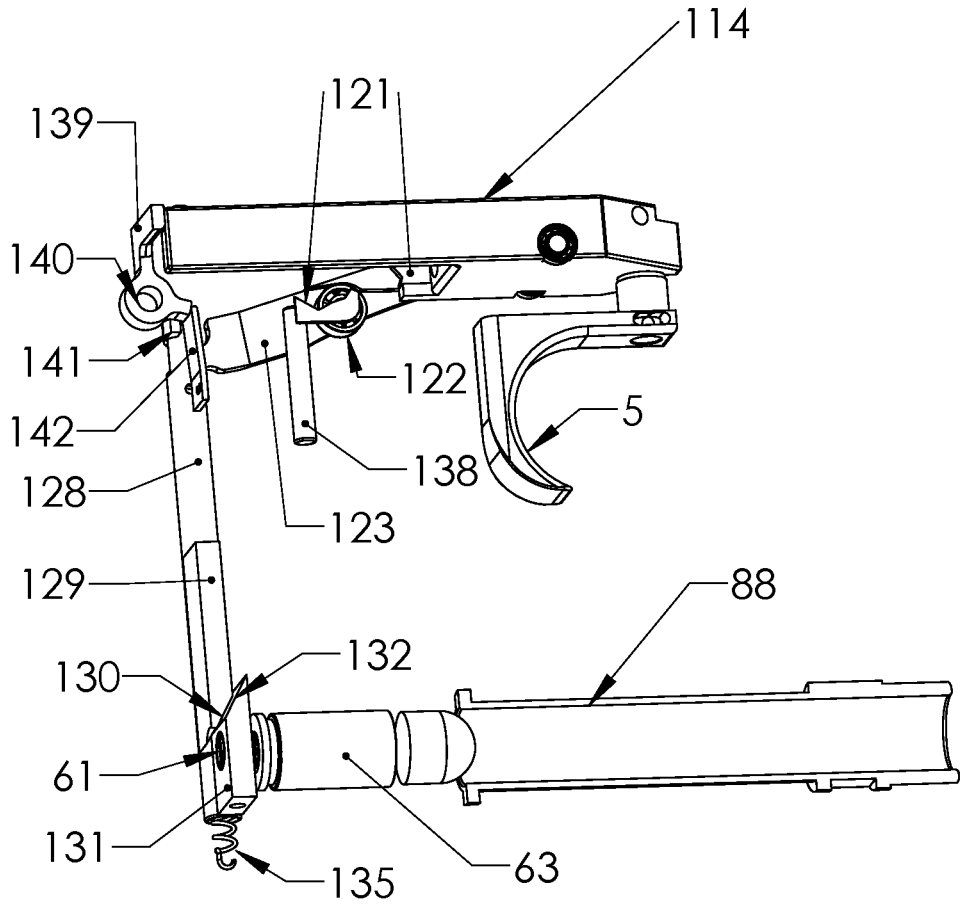
FIG. 25 is a free-floating assembly schematic drawing of the trigger/hammer firing mechanism illustrated in FIG. 24 above taken from a lower perspective view.

FIG. 25 is a free-floating assembly schematic drawing showing the trigger/hammer firing mechanism from a lower perspective view to more clearly illustrate the relative position of all parts. The trigger/hammer firing mechanism illustrated in FIG. 25 is in the same "just-fired" position as that illustrated in FIG. 24 above.

Figure 26:
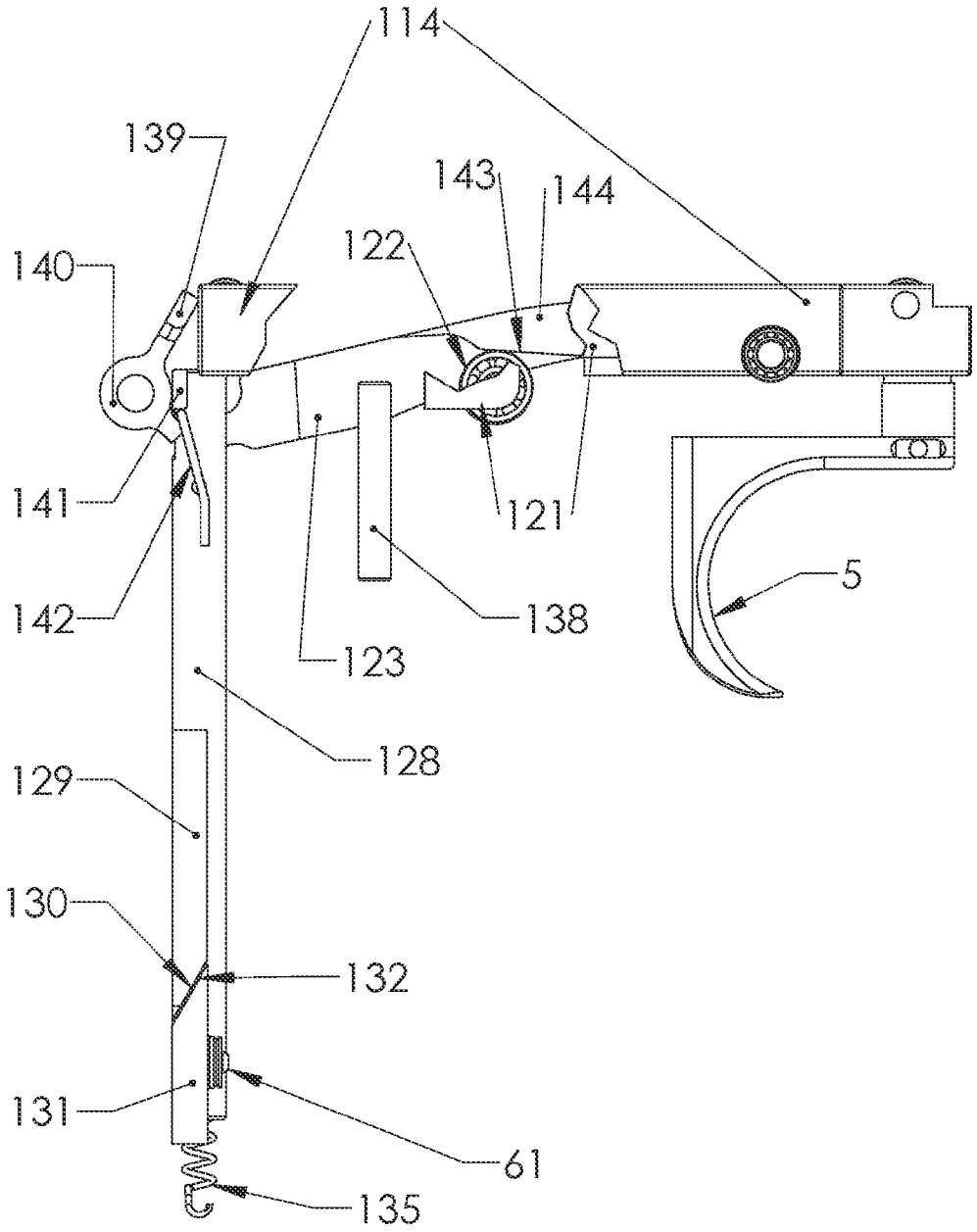
FIG. 26 is a free-floating assembly schematic drawing that illustrates the trigger/hammer firing mechanism illustrated in FIG. 21 thru FIG. 25 with the trigger beginning its return stroke after firing and illustrating the hammer release operation.

FIG. 26 is a free-floating assembly schematic drawing that illustrates the trigger/hammer firing mechanism described above with trigger carriage 114 beginning its return stroke upon trigger release after firing. Cam follower 122 has engaged cam surface 143 of cam projection 144 which is integrally made into cam arm 123 and offset from cam surface 125. This engagement of cam follower 122 has raised cam lever 123 and hammer 128 sufficiently to clear wedge surface 130 of hammer 128 from wedge surface 132 of firing anvil 131 thus allowing firing anvil 131 to retract sufficiently so that firing pin 61 is clear of cartridge 63. The forward motion of trigger carriage 114 has allowed hammer latch lever 139 to rotate clockwise about pivot 140 which has allowed hammer latch spring 142 to spring back under lug 141 of hammer 128 thus preventing hammer 128 from moving downward.

Figure 27:
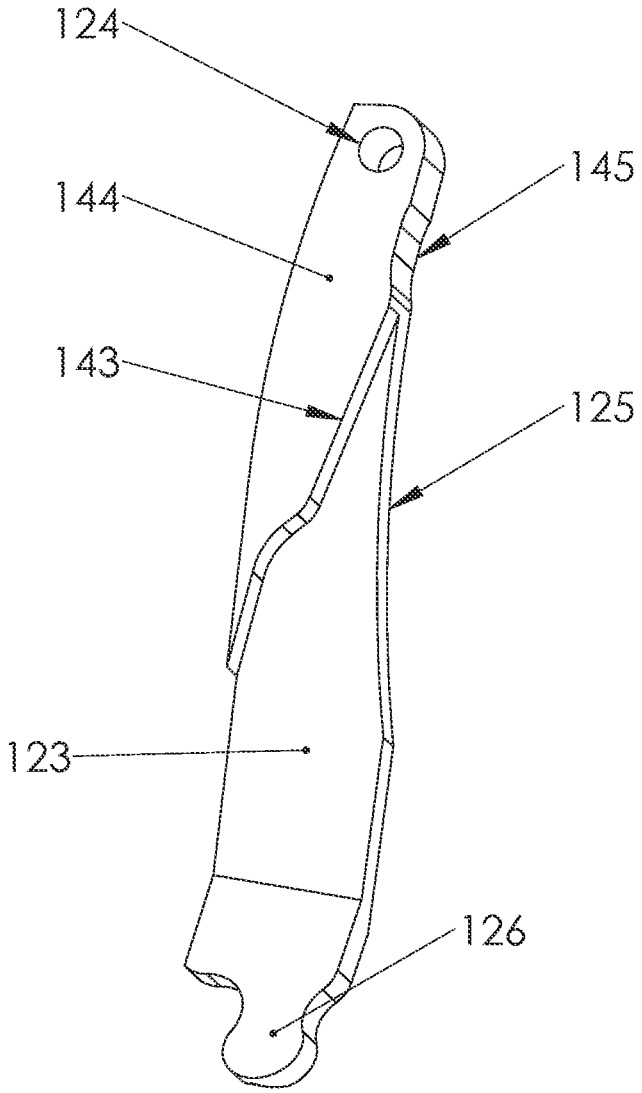
FIG. 27 is a detailed view of a firing mechanism hammer cam arm.

FIG. 27 is a close-up detail schematic drawing of cam lever 123. 124 is the pivot point of the cam lever and 126 is lifting finger which engages hammer 128. As shown cam projection number 144 and its related cam surface 143 are offset from cam surface 125. This allows cam follower 122 and the forced off of cam surface and 125 and still engage cam surface 143. 145 is a relief area at full return stroke position on arm 123 which allows cam follower 122 to spring back under cam arm 123 and reengage cam surface 125. The force exerted by hammer spring 135 which causes pressure between cam surface in 143 and cam follower 122 is relieved by the support of hammer latch spring 142 being engaged under lug 141 of hammer 128 (see FIG. 28 for more detail).

Figure 28:
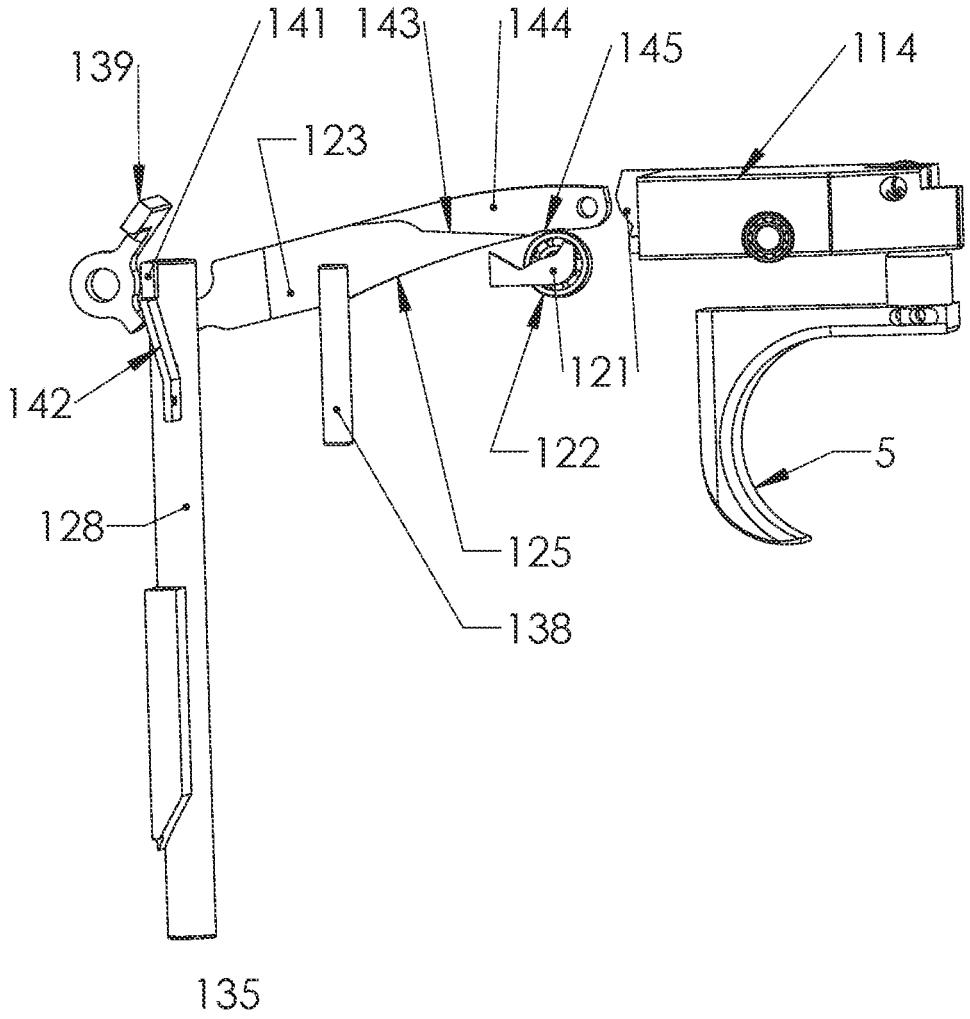
FIG. 28 is a free-floating assembly schematic drawing that illustrates the trigger/hammer firing mechanism illustrated in FIG. 21 thru FIG. 25 with the trigger in its fully returned position after firing and illustrating the hammer release mechanism.

FIG. 28 is a free-floating assembly schematic drawing that illustrates the currently described trigger/hammer firing mechanism with trigger carriage 114 in its fully returned or "free" position. Hammer latch spring 142 is engaged under lug 141 of hammer 128 and resist the downward force of hammer spring 135. Cam follower 122 is at the relief position 145 on cam arm 123 and is free to spring back under cam arm 123 and cam surface 125 driven by the force of leaf spring 121 (shown broken for clarity). The firing mechanism is now ready for the next firing sequence.

Figure 29:
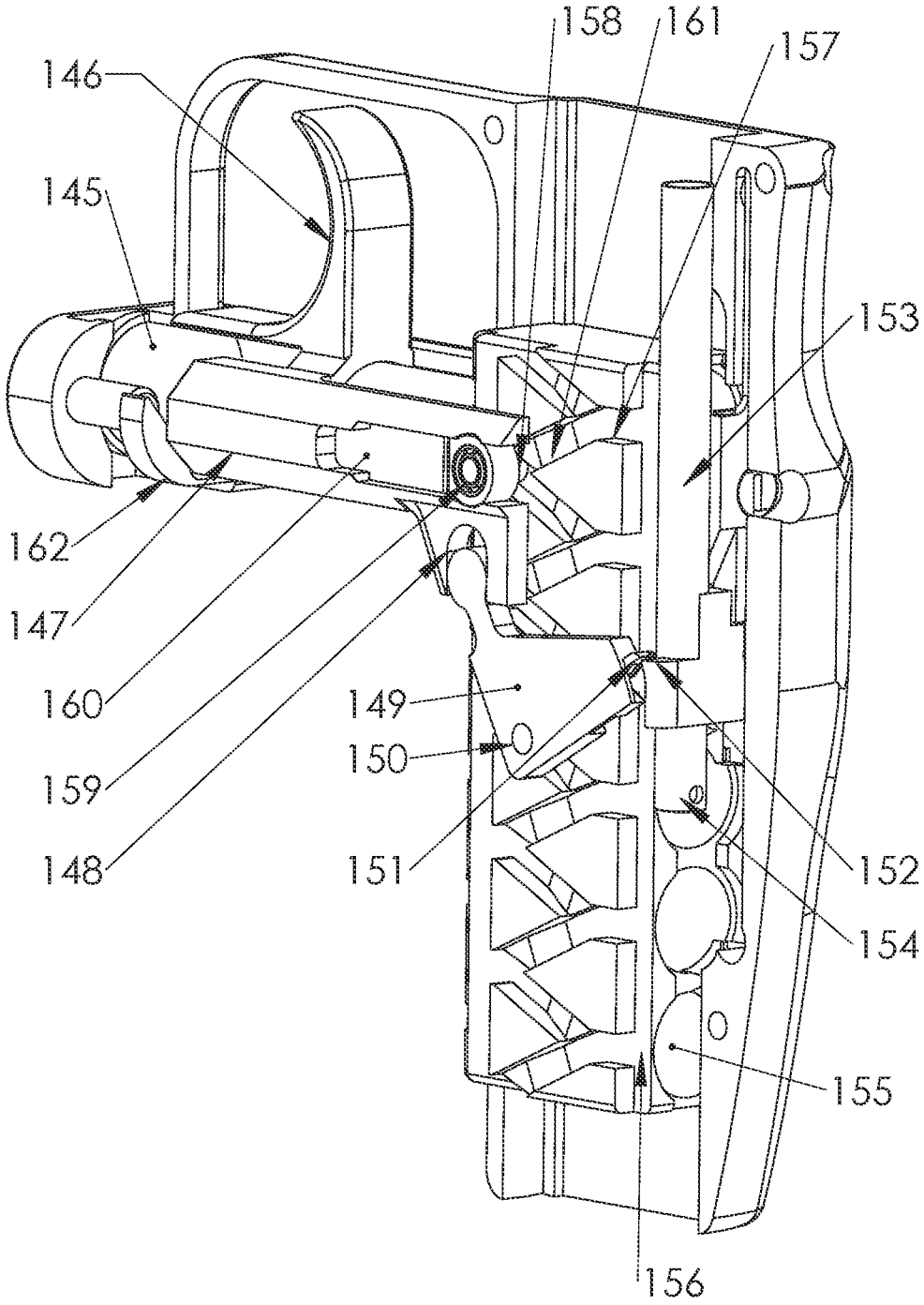
FIG. 29 is a schematic assembly drawing that illustrates a handgun with the barrel located between the index finger and the middle finger of the shooter. In this embodiment the hammer actuating lever and the magazine actuating cam lever are located on the same side of the handgun and actuated by the same slide extension of the trigger.

FIG. 29 is a schematic subassembly drawing of a particular embodiment of a handgun according to the disclosures of this invention. Barrel 145 is located between the index finger and middle finger of the shooter. FIG. 146 is actuated by the index finger of the shooter. Left slide extension 147 of trigger 146 contains a yoke portion 148 which engages hammer actuating lever 149 which is pivoted about point 150. Spring-loaded sear 151 engages flat surface 152 of tubular hammer 153. An extension hammer spring (not shown) is housed in the internal tubular portion of hammer 153 and captivated by a pin which extends through hole 154. Multiple cartridge chambers 155 are located in Magazine 156. Magazine 156 contains cam track 157 to facilitate the indexing of Magazine 156 through the handle of the handgun. Cam follower 158 is Journal in ball bearings 159 which are housed in spring leaf lever section 160 which is mounted in trigger slide extension 147. Spring action of the spring lever 160 allows cam follower 158 to pass over direction controlling ramps 161 located within cam tracks 157. Leaf spring mounted stop 162 limits the forward travel of trigger 146. FIG. 29 is shown with trigger 146 in its forward or at rest position.

Figure 30:
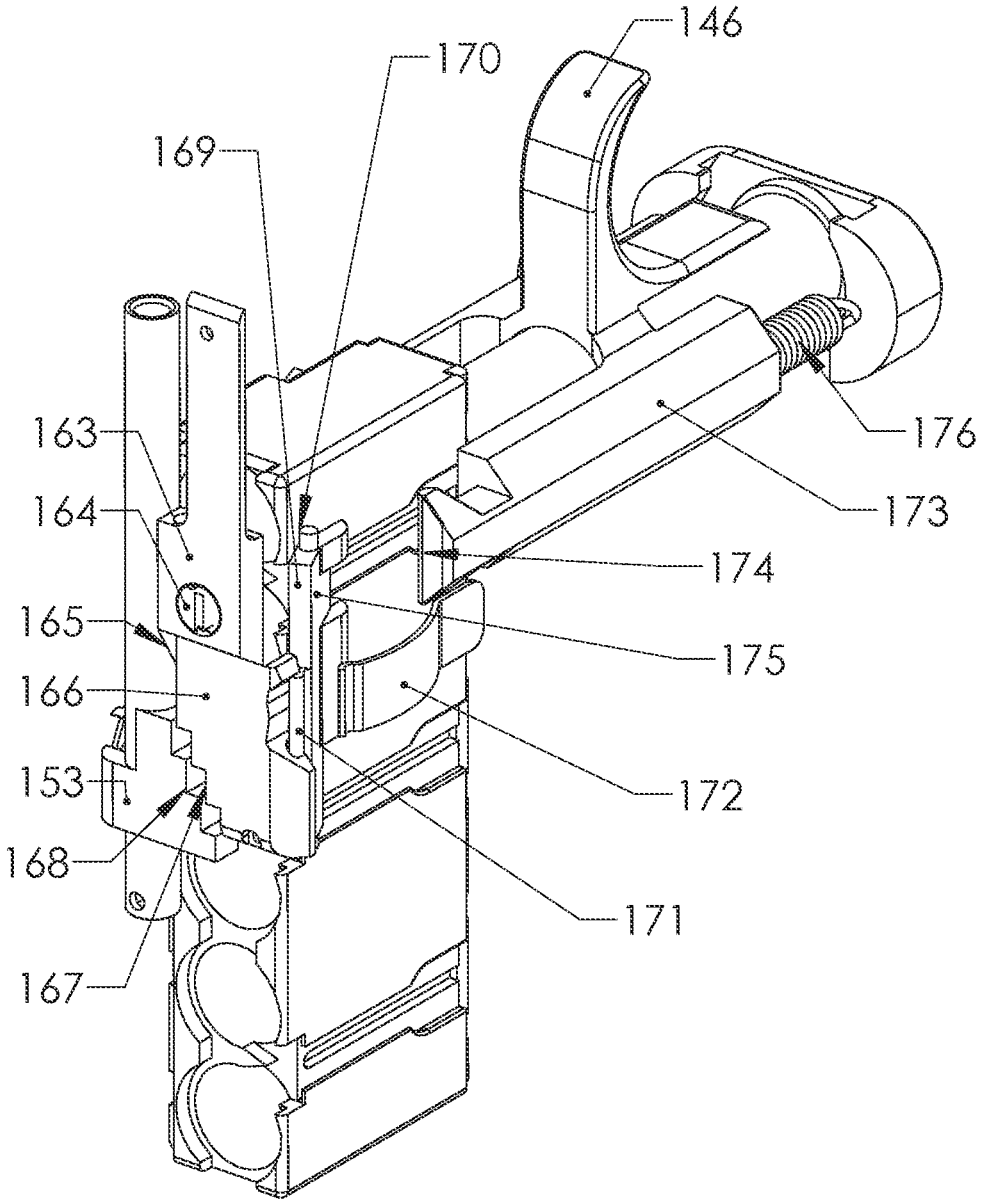
FIG. 30 is a free-floating schematic subassembly drawing of the same handgun illustrated in FIG. 29 above but taken from the opposite side. This illustration shows a mechanism for inserting and retracting a spacer between the hammer and the firing pin anvil to facilitate retracting the anvil during magazine index. This illustration shows the trigger in the "at-rest" position and the spacer in its retracted position.

FIG. 30 is a free-floating schematic subassembly drawing of the handgun illustrated in FIG. 29 but shown from the opposite side. Firing anvil 163 contains adjustable firing pin 164. Wedge shaped surface 165 is integral with anvil 163 and mates with the corresponding wedge-shaped section of firing spacer 166. Step surfaces 167 are integral with firing spacer 166 and mate with corresponding step surfaces 168 in firing hammer 153. Firing spacer 167 is slidably mounted in the butt portion of the handgun housing (not shown). Spacer actuating arm 169 is pivotally mounted in the handgun frame at journals 170. Firing spacer actuating arm 169 is also pivotally mounted to firing spacer 167 at journal 171. Flat bias spring 172 is rigidly mounted in the handgun frame and presses against firing spacer actuating arm 169 to maintain firing spacer 167 in a disengaged or retracted position. Slide extension arm 173 is integral with trigger 146 and contains a cam shape surface 174 which engages firing spacer arm 169 at surface 175. Trigger slide extension arm 173 is attached to trigger return spring 176 which pull trigger 146 to a forward position. The purpose of firing spacer 166 is to retract after the handgun fires to create clearance between hammer 153 and firing anvil 163. This space will allow firing anvil 163 and firing pin 164 to retract and give clearance so Magazine 156 may index. FIG. 30 is shown with trigger 146 in its forward or "at rest" position and firing spacer 166 in its retracted or clearance position. The purpose of the stepped surfaces 167 and 168 is to provide large contact surface area between hammer 153 and firing spacer 166 when spacer 166 is in its engaged position but allow sufficient clearance when firing spacer 166 is retracted only a small distance.

Figure 31:
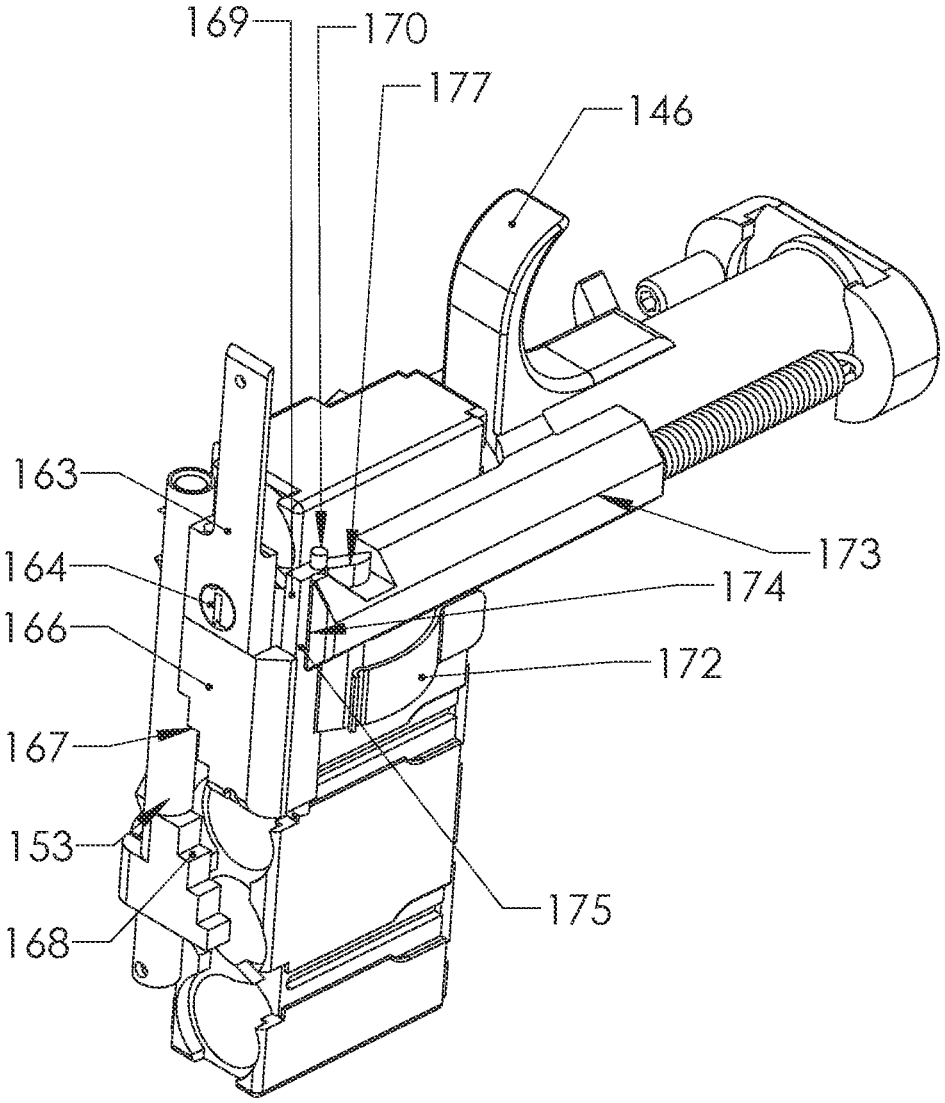
FIG. 31 is the same free floating schematic subassembly drawing shown in FIG. 30 above but illustrating the trigger in its retracted or firing position and the spacer in its engaged position.

FIG. 31 is a free-floating schematic assembly drawing of the same handgun illustrated in FIG. 30. FIG. 31 shows the handgun with trigger 146 retracted to its "just before fired" position. Cam surface 174 of trigger slide extension 173 has engaged surface 175 of firing spacer actuating arm 169 causing it to pivot about journal 170 and move firing spacer 166 to the left where it is fully engaged under firing anvil 163 which places it in firing position. Step surfaces 167 of firing spacer 166 are now aligned with step surfaces 168 of firing hammer 153. Flat bias spring 172 has been moved to its flexed position. Firing spacer 166 is free to float vertically a limited amount along journal 171. This float will allow firing spacer 166 to move upward when struck by firing hammer 153 and drive firing anvil 163 and firing pin 164 into the cartridge detonating cap and fire the gun. After firing, when trigger 146 begins its return stroke, cam surface 174 of trigger slide extension 173 will engage cam surface 177 of firing spacer actuating arm 169 and together with the spring force of bias spring 172 will rotate firing spacer actuating arm 169 about pivot 170 and rotated it back to its retracted position which will retract firing spacer 166 thus creating a gap between hammer 153 and firing anvil 163 thus allowing firing anvil 163 and firing pin 164 to retract. At that point, firing spacer 166 and firing spacer actuating arm 169 will be in the position shown in FIG. 30.

Figure 32:
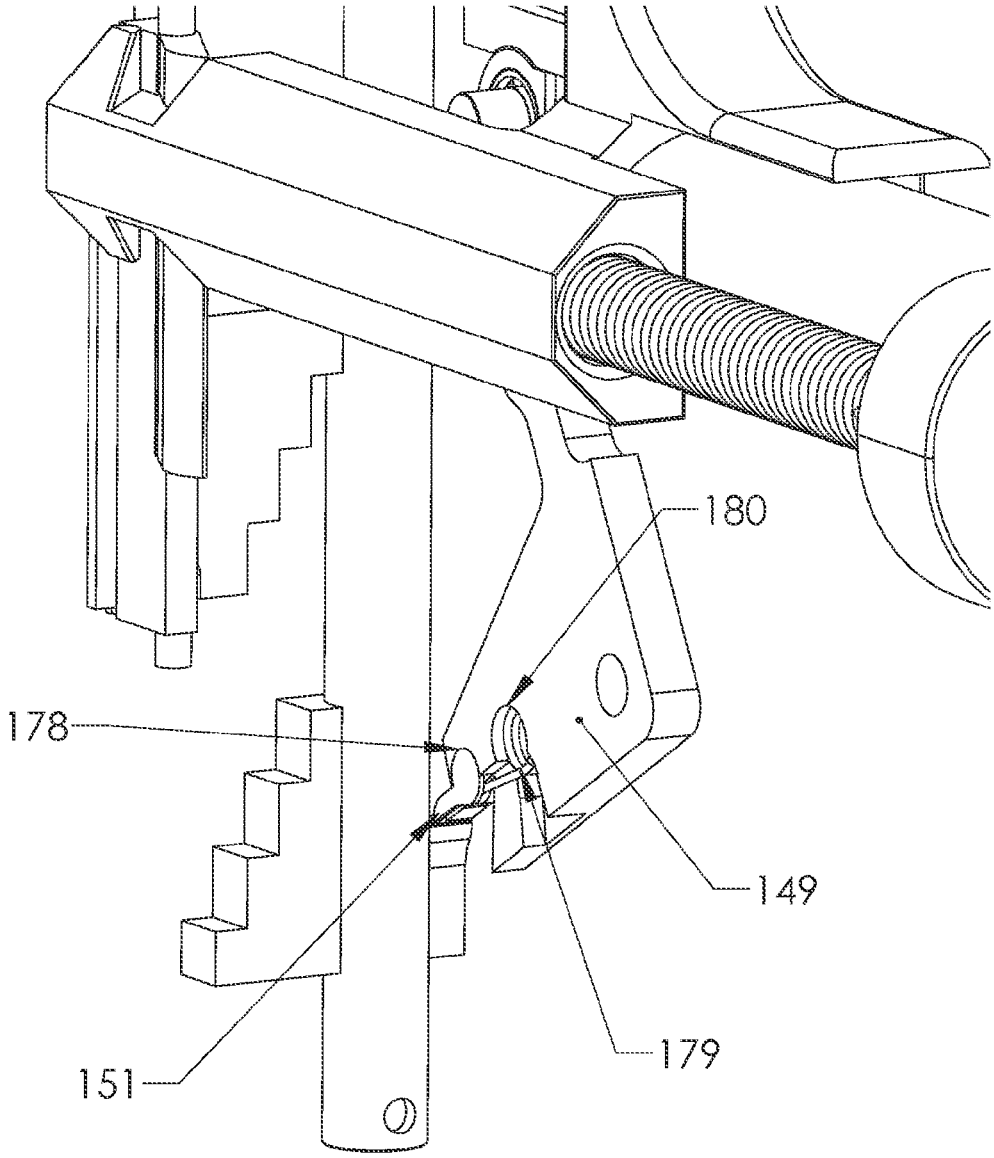
FIG. 32 is a free-floating schematic subassembly drawing that illustrates a different embodiment of a hammer actuating lever and sear.

FIG. 32 illustrates an embodiment of sear 151 which is pivotally mounted in bore 178 of hammer actuating arm 149 and biased to its clockwise or driving position by torsion spring 179 which is captivated in bore 180 in arm 149.

Figure 33:
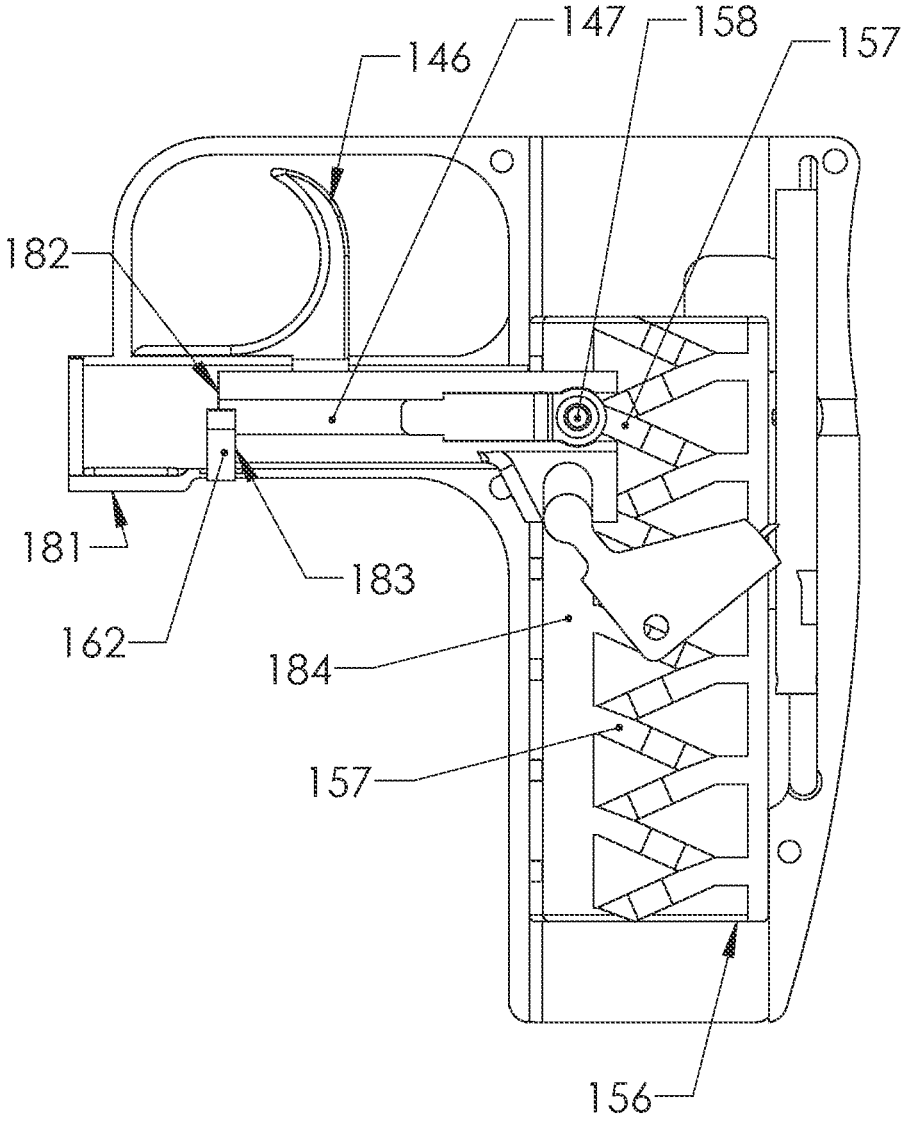
FIG. 33 is a schematic assembly drawing of a handgun illustrated in FIG. 29 above, but with the trigger in its extreme forward position which disengages the cam follower from the magazine cam track and allows the magazine to be removed.

FIG. 33 is a schematic assembly drawing of the handgun shown in FIG. 32 above illustrating a magazine release operation. Trigger stop 162 has an integral leaf spring that is mounted in gun frame 181. In normal operation, surface 182 of trigger slide 147 butts against surface 183 of trigger stop 162 and limits the forward travel of trigger 146. To release magazine 156, trigger stop 162 is depressed allowing surface 182 to bypass surface 183 and allow trigger 146 to move forward. The forward movement of trigger 146 allows magazine indexing cam follower 158 to move out of cam tracks 157 into clearance area 184. With cam follower 158 disengaged from cam tracks 157 of magazine 156 said magazine is free to slide out of handgun frame 181.

Figure 34:
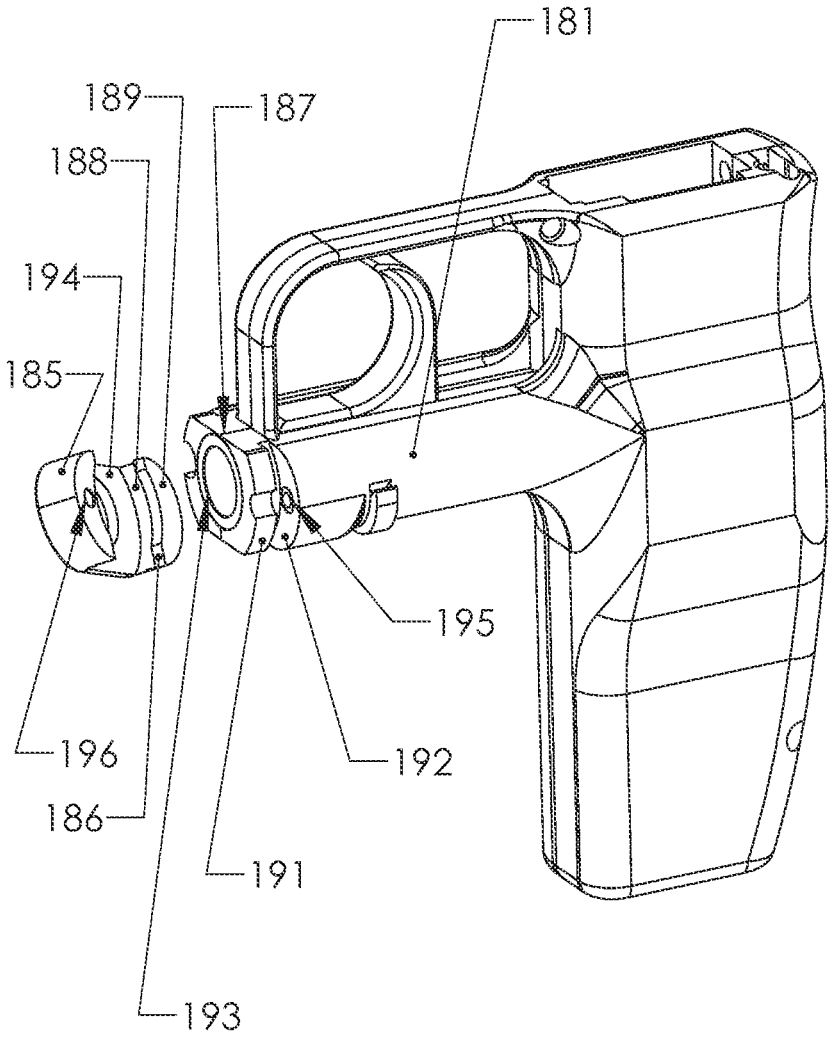
FIG. 34 is a schematic assembly drawing of the handgun illustrated in FIG. 29 above illustrating a quick change barrel lock.

FIG. 34 is a schematic assembly drawing of the handgun shown in FIG. 33 above illustrating a quick-change barrel retention system. 185 is a barrel retainer. With the long axis of barrel retainer 185 turned vertically, opening 186 will slip over flats 187 in gun frame 181. When barrel retainer 185 is rotated 90° such that the long axis of barrel retainer 185 is horizontal, grove 188 will fit around flange 191 of frame 181 and flange 189 of barrel retainer 185 will fit in grove 192 of handgun frame 181. Barrel 193 will be retained by surface 194 of barrel retainer 185. Ball detent 195 located in handgun frame 181 will engage hole 196 in barrel retainer 185 and captivate it.

Figure 35:
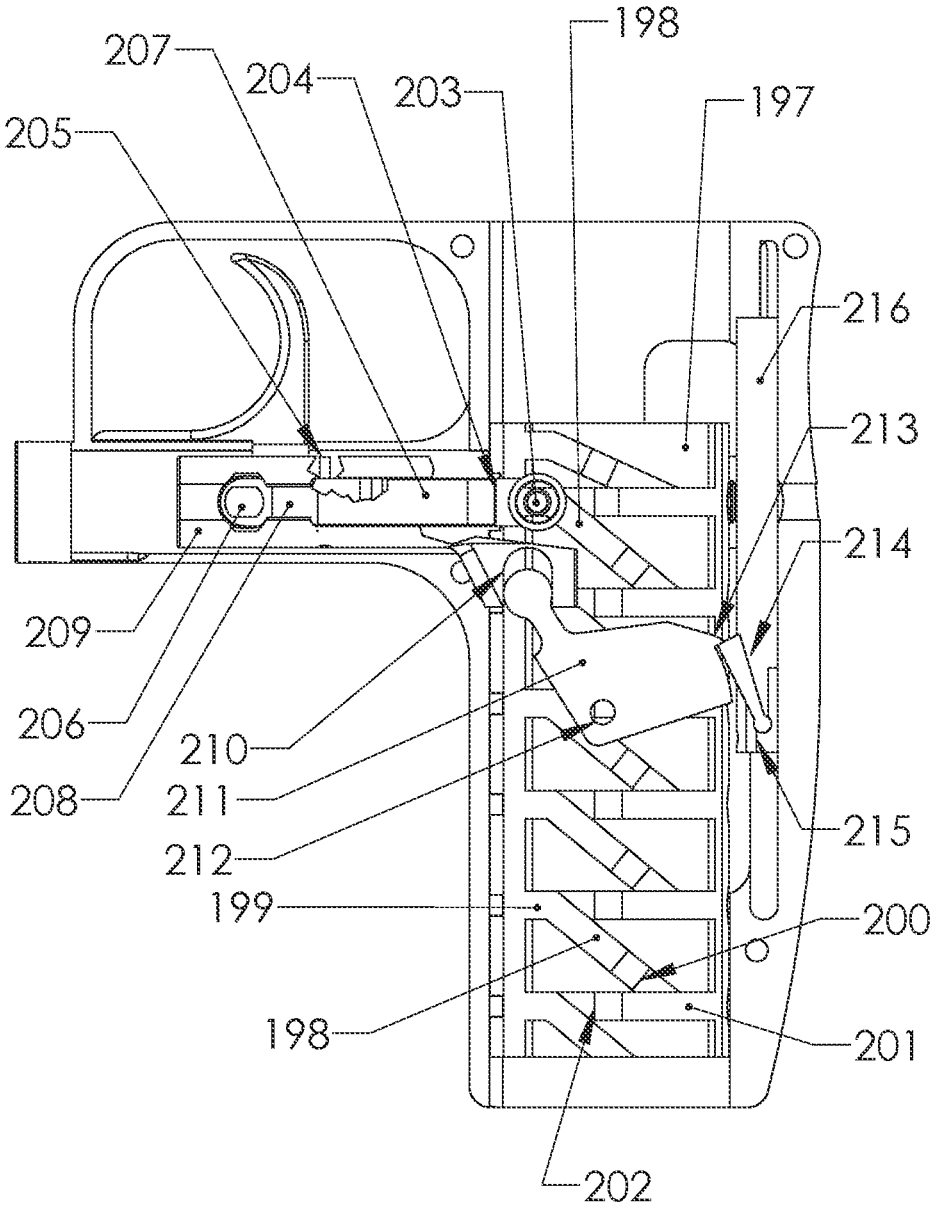
FIG. 35 is a schematic assembly drawing of an embodiment of a handgun in accordance with disclosures of the invention illustrating a magazine indexing configuration which accomplishes the full magazine index stroke during the trigger pull stroke with the magazine remaining in dwell during the trigger return stroke. The trigger is in an "at rest" position.

FIG. 35 is a schematic assembly drawing that illustrates a handgun in accordance with disclosures of the invention wherein a cam follower 203 engages a cam track 198 in the side of a magazine 197. Cam track 198 is designed to index magazine 197 the full stroke between cartridges during a trigger pull stroke only and hold magazine 197 in that position during a trigger release stroke. Cam follower 203 is rotatably mounted cam arm 204 in ball bearings (not shown). Cam follower arm 204 is pivotally mounted in trigger slide extension 209 by means of a pin 205. Trigger slide extension 209 is shown in broken section for clarity. The opposite end of cam follower arm 204 is equipped with a release stud 206. Cam follower arm 204 is forced into cam tracks 198 by means of flat leaf spring 207 which is mounted in trigger slide extension 209 by section 208 of spring 207 being engaged in slots in trigger slide extension 209. Cam follower 203 may engage and follow cam track sections 198, 199, and 201. Trigger slide extension 209 also contains hammer actuating yoke 210 which engages hammer actuating arm 211 which is pivoted about bore 212 and mounted on a stud (not shown) in the gun frame (not shown). Finger 213 of hammer actuating arm 211 engages pivoting sear 214 which is pivotally mounted in nest 215 of firing hammer 216. Sear 214 may be biased toward hammer actuating lever 211 by a leaf spring (not shown). Magazine cam track section 199 is a dwell section wherein the horizontal movement of cam follower 203 maintains the position of magazine 197 in a fixed position.

Figure 36:
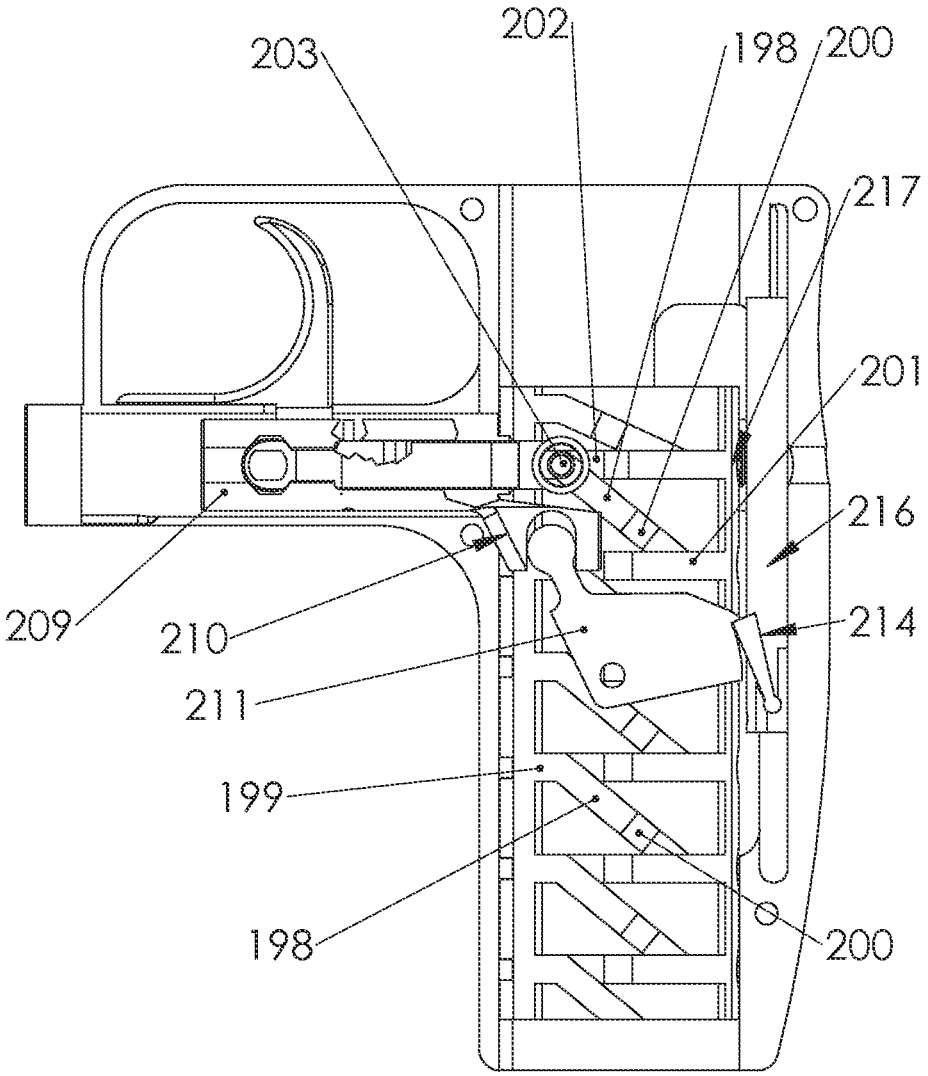
FIG. 36 is a schematic assembly drawing of the handgun shown in FIG. 35 above, with the trigger in a position just before magazine index.

FIG. 36 is a schematic assembly drawing of the handgun shown in FIG. 35 with trigger slide extension 209 pulled back to the point where magazine index will begin. When cam follower 203 reaches the transition point between cam track sections 199 and inclined cam track section 198, hammer actuating arm 211 will have been rotated sufficiently to press firing hammer 216 down a sufficient amount to retract firing pin 217 clear of magazine 197. Cam follower 203 will be directed down cam track 198 when it encounters ramp 202. Cam follower 203 will ride over ramp 200 by virtue of cam follower arm 204 being pivoted about pin 205 and by the flexing of flat bias spring 207.

Figure 37:
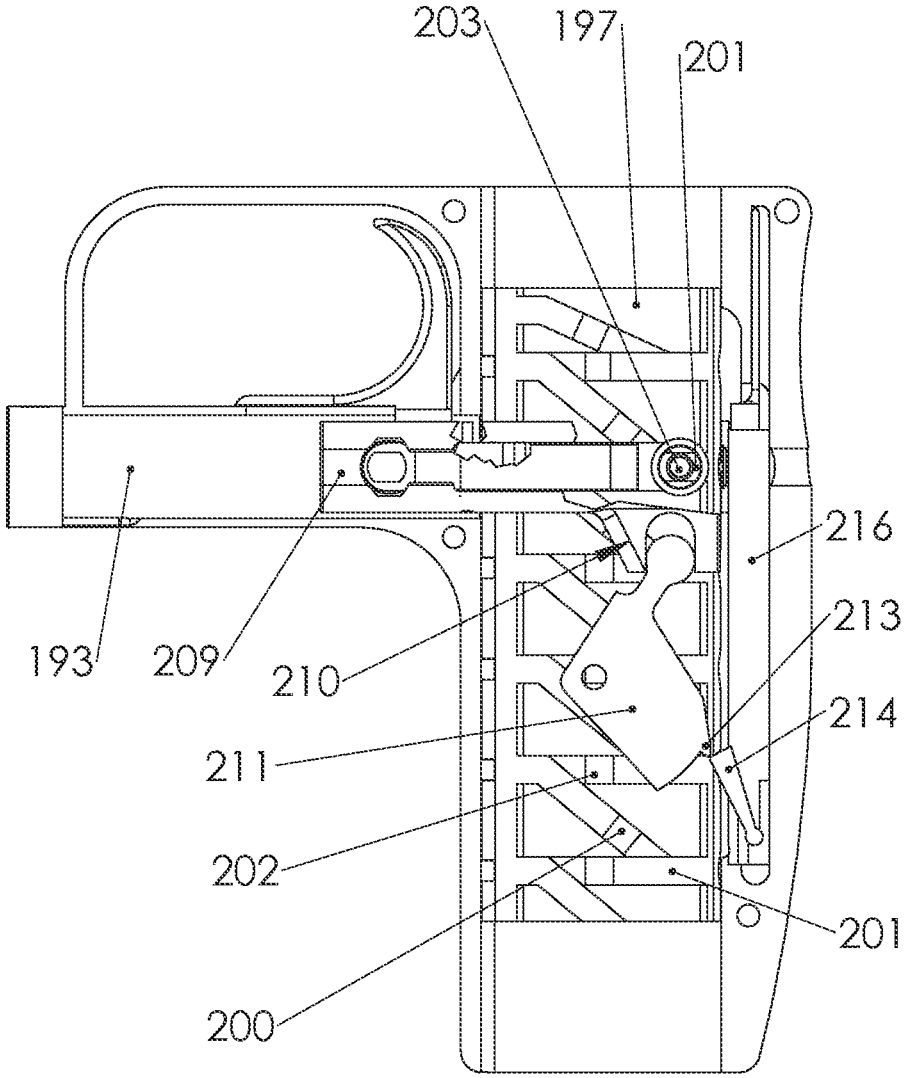
FIG. 37 is a schematic assembly drawing of the handgun shown in FIG. 35 above, with the trigger in a "just before firing" position.

FIG. 37 is a schematic assembly drawing of handgun shown in FIG. 35 above. FIG. 137 illustrates the gun with trigger slide extension 209 pulled to the point just before the gun will fire. Cam follower 203 has descended down inclined cam track 198 and over ramp 200 and into cam track dwell section 201. This action has moved magazine 197 up one cartridge space and aligned the next cartridge with barrel 193 for firing. Hammer actuating arm 211 has been rotated to the point where finger 213 is near the point where it will slip off of sear 214 and allow firing hammer 216 to rapidly ascend and fire the cartridge.

Figure 38:
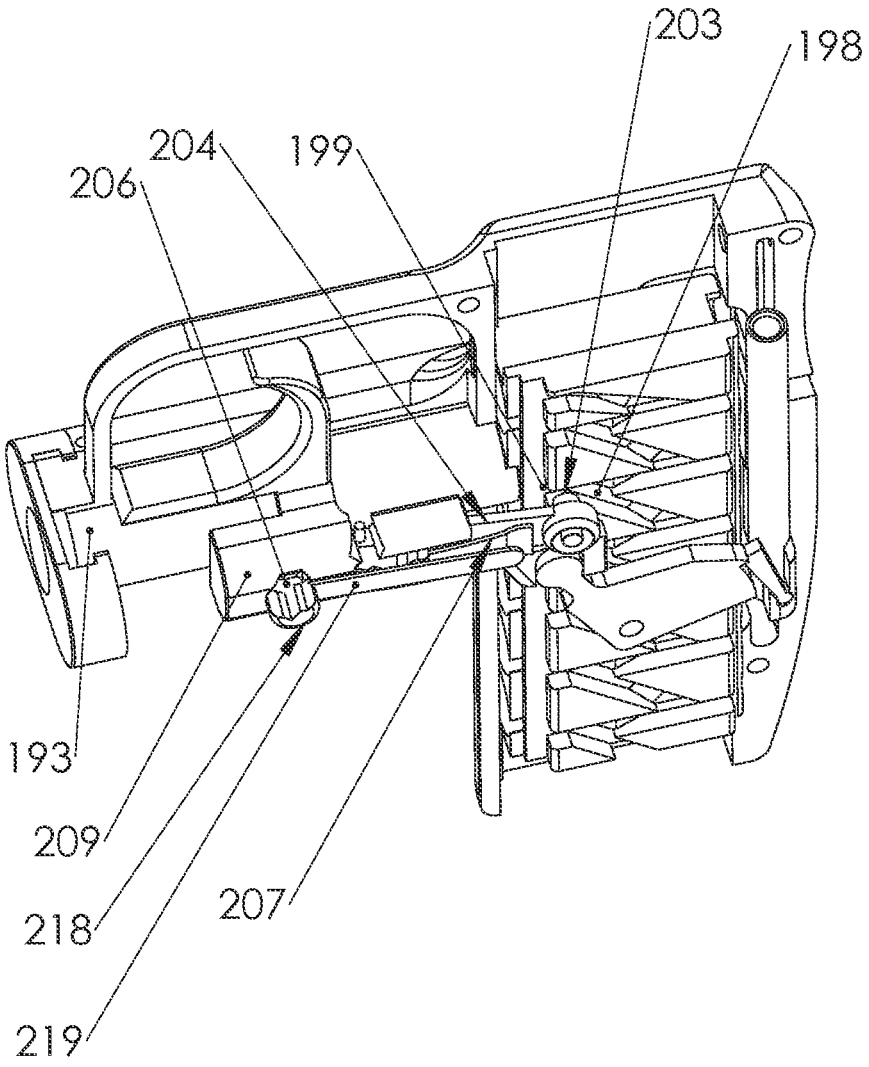
FIG. 38 is a schematic assembly drawing of the handgun shown in FIG. 35 above illustrating a magazine release mechanism in its released position.

FIG. 38 is a schematic subassembly drawing showing the handgun shown in FIG. 35 above. FIG. 38 illustrates a magazine release system. Trigger slide extension 209 is in full forward or "at rest" position. Magazine release button 218 has been depressed and has engaged magazine release stud 206 at the end of cam follower arm 204. This action has pivoted cam arm 204 about pivot pin 205 and flexed spring 207 and withdrawn cam follower 203 from cam track 199. Magazine release button 218 is mounted with its integral flat spring 219 attached to the interior wall of the gun frame (not shown). Withdrawing cam follower number 203 from the cam tracks in magazine 197 will free magazine 197 allowing it to slide out of the handgun handle.

Figure 39:
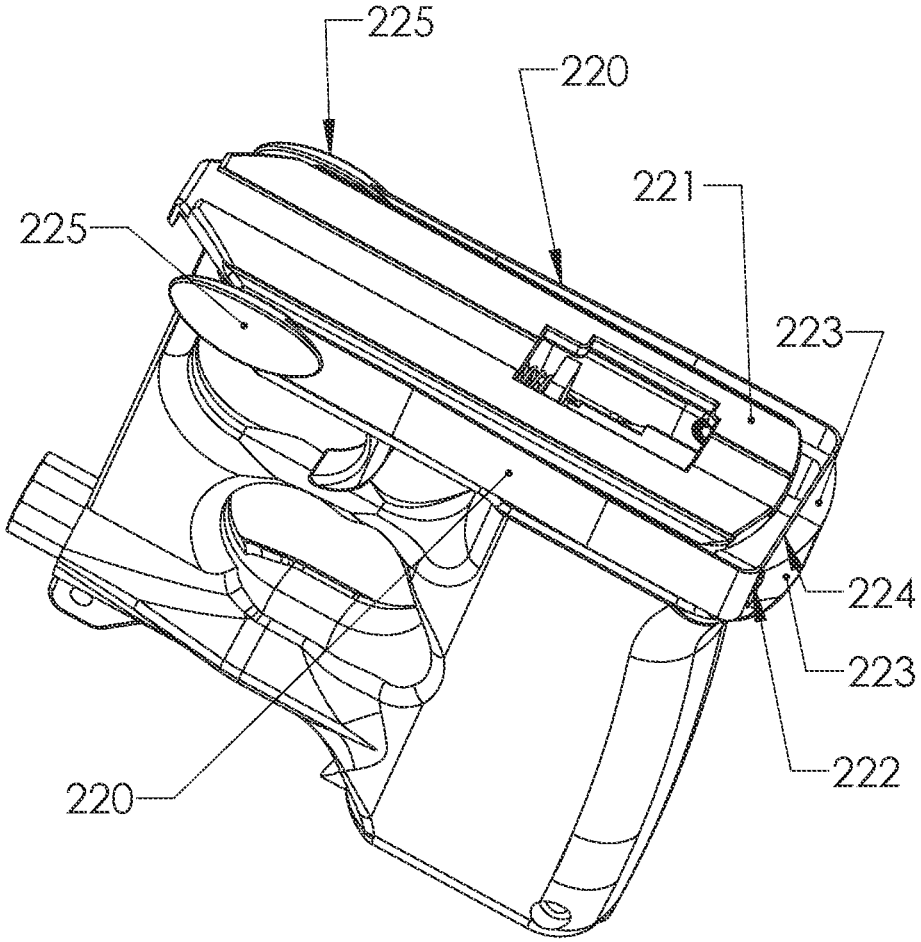
FIG. 39 is a schematic assembly drawing of one embodiment of a handgun according to the disclosures of this invention, illustrating the assembly of an optional belt clip.

FIG. 39 is a schematic assembly drawing that illustrates a handgun according to disclosures of this invention with an optional belt clip installed. U-shaped spring belt clip 220 may be installed by sliding top plate 221 forward and slipping notched cross portion 224 of belt clip 220 into notch 222 machined into gun frame 223. Belt clip 222 may then be securely retained in gun frame 223 by sliding top plate 221 over belt clip portion 224. Optional protective guide tabs 225 may be installed on the open ends of belt clip 220.

Figure 40:
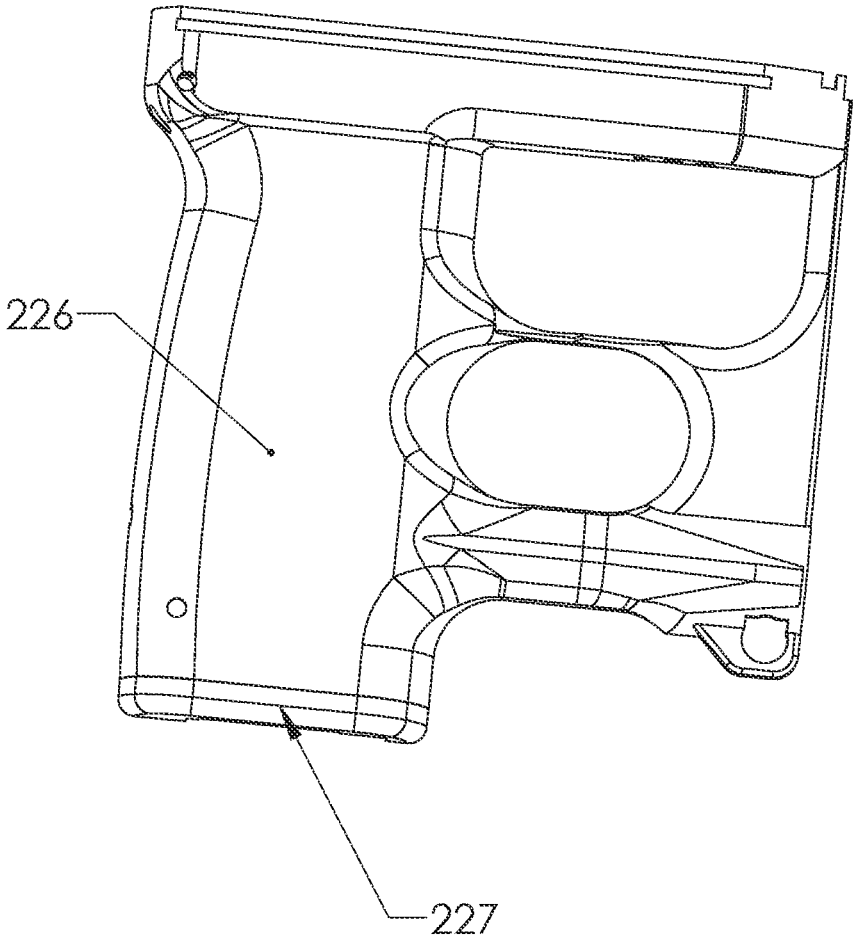
FIG. 40 is a schematic assembly drawing that illustrates an embodiment of a handgun according to disclosures of this invention, illustrating a telescoping handgrip shown in a retracted position.
Figure 41:
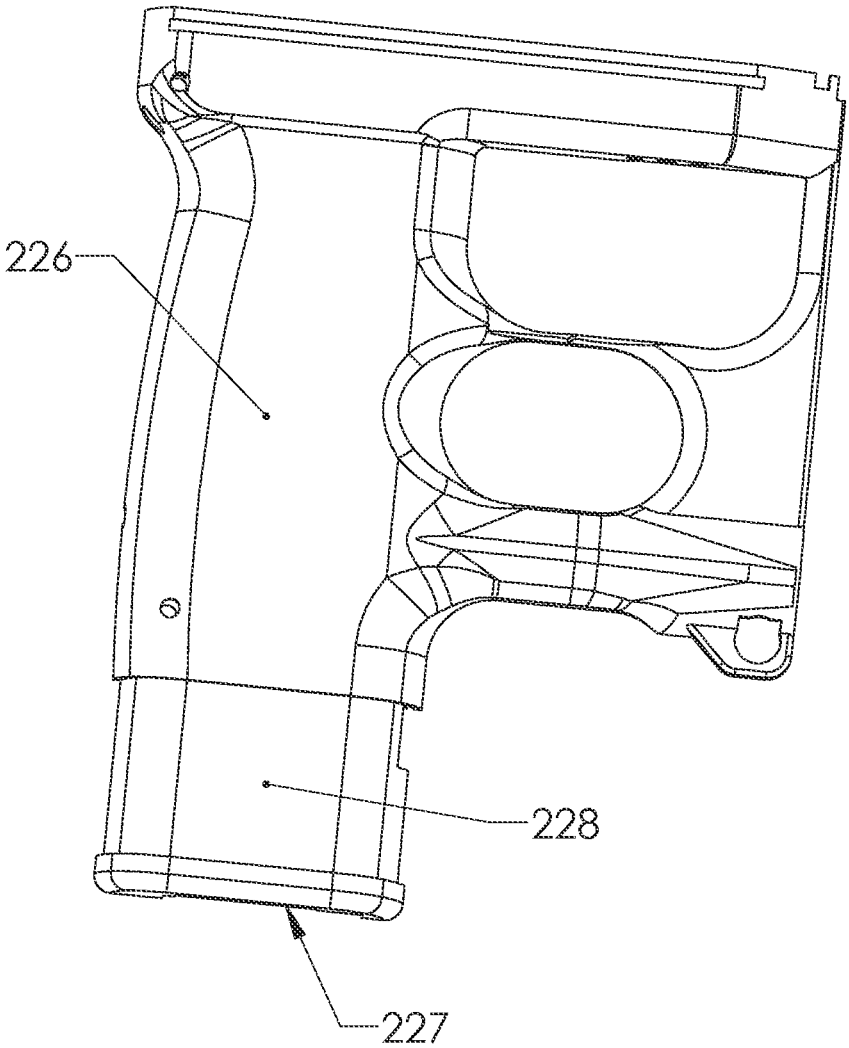
FIG. 41 is a schematic assembly drawing of the handgun illustrated in FIG. 36 above, with the telescoping handle shown in an extended position.

FIG. 40 is a schematic drawing illustrating a hand gun with a telescoping handle. Hand grip 226 is shorter than the hand of a shooter to make the handgun shorter and easier to conceal and carry. 227 is the base of a telescoping hand grip section which is shown collapsed up into hand grip 226. Base 227 may have a cut out opening to allow a magazine to pass through with the telescoping portion either collapsed or extended.

FIG. 11 is a schematic drawing of the same handgun shown in FIG. 40 above with the telescoping handle portion extended. Telescoping base 227 has been moved down from handle 226 exposing a fully enclosing telescoping handgrip portion 228. This provides the shooter with a full grip and protects his hand from the magazine which may extend down through the internal portion of handle 226.

Figure 42:
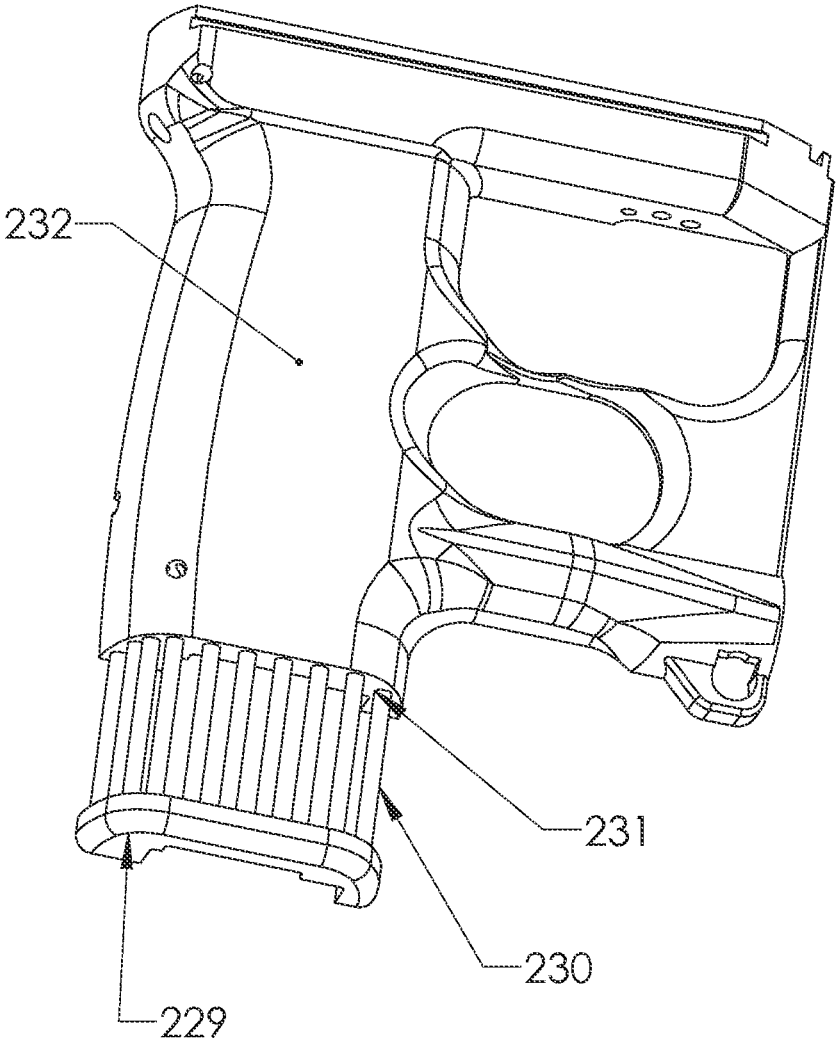
FIG. 42 is a schematic assembly drawing that illustrates an embodiment of the handgun according to disclosures of this invention wherein the telescoping handle it engages the main body of the handgun through a series of parallel rods which engage corresponding bores in the handgun.

FIG. 42 is a schematic drawing that illustrates yet another embodiment of a handgun telescoping handle. Telescoping handle base 229 is connected to handgun handgrip 226 by means of a series of parallel rods 230 which engage and slide in corresponding bores 231 in handgrip 226.

Figure 43:
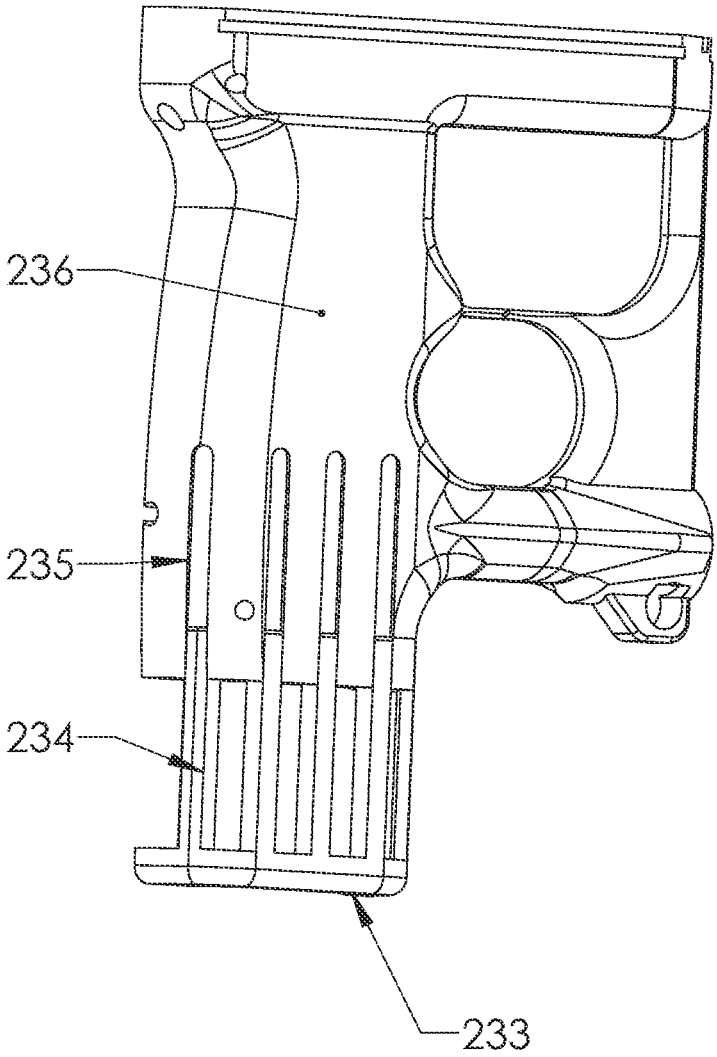
FIG. 43 is a schematic assembly drawing that illustrates handgun with a telescoping handle wherein the telescoping extension includes a series of dovetail strips which engage corresponding dovetail grooves the main body of the handgun handle.

FIG. 43 and yet another embodiment of a hand gun telescoping handgrip. Telescoping handgrip base 233 contains multiple integral dovetail fingers 234 which engage in dovetail grooves 235 in handgrip 236. FIG. 43 illustrates a telescoping hand grip in its extended position.

Figure 44:
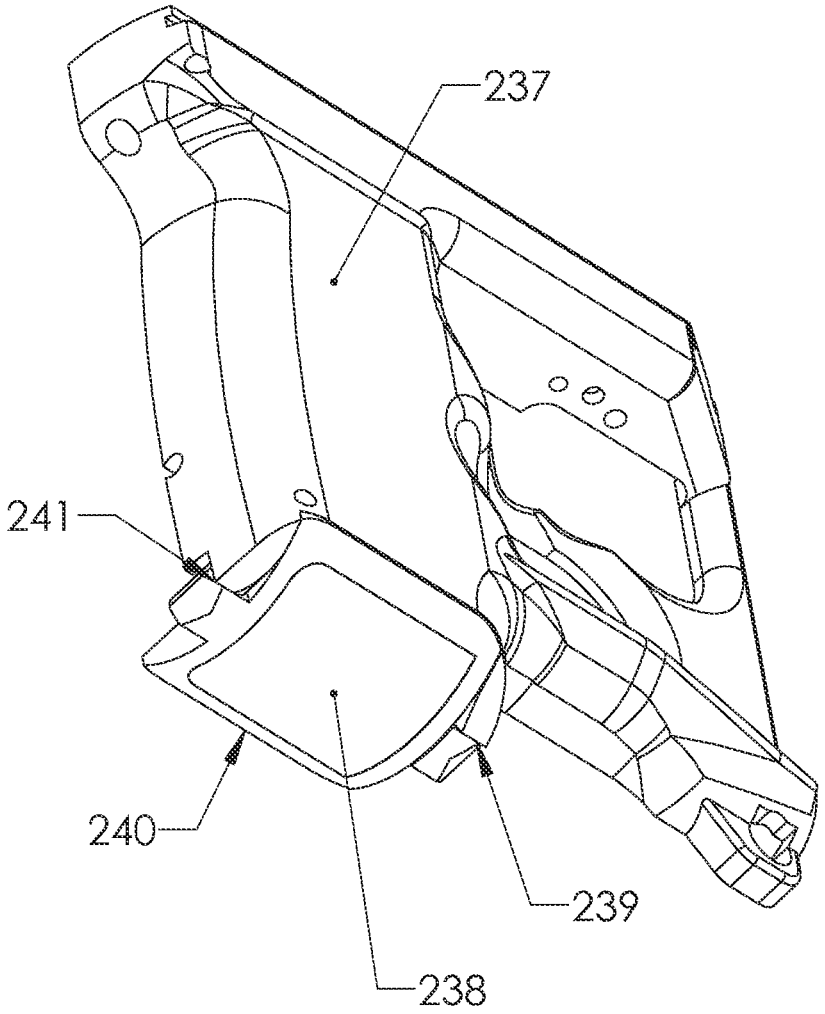
FIG. 44 is a schematic assembly drawing that illustrates a handgun with front and rear swing down handle extensions shown in their retracted and nested position.

FIG. 44 is a schematic drawing that illustrates a pivoted type of handgrip extension. Front handgrip portion 238 is pivotally mounted to handgrip 237 at pin joint 239. Rear pivoting handgrip extension 240 is pivotally mounted to handgrip 237 at pin joint 241. FIG. 44 shows the pivoted folding handgrip extension in its collapsed position with front handgrip section 238 nesting inside of rear folding handgrip section 240.

Figure 45:
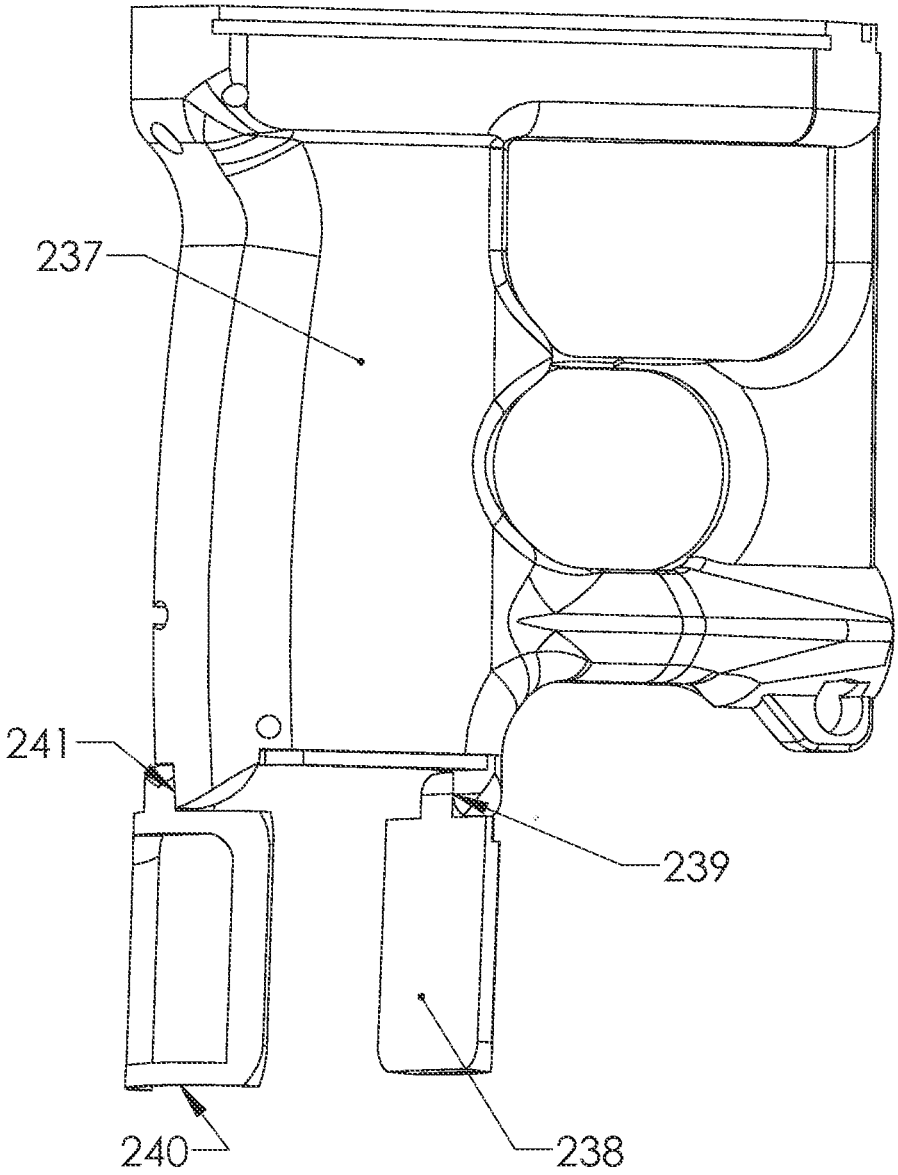
FIG. 45 is a schematic assembly drawing of the handgun shown in FIG. 40 above, with the front and rear swing down handle extensions shown in their extended or down position.

FIG. 45 is a schematic drawing that illustrates the handgun shown in FIG. 44 with the extending handgrip in its down or open position. Front swinging extension portion 238 has been pivoted about its pin joint 239 into its fully down and locked position. Similarly, rear swinging extension portion 240 has been pivoted about its pin joint 241 to its fully down and locked position.

Figure 46:
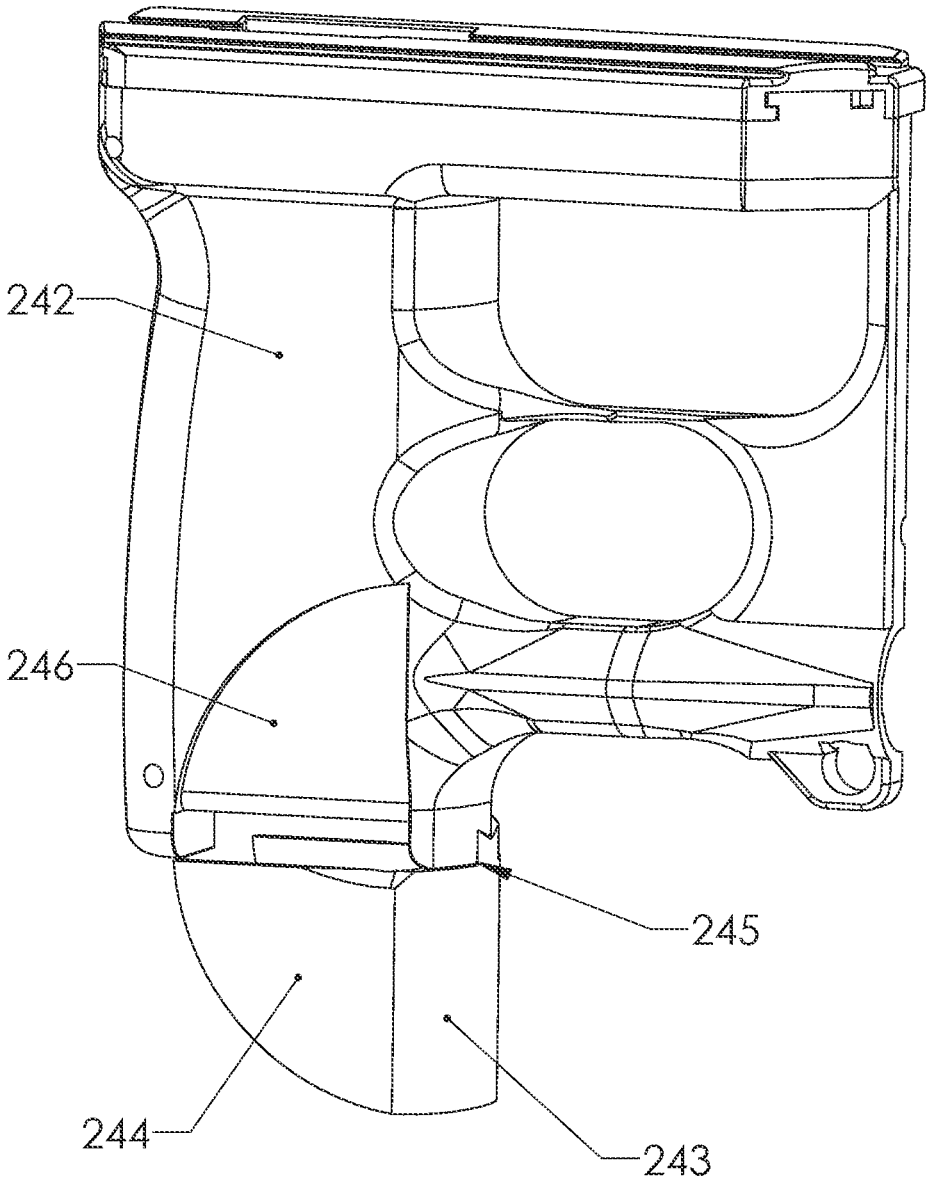
FIG. 46 is a schematic assembly drawing that illustrates handgun the handle extension wherein both the front and sides swing down to an extended position.

FIG. 46 is a schematic drawing that illustrates another embodiment of a handgun with an extending handgrip. The swing down handgrip extension contains front portion 243 and side portions 244. The extending portions are pivoted to handgrip 242 at pin joint 245. The handgrip extension is shown in its fully down and locked position. When folded to its up or closed position, side portions 244 will nest in pockets 246 machined into handgrip 242.

Figure 47:
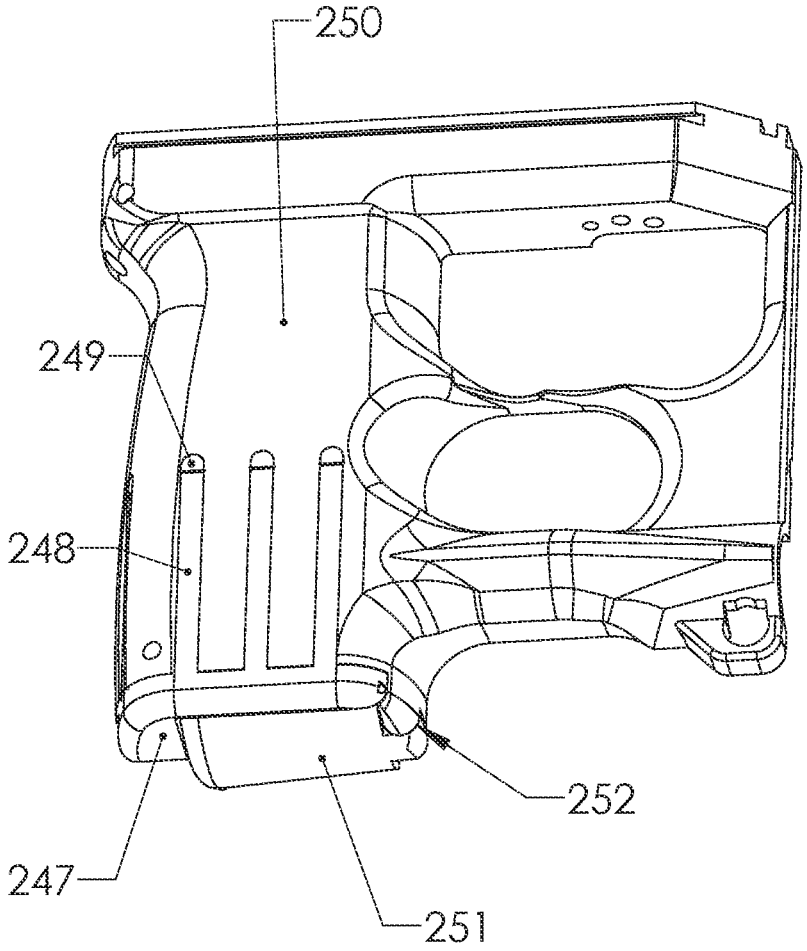
FIG. 47 is a schematic assembly drawing that illustrates a handgun with an expanding handle system which is a combination of telescoping dovetail strips in corresponding grooves and a swing down front portion.

FIG. 47 is a schematic drawing that illustrates handgun with another embodiment of a telescoping hand grip. Telescoping grip base 247 contains dovetail fingers 248 which nest in dovetail grooves 249 and handgun grip 250. Front swing down piece 251 is pivotally mounted to handgun grip 250 at pin joint 251. FIG. 47 shows the extending grip assembly in its closed or retracted position with the dovetail fingers 248 fully extended up into dovetail grooves 249 and the swing down piece 251 folded up and nested in extending grip base 247.

Figure 48:
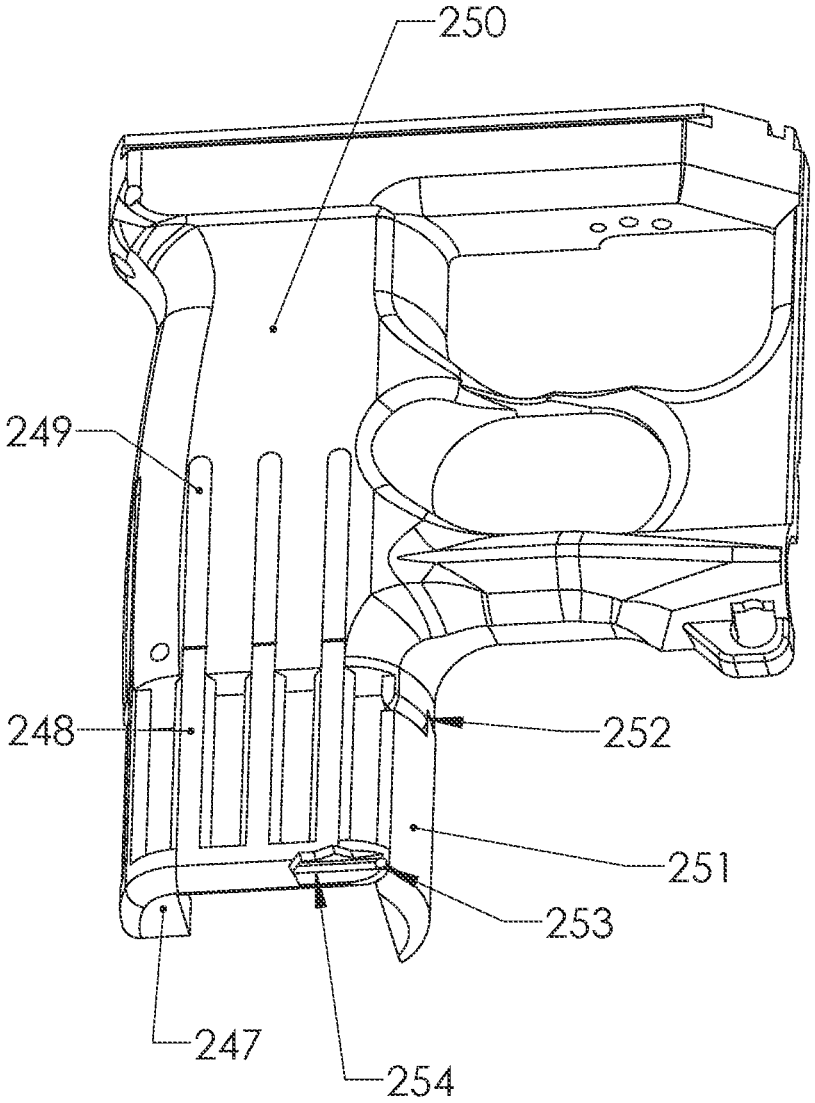
FIG. 48 is a schematic assembly drawing of the handgun illustrated in FIG. 47 above, but with the handle extension system in a down or extended position.

FIG. 48 is a schematic drawing that illustrates the extending handle system shown in FIG. 47 with the extending grip in its fully extended position. Extending hand grip based 247 has been moved down away from handgrip 250 and front swing down piece 251 has been rotated down to its vertical and locked position. Stud 253, attached to front swing down piece 251 may slide in slot 254 of extending base 247 to coordinate movement between the two members and provide a guiding and locking means.

Figure 49:
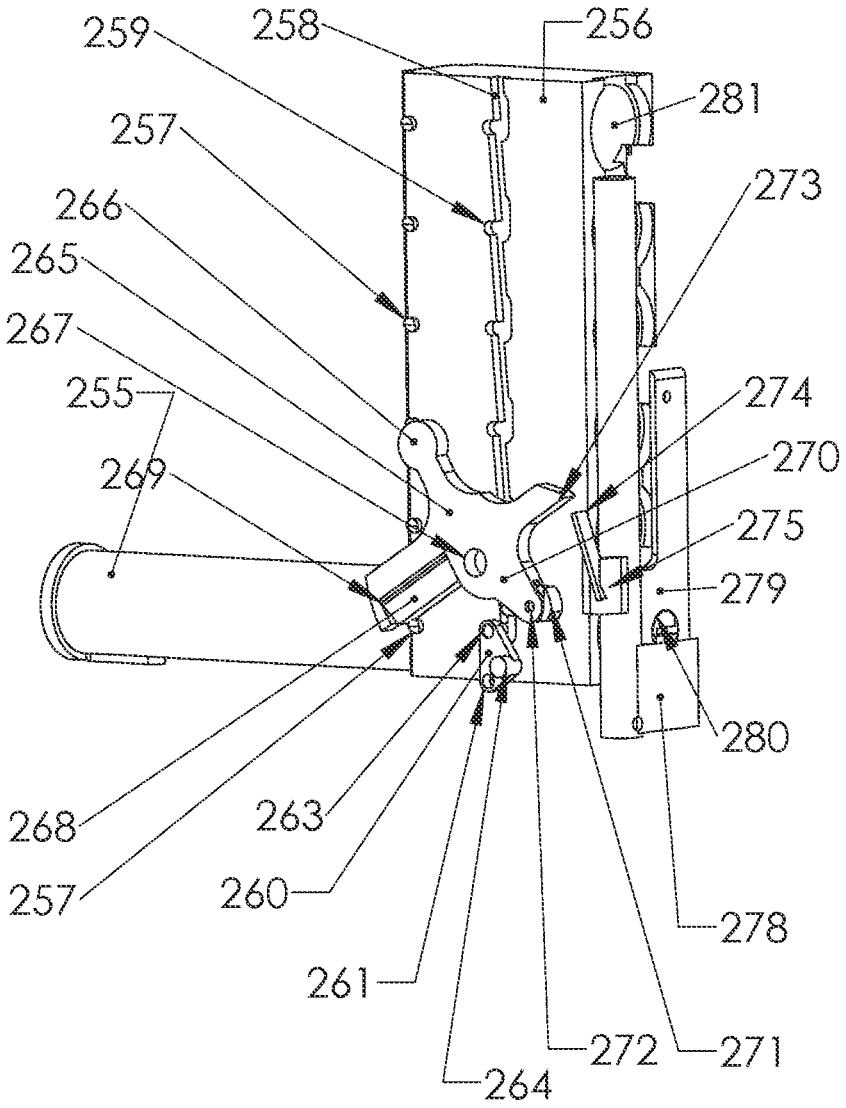
FIG. 49 is a free-floating subassembly drawing of an alternative combination ratchet type magazine indexing system and hammer actuating system shown in an "at-rest position.

FIG. 49 is a free-floating schematic subassembly drawing that illustrates a combination magazine indexing system and cartridge firing mechanism. Magazine 256 is captivated in and guided through a gun frame (not shown). It will be indexed downwardly sequentially aligning a plurality of cartridge chamber's 281 with gun barrel 255. Magazine 256 is fitted with indexing studs 257 located in line with each cartridge chamber 281. Guiding channel 258 is cut down through the side of magazine 256. Locating and locking notches 259 are located in slot 258 and space such that they will align and lock the magazine in place for each sequential cartridge chamber 281. Magazine locking lever 260 is pivotally mounted to the gun frame journal number 261. Stud 263 is integrally attached to magazine locking lever 260 and engages track 258 and locates and locks the magazine in place by engaging slot 259. Indexing and firing arm 265 is pivoted about point 267 and pivotally mounted to a gun frame (not shown). Indexing and firing arm 265 is engaged and actuated by a horizontally moving trigger mechanism (not shown) at lobe 266. Indexing and firing arm 265 is equipped with a pivoting pawl 268 pivotally attached to indexing and firing arm 265 by pivot pin 269. Pawl 268 engages indexing studs 257 of magazine 256 to affect index movement. Magazine lock release arm 270 extends down from magazine indexing and firing arm 265. Magazine lock releasing pawl 271 is pivoted in arm 270 by pivot pin 272. Hammer firing finger 273 extends out from indexing and firing arm 265 on the opposite side from magazine indexing pawl 268. Hammer firing finger 273 will engage leaf spring sear 274 which is attached to firing hammer 276 in mounting nest 275. Firing hammer 276 also contains extended wedge firing portion 278 which will contact firing anvil 279 which contains firing pin 280 which will strike the priming cap of a cartridge and thus fire the gun.

Figure 50:
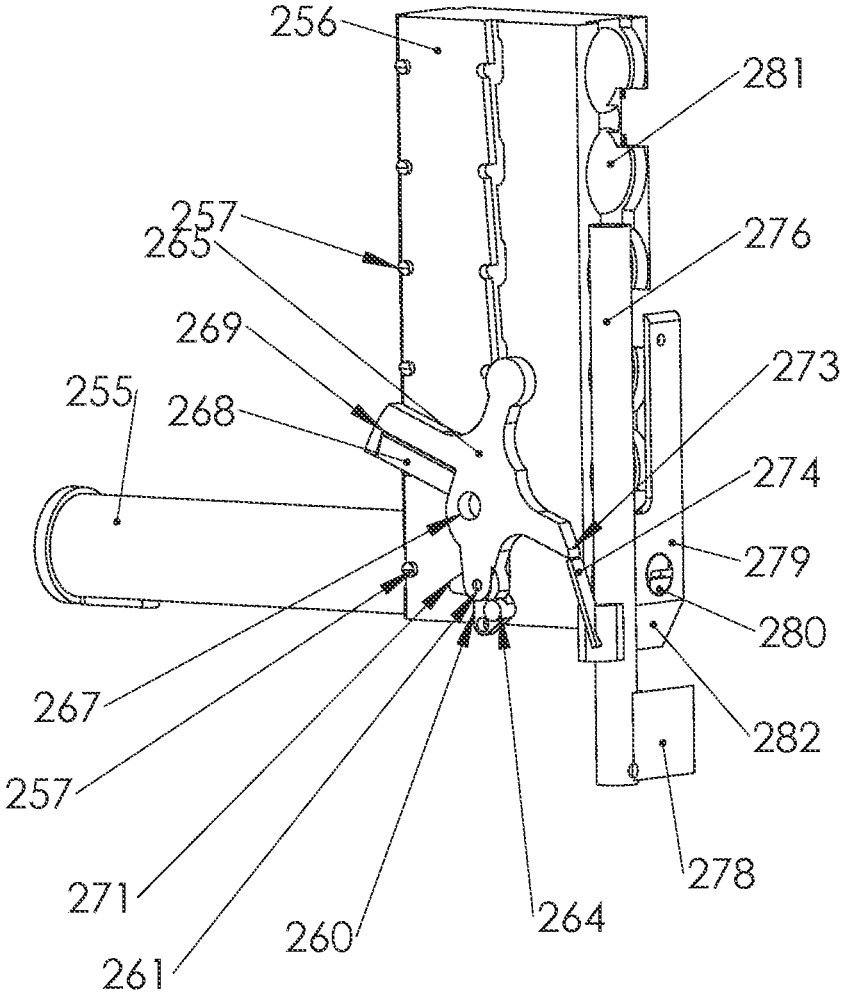
FIG. 50 is a free-floating schematic subassembly drawing of the mechanism illustrated in FIG. 45 above, with the mechanism in a "just before firing" position.

FIG. 50 is a free-floating schematic assembly drawing of the same mechanism shown in FIG. 49. Indexing and firing arm 265 has been rotated to a position just before firing by partial stroke of a trigger pull. Magazine indexing pawl 268 has rotated about its axis 269 and is passing over the next sequential indexing stud 257 on magazine 256 without disturbing the position of magazine 256. Magazine lock releasing pawl 264 has rotated about its axis 261 and is passing over release stud 272 of magazine locking lever 260 and leaving 260 in locked position. The rotation of indexing and firing arm 265 has rotated Hammer firing finger 273 into contact with spring sear 274 which in turn has depressed firing hammer 276 down leaving a space between firing wedge 278 of firing hammer 276 and firing anvil 279. Inclined wedge surface 282 of firing anvil 279 is now visible.

Figure 51:
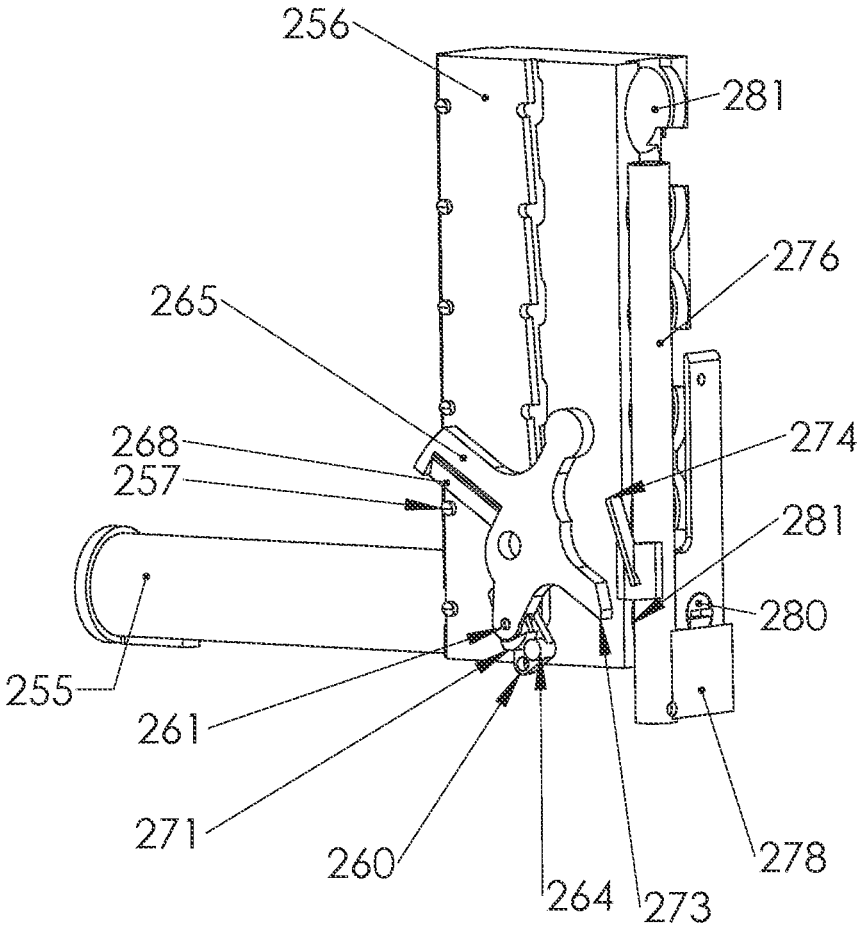
FIG. 51 is a free-floating schematic subassembly drawing of the same mechanism illustrated in FIG. 50 above with the mechanism shown in "fired" position.

FIG. 51 is a free-floating schematic subassembly drawing of the same mechanism illustrated in FIG. 50 above. Indexing and firing arm 265 has been rotated to the "just fired" position by the full stroke of the trigger (not shown). Firing finger 273 has slipped off of the spring sear 274 allowing firing hammer 276 to slam upward thereby driving firing wedge 278 and the inclined surface of firing anvil 279 and thus driving firing pin 280 into the priming cap of the cartridge in magazine chamber 281 in line with gun barrel 255. Magazine indexing pawl 268 has cleared magazine indexing post 257 and snapped back to its catch possession where it will engage indexing pin 257 on its down stroke. Magazine lock release pawl 271 has rotated back about its pivot point 261 into locking position behind Magazine lock release stud 264 of magazine locking arm 260.

Figure 52:
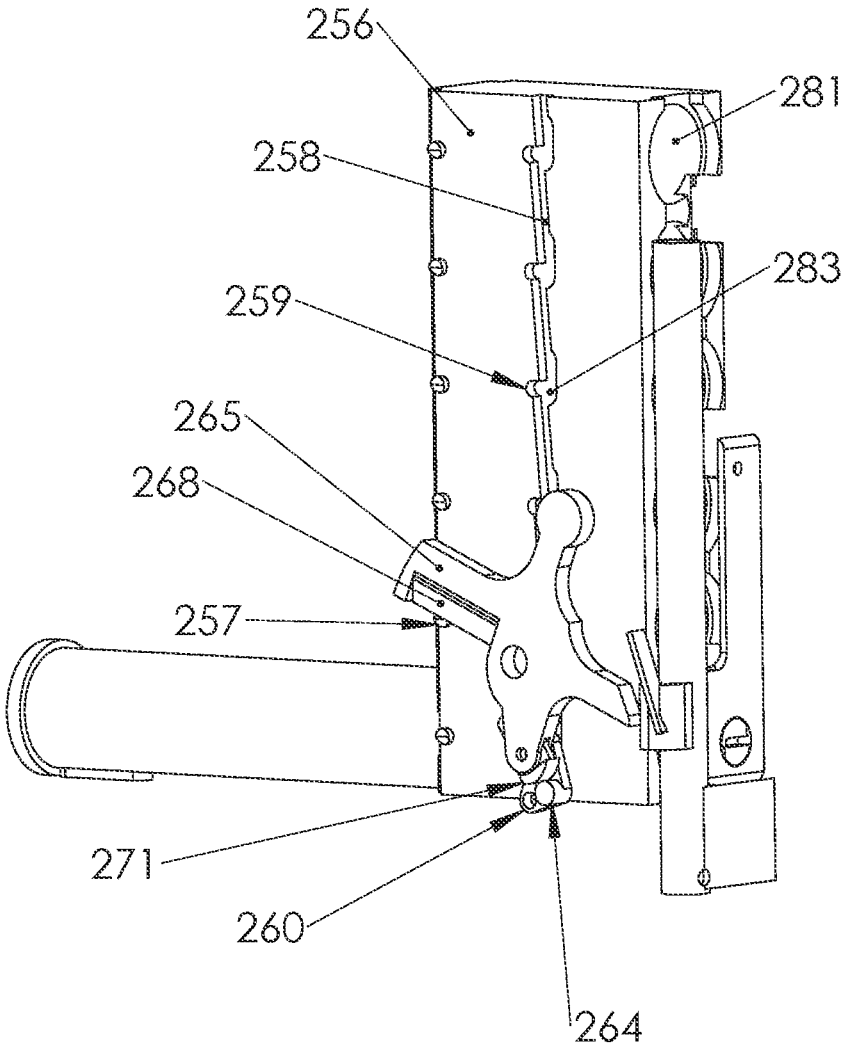
FIG. 52 is a schematic free-floating subassembly drawing of the same mechanism shown in FIG. 52 above with the mechanism shown with the trigger in a returning position at the beginning of magazine index.

FIG. 52 is a free-floating schematic assembly drawing of the same mechanism illustrated in FIGS. 50 and 51 above. FIG. 52 shows the mechanism during the return trigger stroke at the point where magazine index will begin. Indexing and firing arm 265 has rotated counterclockwise and magazine indexing pawl 268 has engaged magazine indexing stud 257. Magazine lock release pawl 271 has engaged stud 264 on magazine locking lever 260 and has rotated lever 260 clockwise sufficiently to disengage locking pin 263 (not shown, see FIG. 49) and disengaged pin 263 from locking notch 259. Stud 263 is now in the enlarged section 283 of magazine control track 258 and magazine 256 is free to move down.

Figure 53:
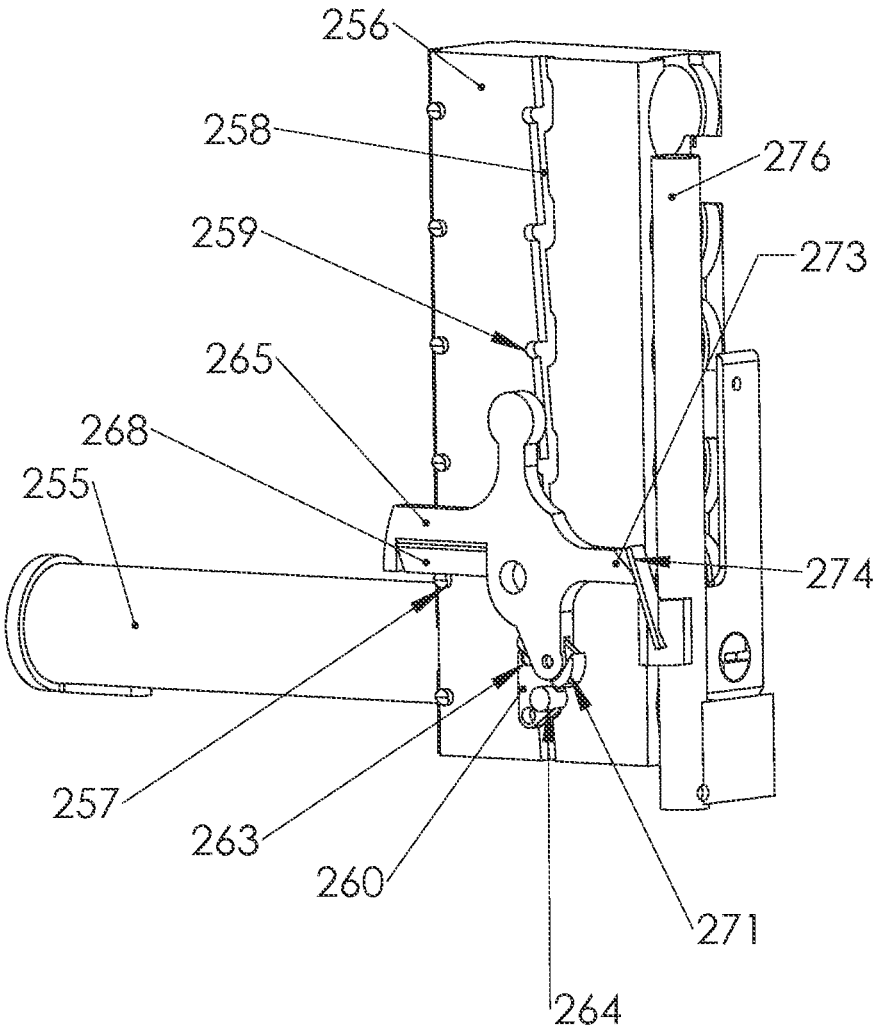
FIG. 53 is a schematic free-floating subassembly drawing of the same mechanism illustrated in FIG. 52 above with the trigger in a "half returned" position and the magazine in a "half indexed" position.

FIG. 53 is a free-floating schematic assembly drawing of the same mechanism illustrated in FIG. 50-52 above. FIG. 53 shows the mechanism with the trigger in its mid-return stroke and the magazine in its mid-index position. Indexing and firing arm 265 has rotated counterclockwise and magazine indexing pawl 268 engaged with magazine indexing stud 257 has moved magazine 256 part way through its indexing distance. Magazine lock release pawl 271 has snapped over stud 264 on magazine locking lever 260 and magazine locking stud 263 is engaged in magazine control grove 258 and is biased counterclockwise toward the locking notch 259 by a spring (not shown). Hammer firing finger 273 has engaged leaf Spring sear 274 on its return stroke and will deflect spring sear 274 as it passes and will not move firing hammer 276.

Figure 54:
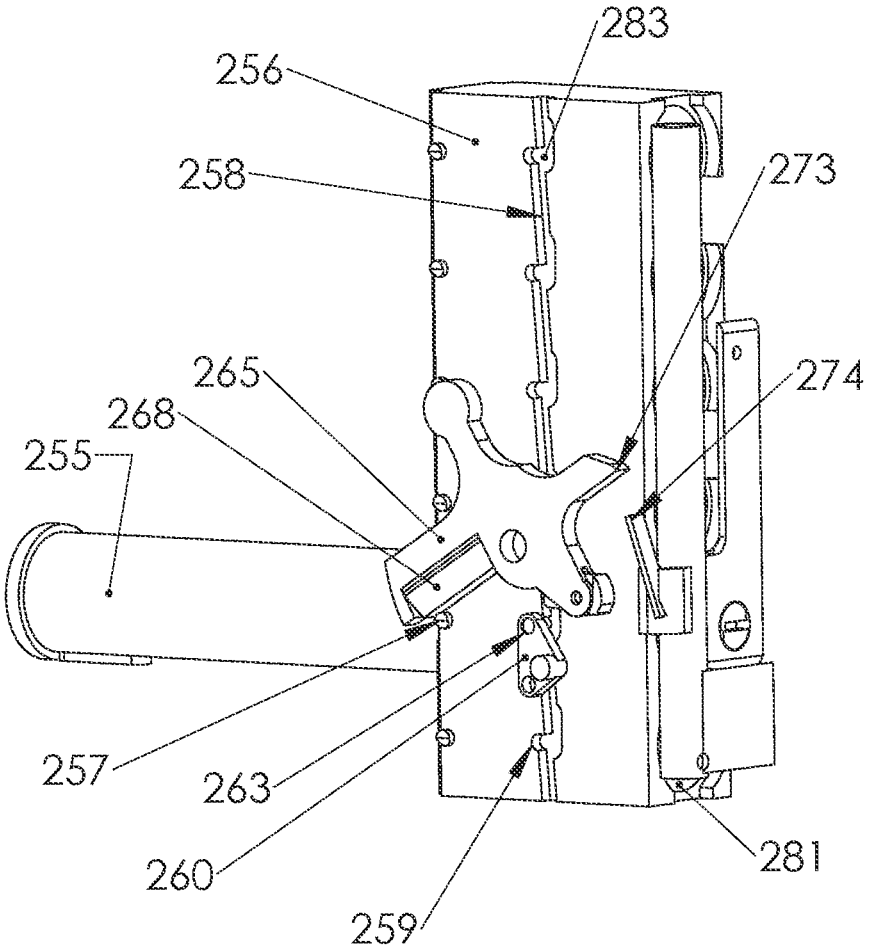
FIG. 54 is a schematic free-floating subassembly drawing of the same mechanism illustrated in FIG. 49 above with the trigger in a "fully returned" position and the magazine in a "fully indexed and locked" position.

FIG. 54 is a free-floating schematic subassembly drawing of the same mechanism illustrated in FIG. 50 thru 53 above. Magazine indexing and firing arm 265 is rotated counterclockwise to its full return position. Magazine indexing pawl 268 is engaged with magazine indexing stud 257 and has moved magazine 256 down one full stroke to align the next cartridge firing chamber 281 with barrel 255. Magazine locking stud 263 is engaged in a locking notch 259 in magazine control track 258. Hammer firing finger 273 has cleared flat leaf spring sear 274 and is in position for the next trigger pull.

Figure 55:
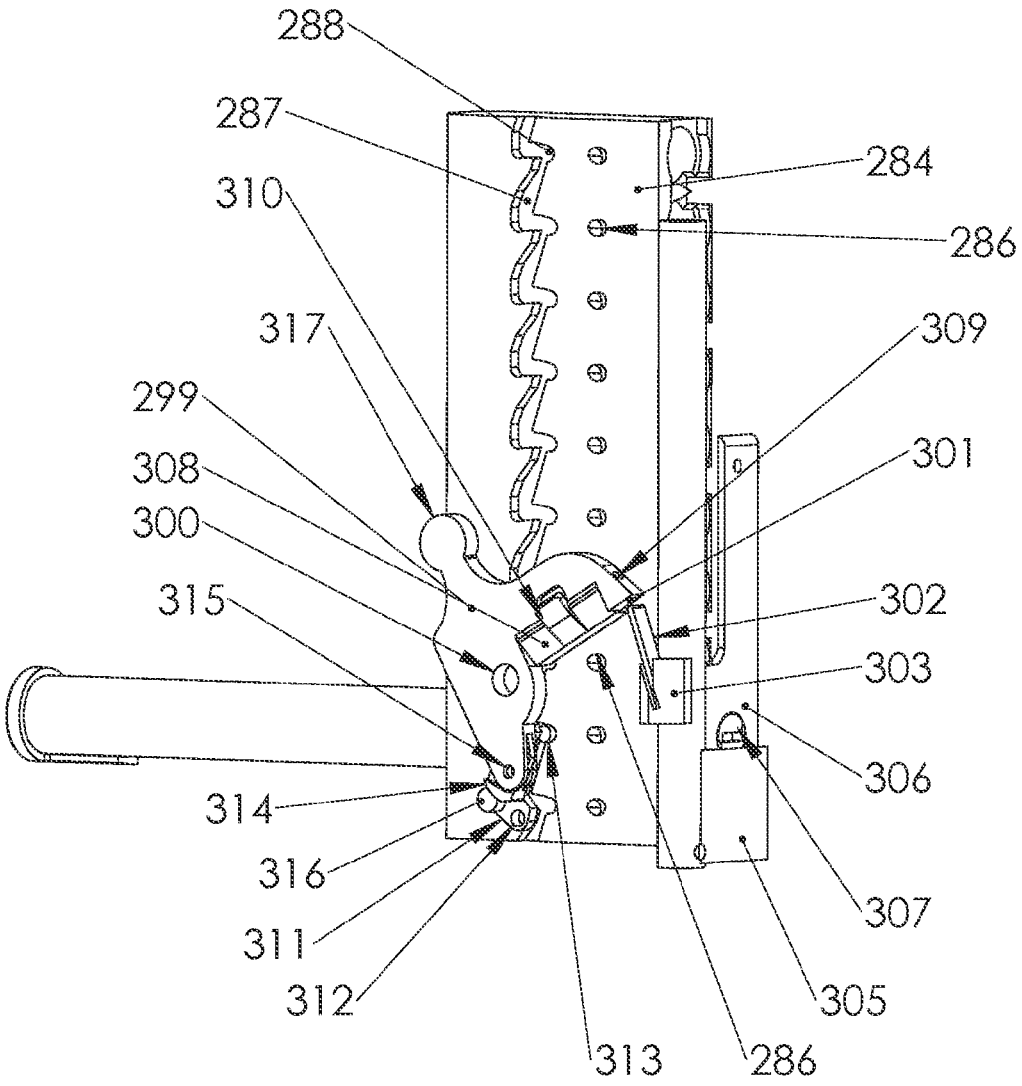
FIG. 55 is a free-floating schematic subassembly drawing that illustrates a combination firing mechanism and ratchet type magazine index mechanism wherein the magazine is indexed on the pull stroke of the trigger.

FIG. 55 is a schematic free-floating subassembly drawing that illustrates an alternative arrangement of a combination ratchet type magazine indexing and firing mechanism in accordance with this invention. FIG. 49 through FIG. 54 above, illustrate a ratchet type indexing mechanism which indexes a magazine on the return stroke of the trigger. FIG. 55 through FIG. 59 illustrate a ratchet type magazine indexing system and firing mechanism which indexes the magazine during the pull stroke of the trigger. Cartridge magazine 284 has multiple cartridge firing chambers 285 and is equipped with properly spaced indexing pegs 286. Channel 287 in the side of magazine 284, guides magazine control locking stud 313. Magazine locking stud 313 engages notches 288 in control track 287 to lock magazine 284 in the proper position for firing at each individual firing chamber 285. 299 is a combination firing mechanism actuating arm and magazine indexing arm. Arm 299 is pivoted about pivot point 300. Surface 301 of firing arm 299 engages spring sear 302 during the firing sequence. Spring sear 302 is mounted in pocket 303 attached to tubular firing hammer 304. Wedge-shaped extension section 305 of hammer 304 engages spring loaded firing anvil 306 which contains firing pin 307 which engages the primer cap of a cartridge and fires the gun. Arm 299 is also equipped with a pivoting magazine indexing pawl 308 which is pivoted about pin 309 mounted in arm 299. Pawl 308 is spring biased such that it will engage magazine indexing pegs 286. Pawl 308 also contains cam surface 310 which protrudes outwardly from Pawl 308. Magazine locking stud 313 is integral with magazine locking arm 311 which is pivoted about pivot point 312. Magazine locking arm release pawl 314 is attached to arm 299 and pivotally mounted at journal 315. Magazine lock releasing Pawl 314 engages stud 316 which is integral with magazine locking arm 311. Arm 299 is actuated by a trigger yoke (not shown) which engages surface 317. FIG. 55 illustrates the mechanism in its "at rest" position with the trigger forward and actuating arm 299 in its most counterclockwise position. In this position there is a space between magazine indexing pawl 308 and magazine indexing stud 286.

Figure 56:
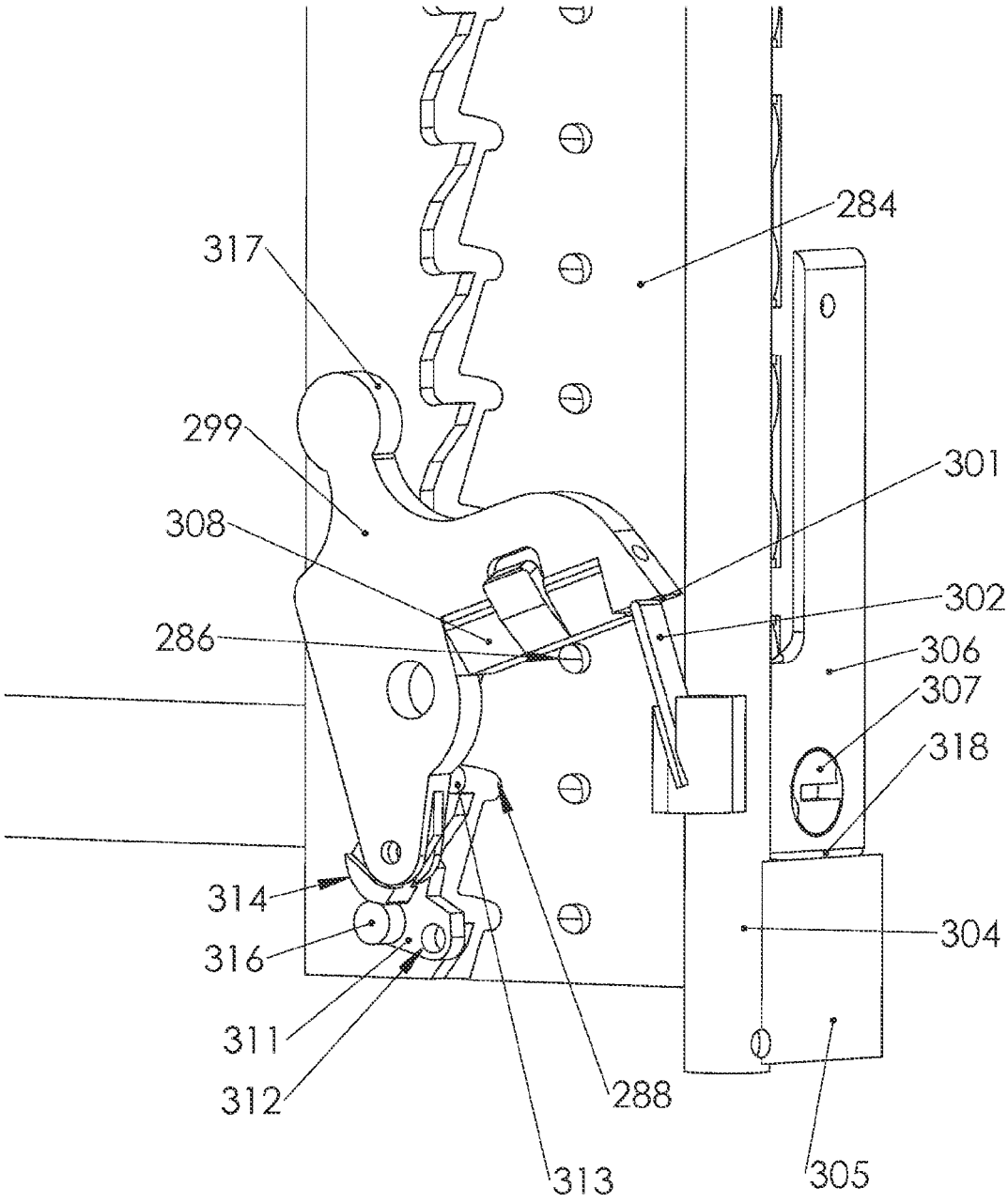
FIG. 56 is a free-floating schematic subassembly drawing of the mechanism illustrated in FIG. 55 above with the mechanism at the beginning of the magazine index stroke.

FIG. 56 is a free-floating subassembly schematic drawing of the mechanism illustrated in FIG. 55 above with the mechanism at the beginning of the magazine index stroke. The trigger has been pulled slightly to the right thus rotating arm 299 about pivot point 300. The engagement of surface 301 with sear spring 302 has depressed firing hammer 304 down slightly. Extension 305 of hammer 304 has moved down allowing a gap between firing hammer extension 305 and firing anvil 306 exposing wedge-shaped surface 318 of firing anvil 306. This relief of firing anvil 30 has allowed it to move back disengaging firing pin 307 from any previously fired cartridges in clearing the magazine for index. Magazine lock release pawl 314 has engaged stud 316 of magazine locking arm 311 and rotated it about point 312 thus retracting magazine locking stud 313 from magazine locking notch 288. Magazine indexing pawl 308 has just engaged magazine indexing stud 286 on magazine 284. Further rotation of arm 299 will begin indexing magazine 284 in a downward direction.

Figure 57:
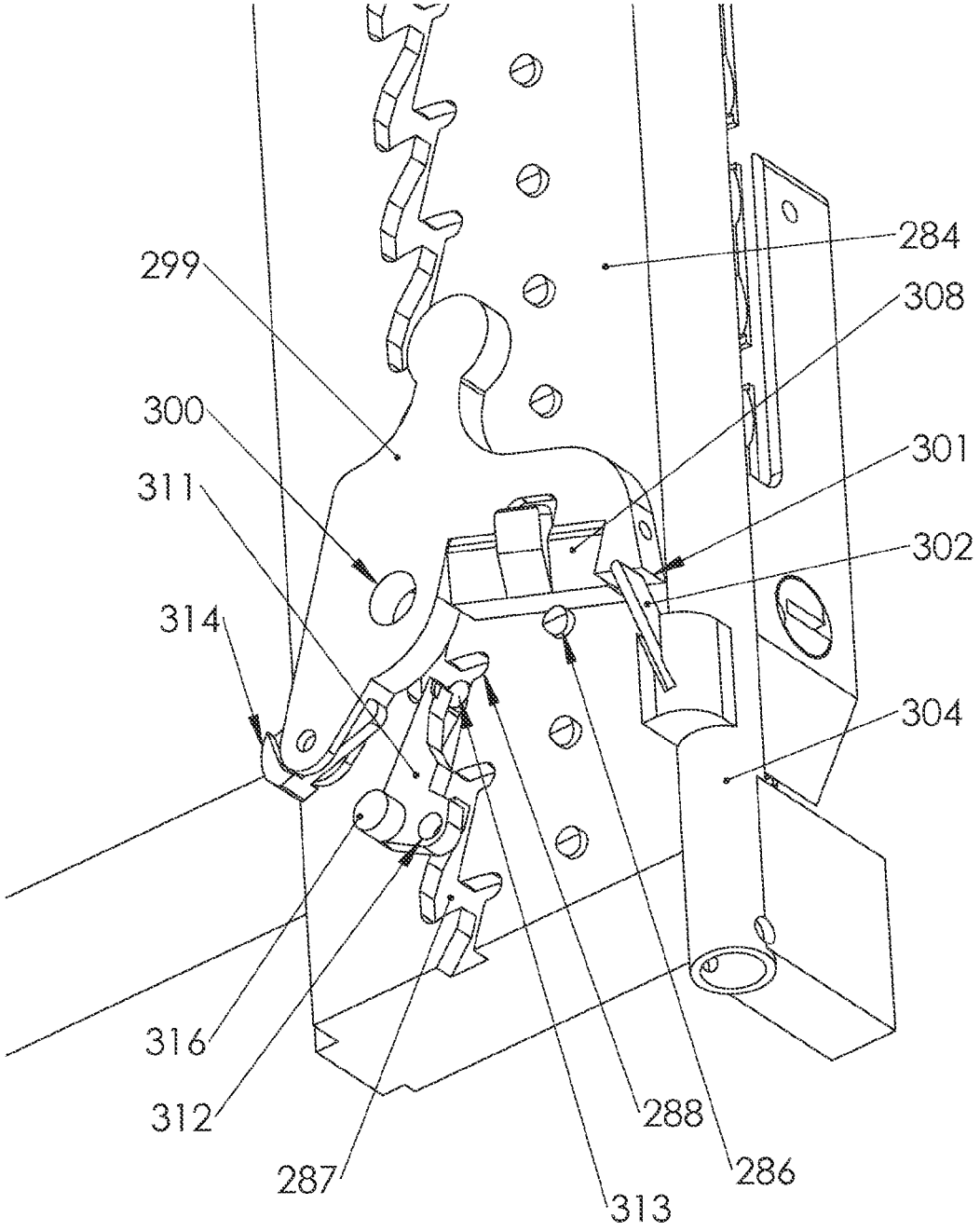
FIG. 57 is a free-floating schematic subassembly drawing of the mechanism illustrated in FIG. 55 above with the mechanism near the end of the magazine index stroke.

FIG. 57 illustrates the mechanism above during the magazine index stroke. Arm 299 has rotated further clockwise about pivot point 300. The engagement of surface 301 pressing against spring sear 302 has continued to move hammer 304 in a downward direction. Magazine indexing Pawl 308 is engaged with magazine indexing peg 286 and has moved magazine 284 in a downward direction. Magazine control lock release Pawl 314 has passed over stud 316 and allowed magazine control arm 311 to rotate about pivot point 312 thus engaging magazine locking stud 313 in slot 287. Arm 311 is shown cutaway for clarity. Arm 311 is spring biased in a clock wise direction thus forcing stud 313 against the right wall of slot 287.

Figure 58:
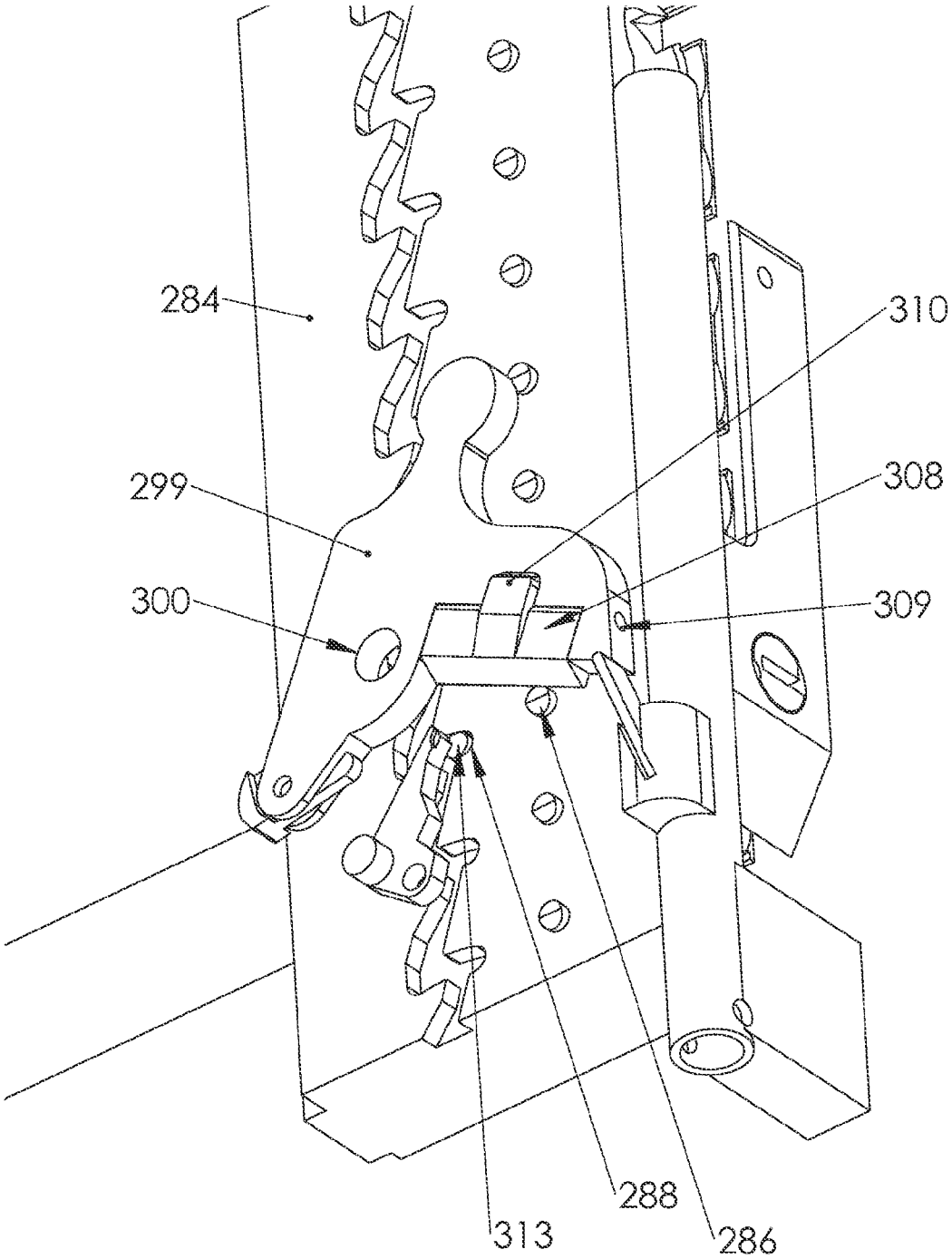
FIG. 58 is a free-floating schematic subassembly drawing of the mechanism illustrated in FIG. 55 above with the mechanism at the end of the magazine index stroke illustrating the magazine lock.

FIG. 58 is a free-floating schematic sub-assembly drawing of the mechanism above illustrating the end of the magazine index stroke. The continued rotation of arm 299 about pivot 300 has caused cam surface 310 of magazine indexing pawl 308 to encounter a stationary flat cam surface on the inner wall of the handgun frame (not shown). The stationary cam surface has rotated magazine index pawl 308 about pivot pin 309 thus disengaging pawl 308 from magazine index peg 286. Magazine locking stud 313 is now engaging locking slot 288 which will lock magazine 284 in position.

Figure 59:
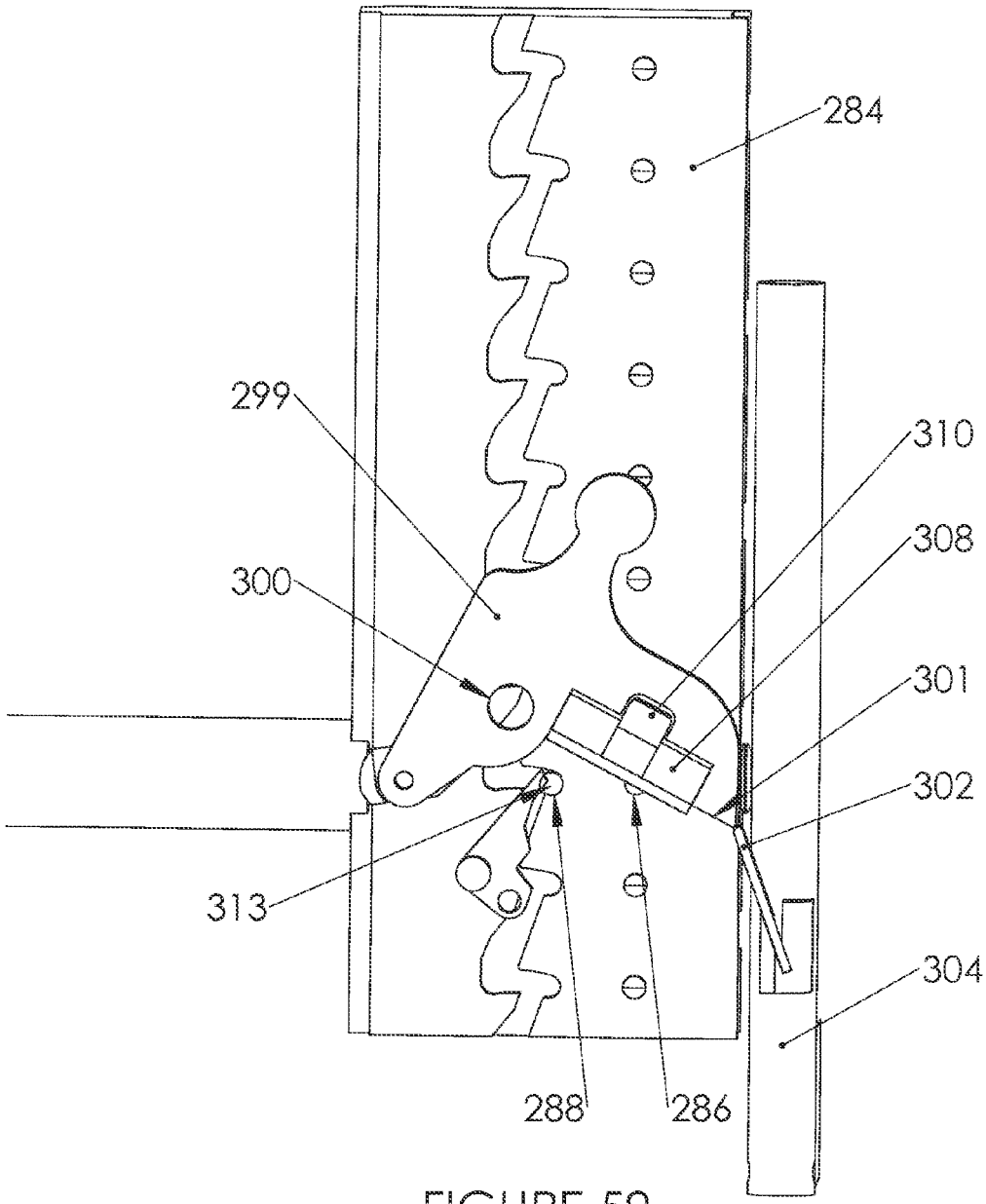
FIG. 59 is a free-floating schematic subassembly drawing of the mechanism illustrated in FIG. 55 above with the mechanism in the "firing position" at the end of the trigger pull.

FIG. 59 is a free-floating schematic subassembly drawing of the above mechanism in its firing position. Magazine indexing pawl 308 is still rotated to a disengaged position and has bypassed magazine indexing pawl 286. Magazine locking stud 313 is engaged in magazine locking notch 288 thus locking magazine 284 in the proper position. Arm 299 has rotated about pivot point 300 to a point where surface 301 will slip off of spring sear 302 which will allow firing hammer 304 to rapidly rise and fire the weapon.

The mechanism illustrated in FIG. 55 through FIG. 59 illustrates a system which indexes a magazine 284 through a handgun in a downward direction. The mechanism could be configured to index magazine 284 in an upward direction by inverting magazine indexing pawl 308 and placing it on the opposite side of pivot point 300 and simultaneously positioning indexing pegs 286 on the opposite side of pivot point 300 aligned with indexing pawl 308.

Figure 60:
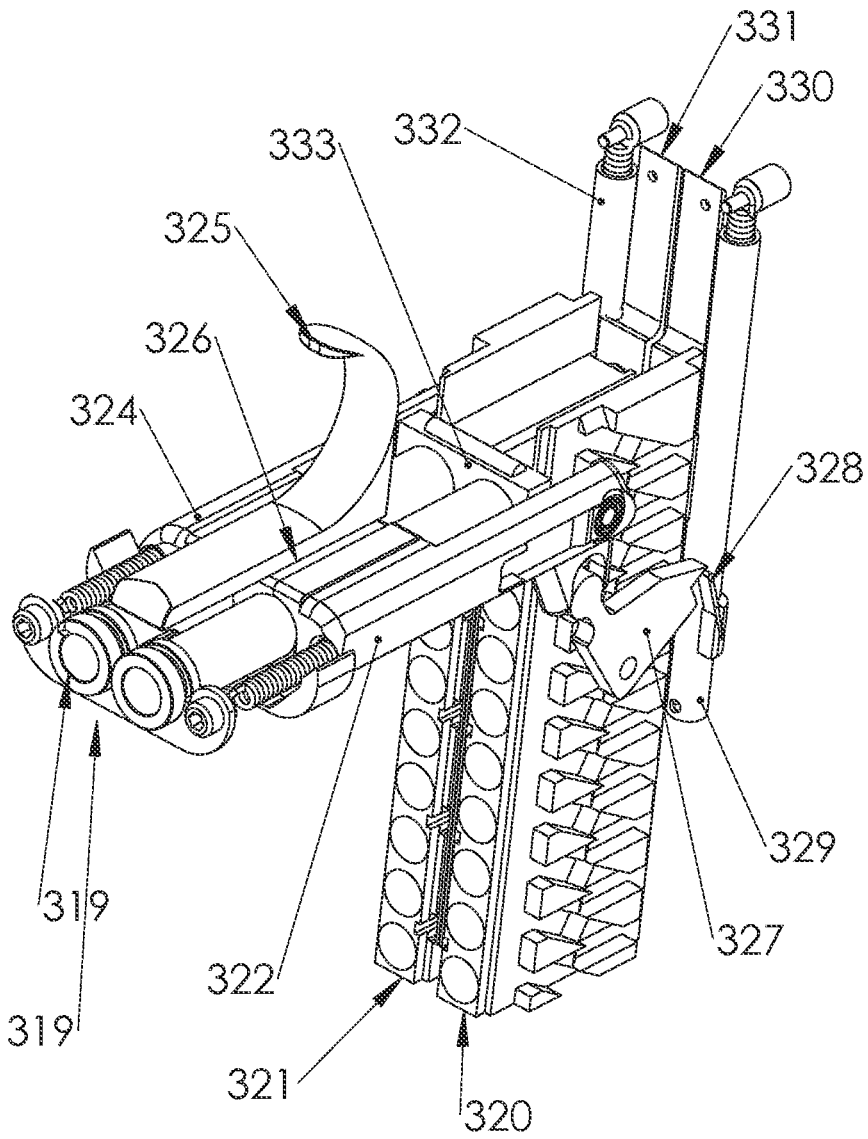
FIG. 60 is a free-floating schematic subassembly drawing that illustrates a side-by-side double-barreled double magazine handgun configuration according to disclosures of this invention.

FIG. 60 is a free-floating schematic subassembly drawing that illustrates a double barrel and double magazine handgun according to disclosures of this invention. The handgun illustrated in FIG. 60 is basically two handguns mounted side-by-side in the same housing. The basic design of these handguns is similar to that illustrated in FIG. 29, above, with some modifications. Two barrels 319 are mounted horizontally parallel to each other. Left magazine 320 and right magazine and 321 are mirror images of each other and are mounted parallel and aligned with barrels 319. Left trigger slide 322 engages firing hammer actuating lever 327 which engages left spring sear 328. Left spring sear 328 is attached to left firing hammer 329 and hammer 329 engages left firing anvil 330 in an arrangement similar to that described and illustrated in FIG. 29. Similarly, right trigger slide 324 engages a corresponding hammer actuating lever (on opposite side and not visible) which actuates right firing hammer 332 which in turn actuates right firing anvil 331. Trigger pull 325 is pivotally attached to a separate center trigger slide 326. Center trigger slide 326 slides between left trigger slide 322 and right trigger slide 324 and can be independent of each of them. Rear barrel support insert 333 is inserted in the handgun frame halves (not shown) to support and align the rear ends of barrels 319.

Figure 61:
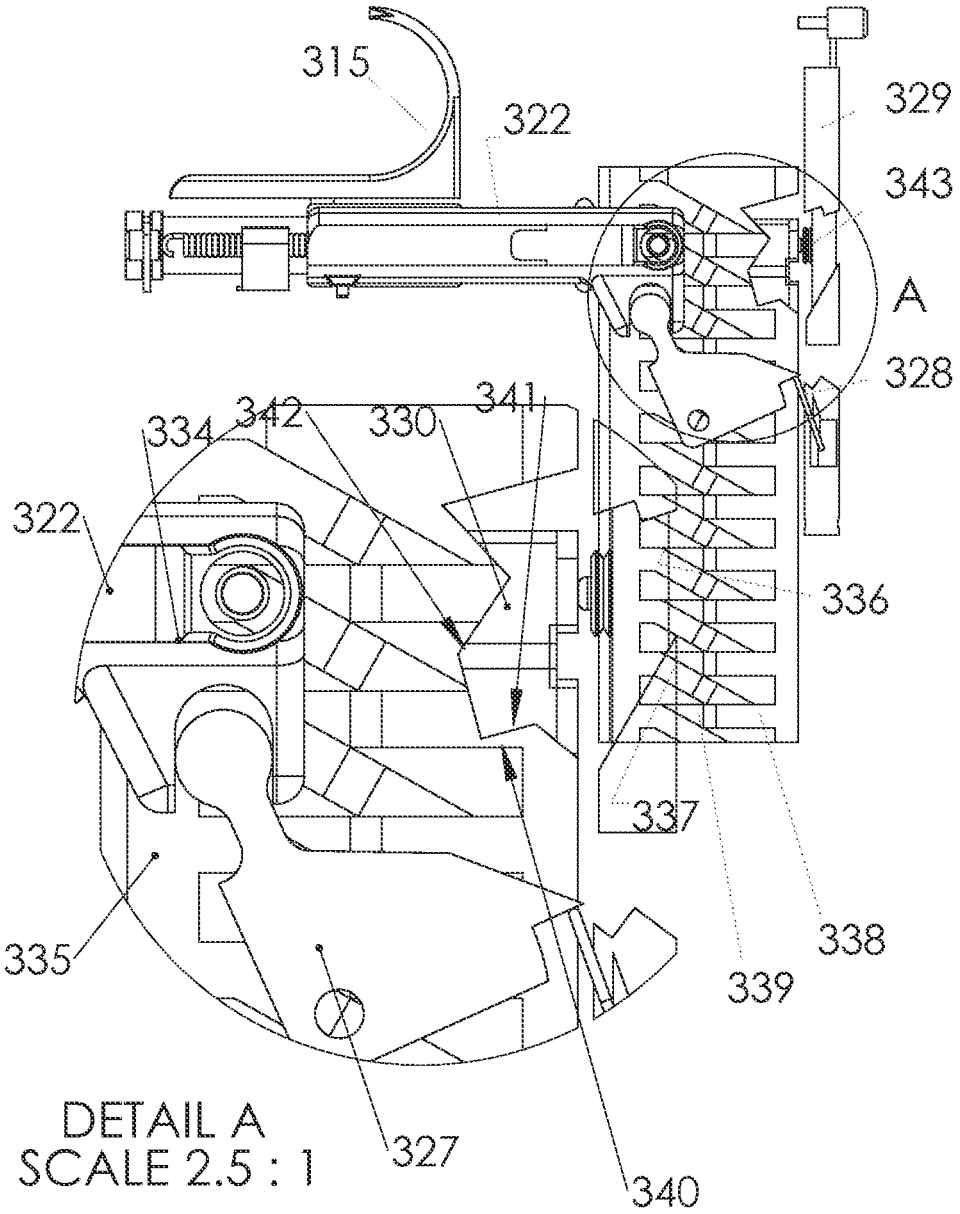
FIG. 61 is a free-floating subassembly schematic drawing and an enlarged detail drawing view illustrating the handgun shown in FIG. 60 above with the mechanism in the position at the beginning of the magazine index stroke.

FIG. 61 is a free-floating schematic subassembly drawing and an enlarged detail drawing that illustrates the magazine cam design and interaction between the trigger mechanism, firing mechanism, and the magazine index mechanism. Cartridge magazine 320 is equipped with a cam track to index said magazine through a handgun handle. The cam track is designed to index the magazine the full distance between successive cartridges during the trigger pull stroke only and to maintain the magazine in a fix or dwell position during the trigger return stroke. The magazine cam track consists of an initial straight or dwell portion 335 which will allow some trigger motion before magazine index. During the initial stroke of the trigger, hammer actuating arm 327 is rotated and, through contact with spring sear 328, moves hammer 329 down sufficiently to allow firing anvil 330 and associated firing pin 343 to retract sufficiently to clear cartridges and magazine 320 before magazine index. The motion between firing anvil 330 and firing hammer 329 is controlled by the mating wedge surfaces 341 on firing anvil 330 and wedge surface 340 on firing hammer 329. Magazine cam track point 336 is a transition point at which point, magazine 320 will begin its index movement driven by trigger cam follower 344 acting against inclined track section 337. The magazine index period will end and magazine 320 will be held in proper firing position when trigger cam follower 344 enters magazine cam section 338. Magazine 320 will be held in its previous "fired" position during the return stroke of trigger 322 as cam follower 344 travels through the straight-line section 339 of the cam track on magazine 320.

Figure 62:
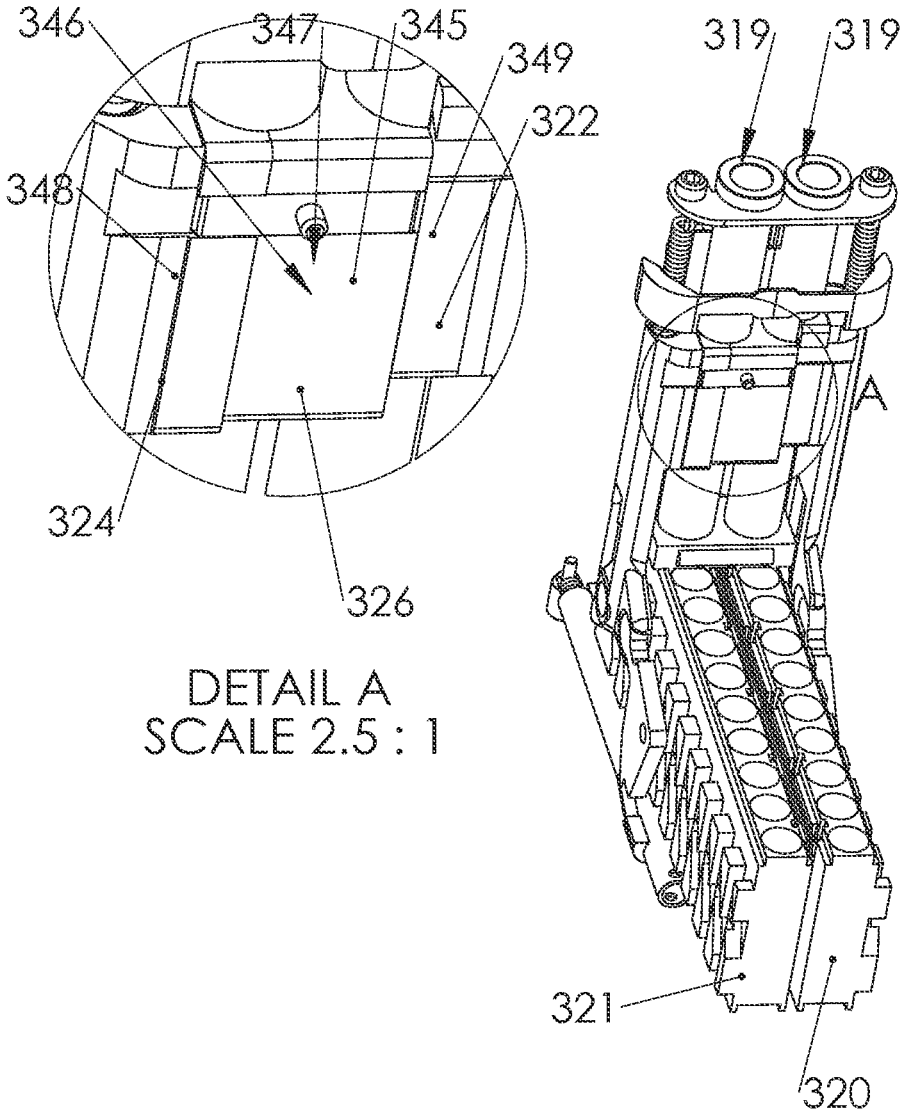
FIG. 62 is a free-floating subassembly schematic drawing and an enlarged detail view of the handgun shown in FIG. 60 above illustrating the barrel firing selecting mechanism.

FIG. 62 is a free-floating subassembly schematic drawing and an enlarged detail drawing that illustrates the mechanism to select which barrel and magazine will be fired. Underneath center trigger slide 326 is dovetail slot 347 which is cut transversely across the bottom of slide 326. Engaged in slot 347 is dovetail slide bolt 345 which may be equipped with protruding stud 346 to facilitate manual movement of slide 345. Transverse dovetail slot 348 is cut into right trigger slide 324 and similarly transverse dovetail slot 349 is cut into left trigger slide 322. The cross-sectional shape of dovetail slides 348 and 349 match the cross-sectional shape of dovetail slide bolt 345. Dovetail slots 348 and 349 may align with dovetail slot 347 and slide bolt 345 may be positioned to engage all three dovetail slots. With dovetail slide bolt 345 simultaneously engaging center slide 326 and left trigger slide 348 and right trigger slide 349, both barrels will be fired simultaneously with each trigger pull. When trigger slide bolt 345 is moved to engage only dovetail slot 348 in right trigger slide 324 and is free and clear of dovetail slot 349 in left trigger slide 322 as shown in detail "A" of FIG. 62, only right trigger slide and right barrel will be fired with each trigger pull. Similarly if dovetail slide bolt 345 is moved to the left such that it fully engages dovetail slot 349 in left trigger slide 322 and is clear of dovetail slot 348 in right trigger slide 324, only the left barrel will be fired with each trigger pull.

Figure 63:
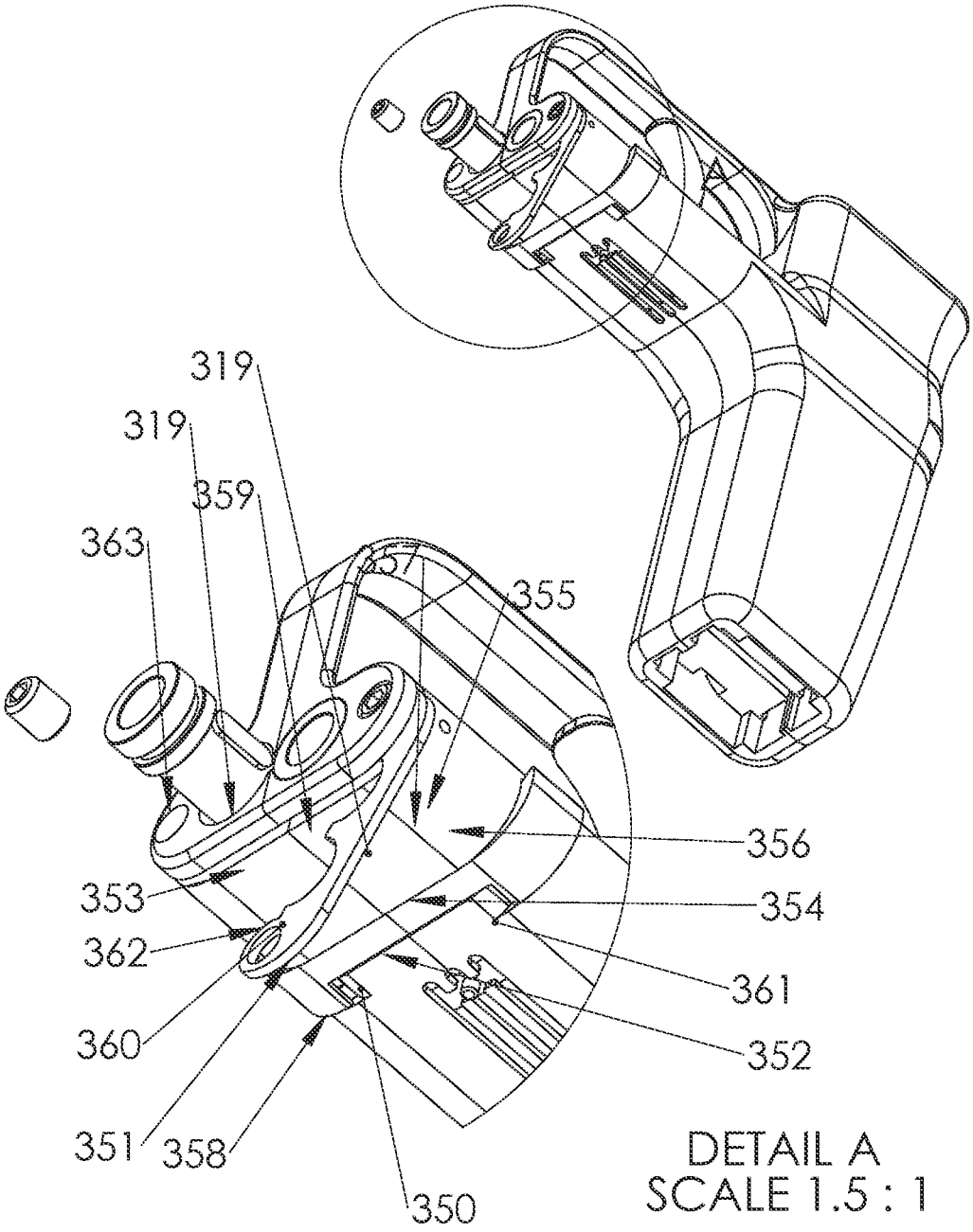
FIG. 63 is a free-floating subassembly schematic drawing and an enlarged detail view of the handgun shown in FIG. 60 above illustrating a quick change barrel retaining mechanism.

FIG. 63 is a schematic assembly drawing and an enlarged detail drawing that illustrates a quick change barrel retaining mechanism according to disclosures of this invention. Barrels 319 have retaining slots 353 cut angularly around the end of barrel 319. Barrels 319 are also equipped with keys 359 which engage mating slots in handgun frames 360 and 361 and provide proper angular alignment and prevent barrel rotation. Handgun frame halves 360 and 361 have a slot 351 cut partially through the barrel frames near the end of said frames. Retaining clip 350 fits into grooves 351 of handgun frames 360 and 361. Retaining clip 350 has radius sections 352 and 354 which engage and lock into barrel grooves 353. Retaining clip 350 has mounting holes at each end 356 and 358. Mounting hole 356 mates with threaded mounting hole 355 in handgun frame half 361 and may be retained by set screw 357. Similarly, mounting hole 358 in retaining clip 350 mates with threaded mounting hole 362 in handgun frame half 360 and may be retained by set screw 363. When either set screw 363 or set screw 357 are removed, retaining clip 350 may be swung down out of groove 351 and clear of grooves 353 in barrels 319 thus allowing barrels 319 to be removed.

Figure 64:
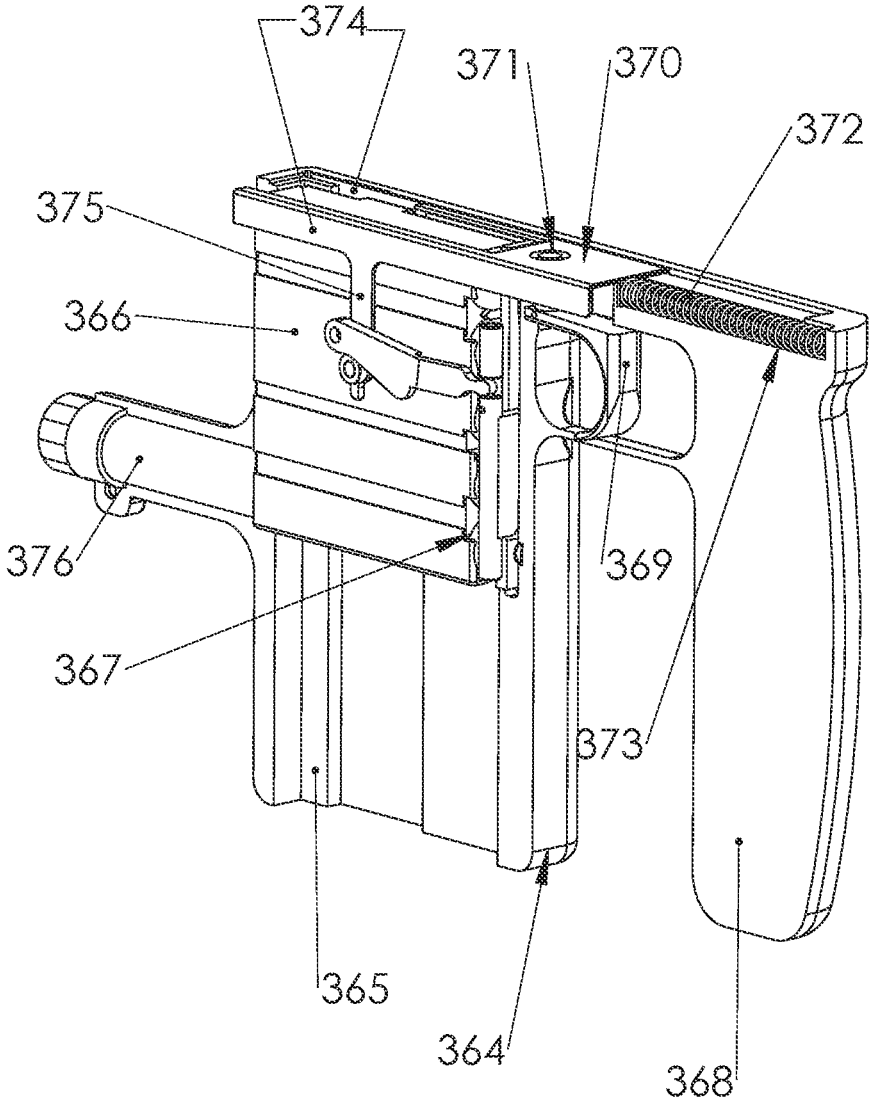
FIG. 64 is a schematic subassembly drawing of a handgun according to disclosures of the invention wherein the magazine is extremely long to accommodate long ammunition and thus too large to fit within the palm of the hand of a shooter. The embodiment shown has the handle grip and trigger moved rearward behind the magazine to allow a shooter to grip the handgun.

FIG. 64 is a schematic assembly drawing that illustrates a different embodiment of a handgun according to this invention. Gun frame 364 has a channel 365 to accommodate and guide a multiple cartridge magazine 366. Magazine 366 is sufficiently long to accommodate longer high-powered ammunition such as 410 shotgun shells. The length of magazine 366 makes it too long to fit within the hand of a shooter. Handgrip 368 is made integral with gun frame 364 and positioned behind Magazine channel 365 and magazine 366 as shown in FIG. 64. Articulating trigger 369 is attached to trigger slide 370 by pivot pin 371. Trigger slide 371 is biased forward by trigger spring 372 captivated in slot 373 in handgrip 368. Trigger slide 370 has extensions 374 running forward which carry actuating means such as spring extension 375 which actuate firing mechanisms and magazine index mechanisms similar to those described previously in this invention. Barrel 376 and its associated firing mechanism may be located at any desirable point along the front end of handgun frame 364. The preferred embodiment places the centerline of barrel 376 in line with the center of a shooter's hand and along the centerline of a shooters arm. This location prevents the undesirable "barrel flip" caused by recoil in conventional handguns.

Figure 65:
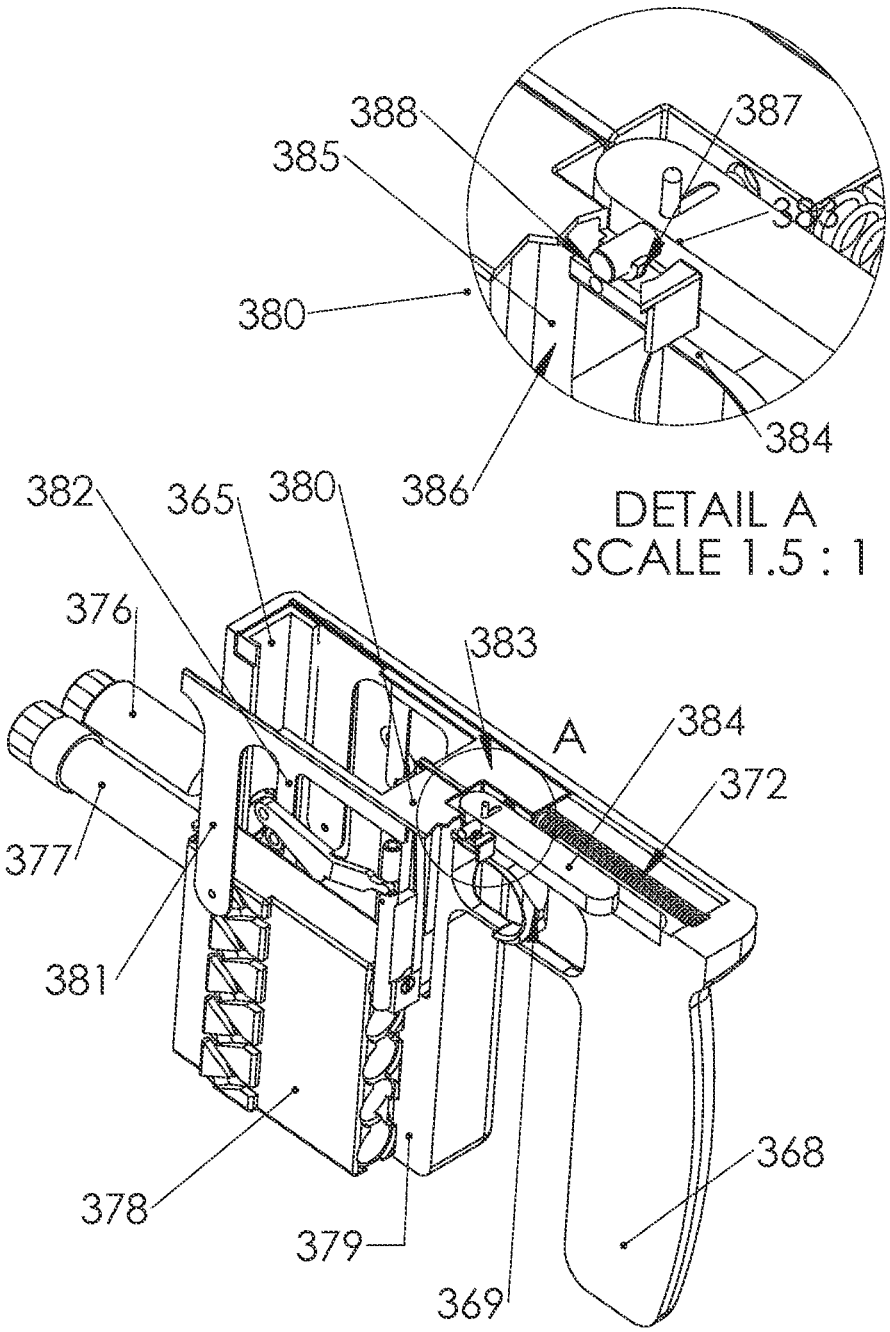
FIG. 65 is a schematic assembly drawing that illustrates a double barrel, dual magazine version of a handgun illustrated in FIG. 64.

FIG. 65 is a schematic assembly drawing that illustrates a double barrel, dual magazine version of a handgun illustrated in FIG. 64 above. This embodiment has two parallel barrels 376 and 377 each mounted in their respective gun frame halves. Each gun frame half has a magazine channel, 365 in the right gun frame half and 379 in the left gun frame half (not shown). There is a left side trigger slide 380 which incorporates a magazine indexing arm 381 and a firing mechanism actuating arm 382. Both actuating arms are on the outside extension of trigger slide 380. Right-hand trigger slide 383 is the opposite hand or mirror image of left-hand trigger slide 380. Trigger selecting deadbolt 385 is cross mounted in a bore in center trigger slide 384. Trigger selecting bolt 385 engages hole 386 in left-hand trigger slide 380. Trigger selecting bolt 385 is connected to actuating finger 388 and can be manually moved to at least three different positions. Left-hand position, shown in FIG. 65, connects left-hand trigger slide 380 to center trigger slide 384 and allows operation of the left-hand magazine, firing mechanism and barrel only. Trigger selecting bolt 385 may be moved to a center position which will engage left-hand trigger slide 380 via hole 386 and also engage right-hand trigger slide 383 via hole 387 and trigger 369 will fire both barrels simultaneously. Trigger selecting bolt 385 may be moved to the right position where trigger selecting bolt 385 will be disengaged from left-hand trigger slide 380 and only engaged in right-hand trigger slide 383 via hole 387. This selection will allow trigger 369 to fire only the right-hand magazine, firing mechanism and barrel. Both left and right hand trigger slides have their own return spring 372 (left side not shown).

Figure 66:
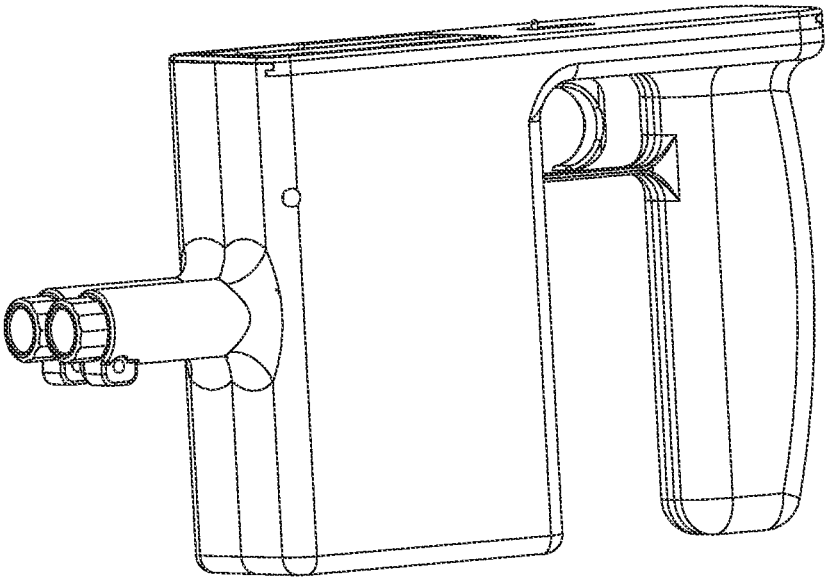
FIG. 66 is a schematic assembly drawing showing the fully assembled double-barreled, dual magazine, long ammunition handgun illustrated in FIG. 65.

FIG. 66 is a schematic assembly drawing showing the fully assembled double-barreled, dual magazine, long ammunition handgun illustrated in FIG. 65 above.

Figure 67:
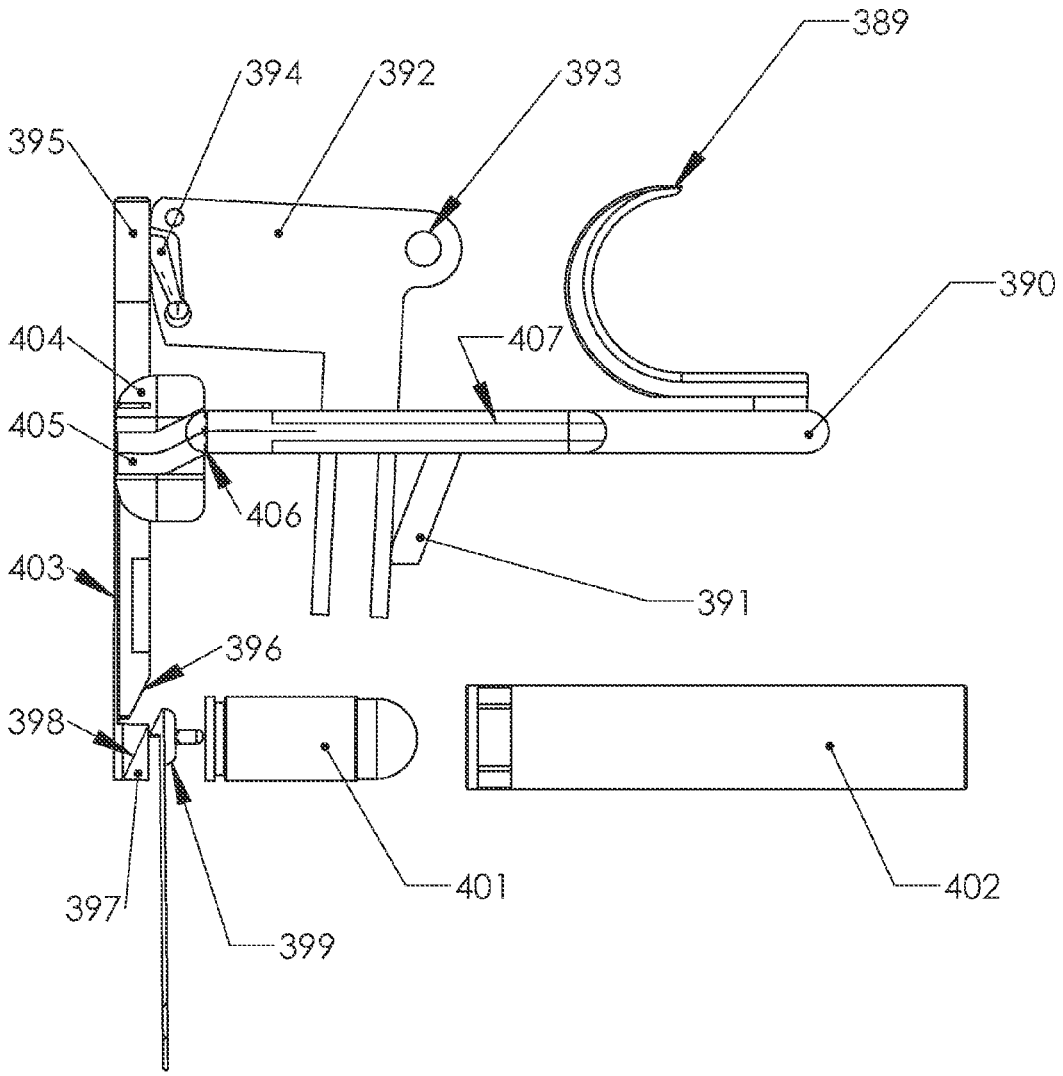
FIG. 67 is a free-floating subassembly drawing that illustrates an embodiment of a firing mechanism and firing pin retraction mechanism.

FIG. 67 is a free-floating subassembly drawing that illustrates an embodiment of a firing mechanism and firing pin refraction mechanism. Trigger finger pull 389 is attached to trigger slide 390 which is slidably mounted in a gun housing. Extension 391 is integral with trigger slide 390 and forcibly engages rotating link 392 which is pivoted about pivot point 393. Rotating link 392 is equipped with a sear 394 which engages hammer 395. Hammer 395 is vertically slidable in a gun housing and has an inclined or wedge shape surface 396 at its lower end. Driving spacer 397 is also equipped with an inclined or wedge-shaped surface 398 which matches that of 369. Driving spacer 397 is also vertically slidable in a gun housing and connected to vertically sliding cam block 404 by flat spring section 403. Sliding cam block 404 is shown in its lower or at rest position which positions driving spacer 397 below and out of reach of the travel of hammer 395 and wedge-shaped surface 396. Spring-loaded firing pin 399 is located adjacent to firing spacer 397 with its firing pin being adjacent to the firing cap 400 of cartridge 401. FIG. 67 shows the firing pin in its retracted or "at rest" position. Barrel 402 is located coaxially with cartridge 401. Extension arm 407 is integrally attached to trigger slide 390 and has a cylindrical cam follower portion 406 located at the end of extension 407 and adjacent to cam track 405 which is cut into vertically sliding cam block 404. FIG. 67 shows the firing mechanism with trigger slide 390 partially pulled but just before the gun will fire.

Figure 68:
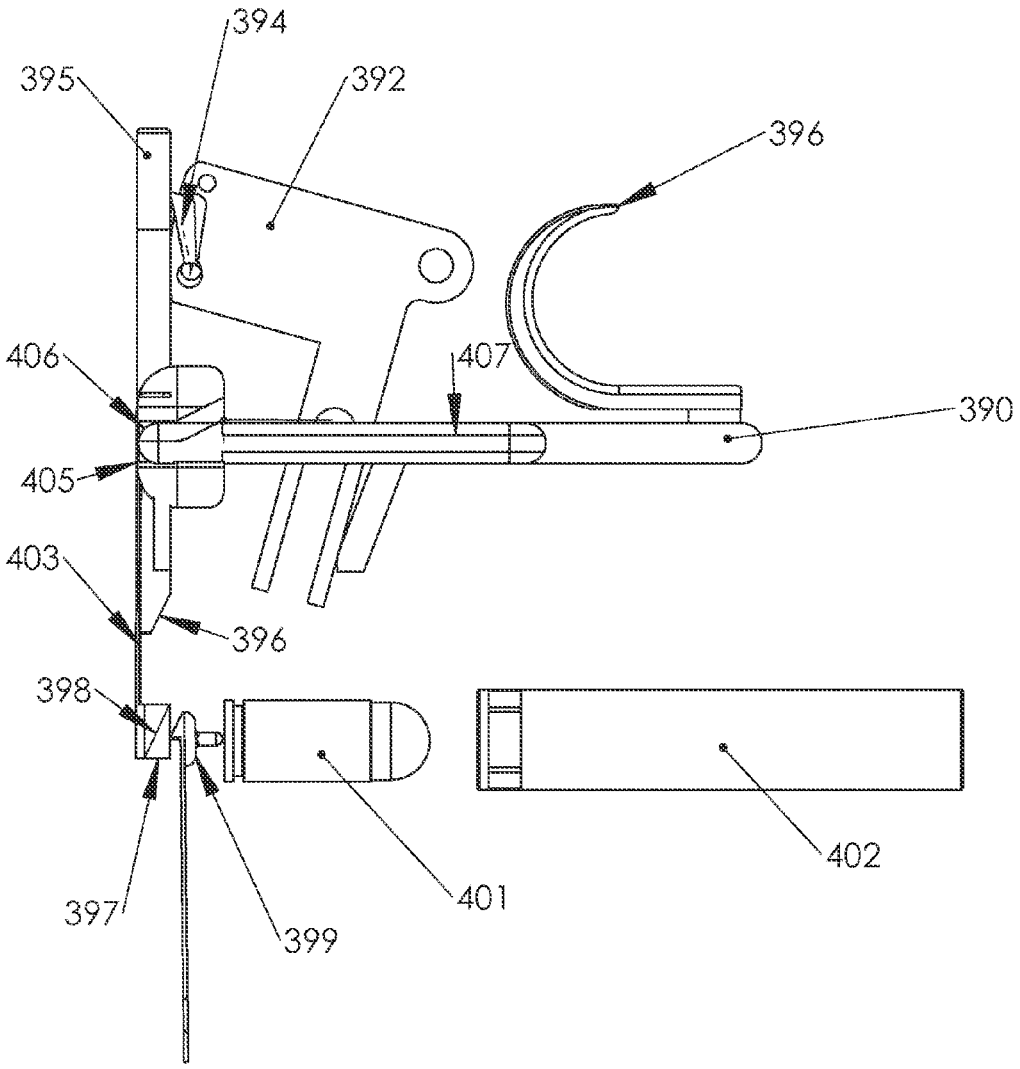
FIG. 68 shows the same firing mechanism illustrated in FIG. 67 above but with trigger slide pulled back to the position just at firing.

FIG. 68 shows the same firing mechanism illustrated in FIG. 67 above but with trigger slide 390 pulled back to the position just at firing. The movement of trigger slide 390 has rotated link 392 which in turn has raised hammer 395 by means of its engagement with sear 394. Cam follower portion 406 of trigger slide arm 407 has engaged cam track 405 in vertical sliding cam block 404 and raised it and connected driving block 397 to a position which will allow engagement of wedge surface 396 of hammer 395 with wedge surface 398 of driving block 397 when hammer 395 drops in the firing action.

Figure 69:
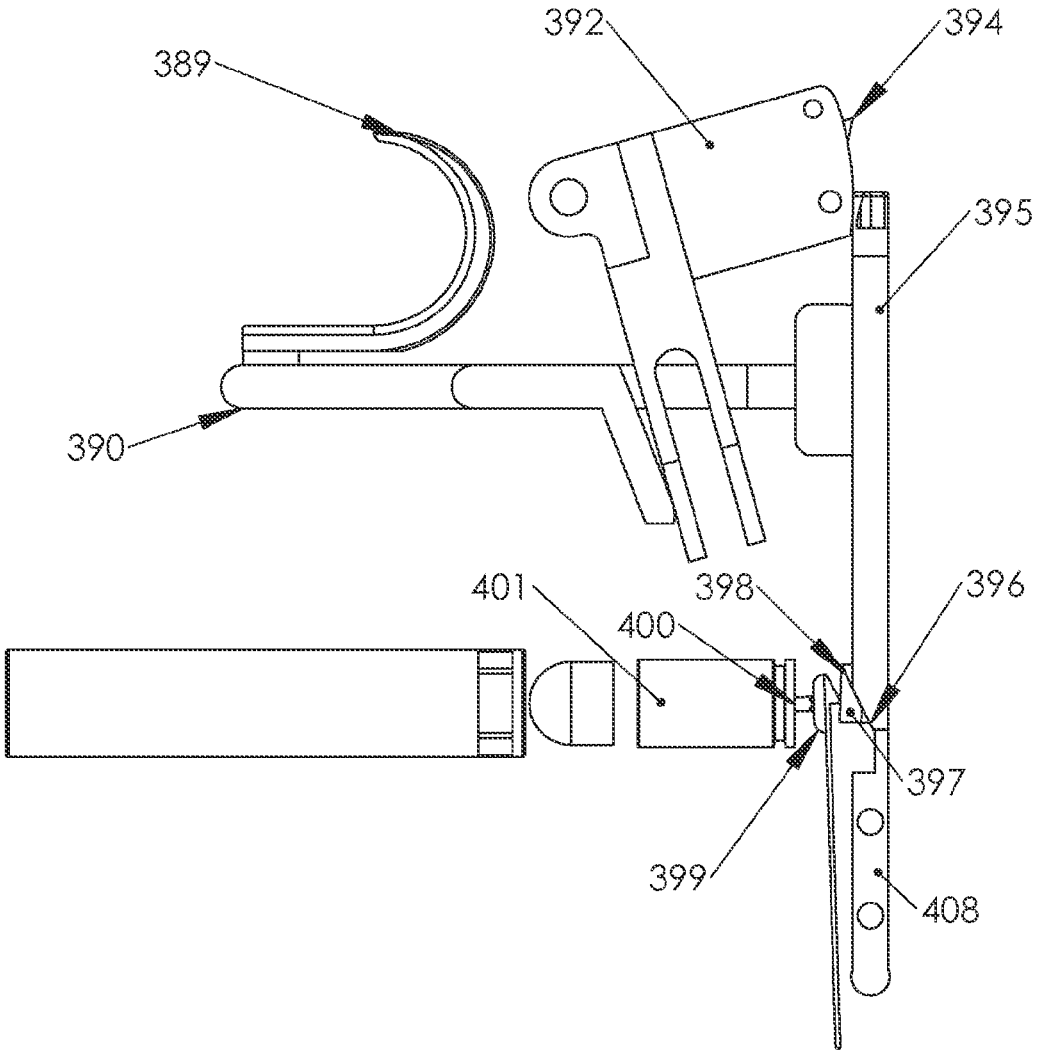
FIG. 69 shows the same firing mechanism illustrated in FIGS. 67 and 68 above but with the mechanism in its fire position.

FIG. 69 shows the same firing mechanism illustrated in FIGS. 67 and 68 above but with the mechanism in its fire position. Hammer 395 has slipped off of sear 394 and been driven down by a hammer spring and has engaged wedge surface 396 of hammer 395 with wedge surface 398 of driving block 397. This wedging action has driven driving block 397 forward which has engaged firing pin 399 which in turn has impacted firing cap 400 of cartridge 401 and fired cartridge 401. The downward travel of hammer 395 is stopped by stationary stop 408.

Figure 70:
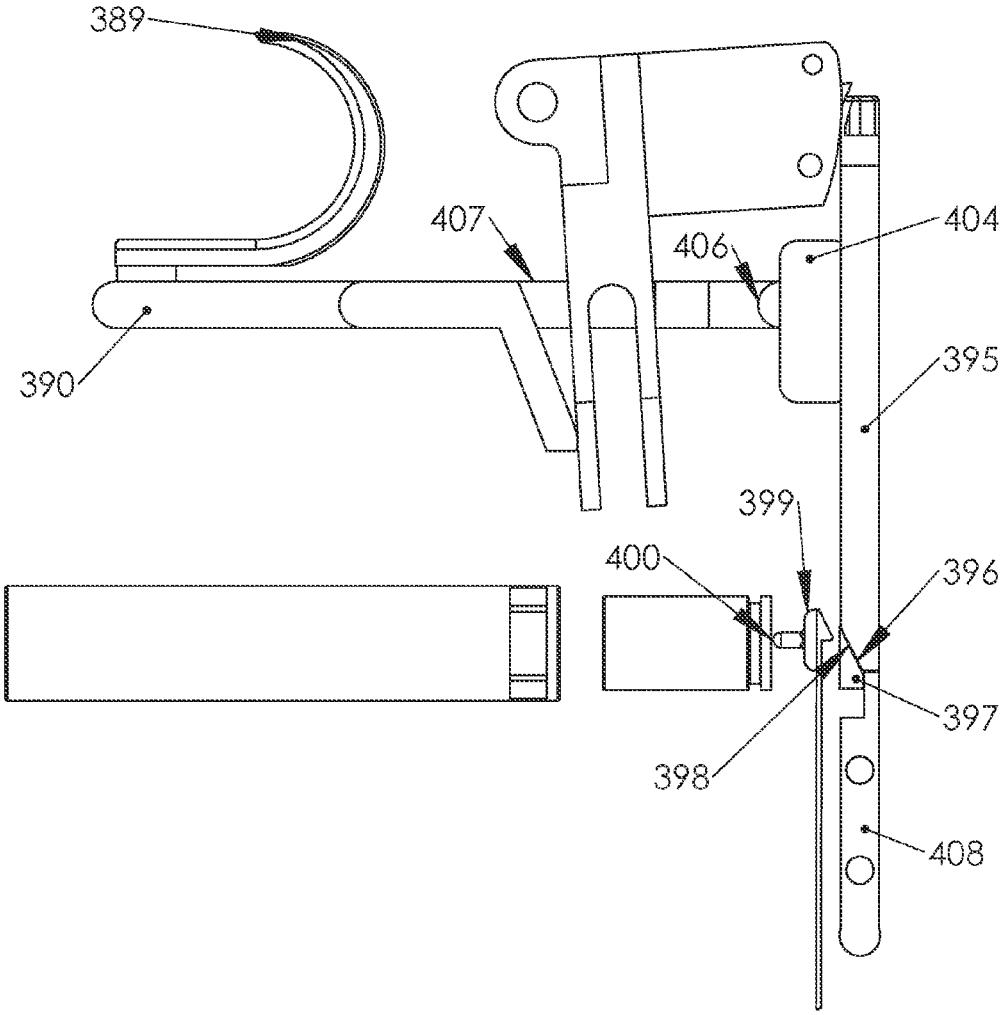
FIG. 70 shows the same firing mechanism illustrated in FIGS. 67 through 69 above with the trigger slide at the beginning of the return stroke after firing.

FIG. 70 shows the same firing mechanism illustrated in FIGS. 67 through 69 above with the trigger slide 390 at the beginning of the return stroke after firing. Circular cam follower portion 406 of trigger slide arm 407 has moved forward and driven vertical travel cam block 404 into its down position thereby lowering driving block 397 slightly below hammer 395 causing it to drop back away from firing pin 399 thus disengaging firing pin 399 from firing cap 400.

Figure 71:
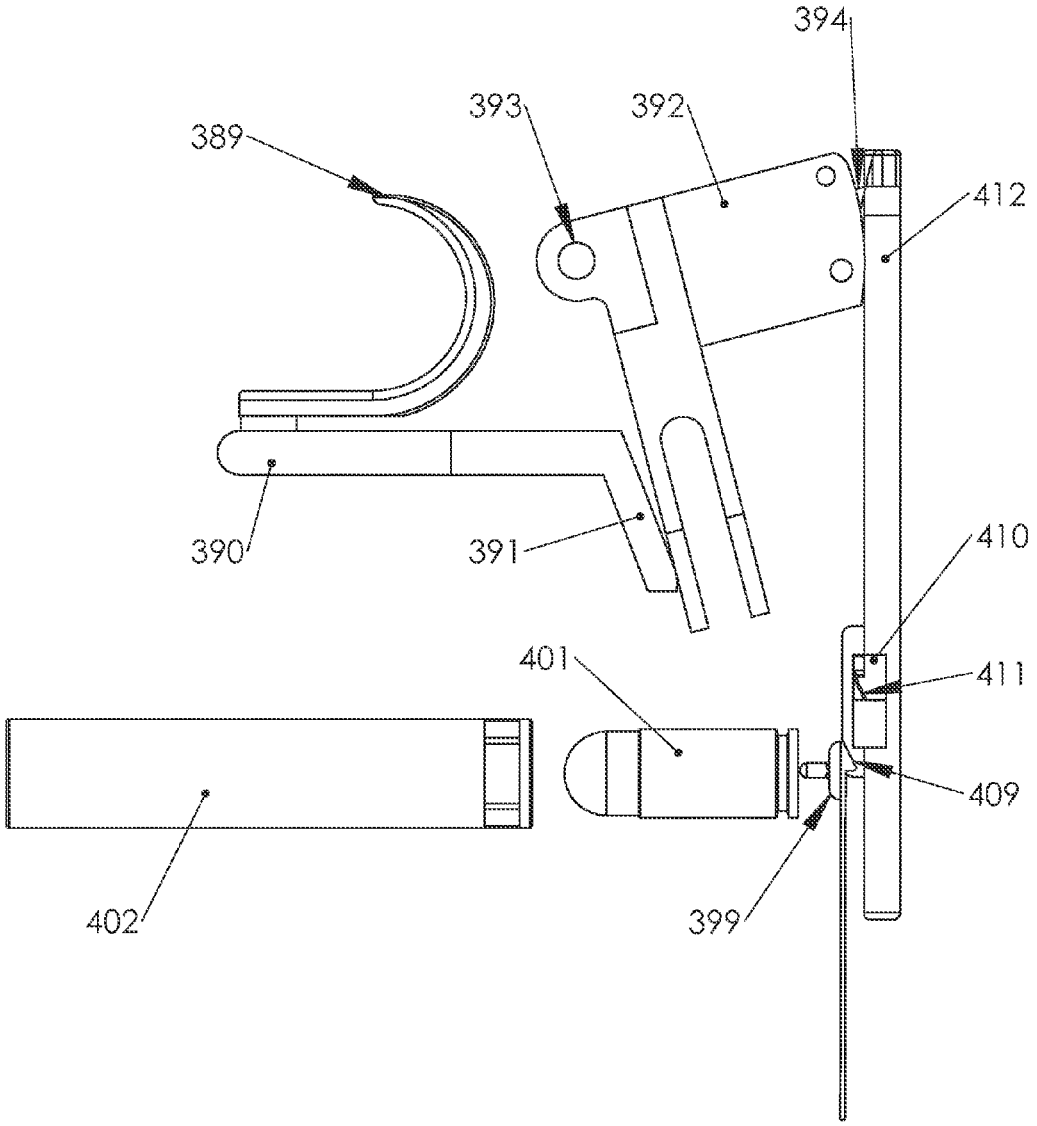
FIG. 71 is a schematic drawing of a free-floating subassembly illustrating a firing mechanism with built-in firing pin retraction.

FIG. 71 is a schematic drawing of a free-floating subassembly illustrating a firing mechanism with built-in firing pin retraction. Trigger finger pull 389, trigger slide 390, trigger slide extension 391, pivoting arm 392, pivot point 393, sear 394, firing pin 399, cartridge 401, and barrel 402 are the same as described in paragraph 139 above and illustrated in FIG. 67. In FIG. 71, hammer 412 is vertically slidable in the gun housing. Hammer 412 is raised by the action of pivoting arm 392 engaging hammer 412 with sear 394. Firing wedge 410 is rotatably mounted in hammer 412 and has an inclined wedge-shaped surface 411 which is in line with and on the same angle as the inclined wedge surface 409 of firing pin 399. FIG. 71 shows the mechanism at the position just before firing where hammer 412 will slip off of sear 394 and be driven downward by its hammer spring.

Figure 72:
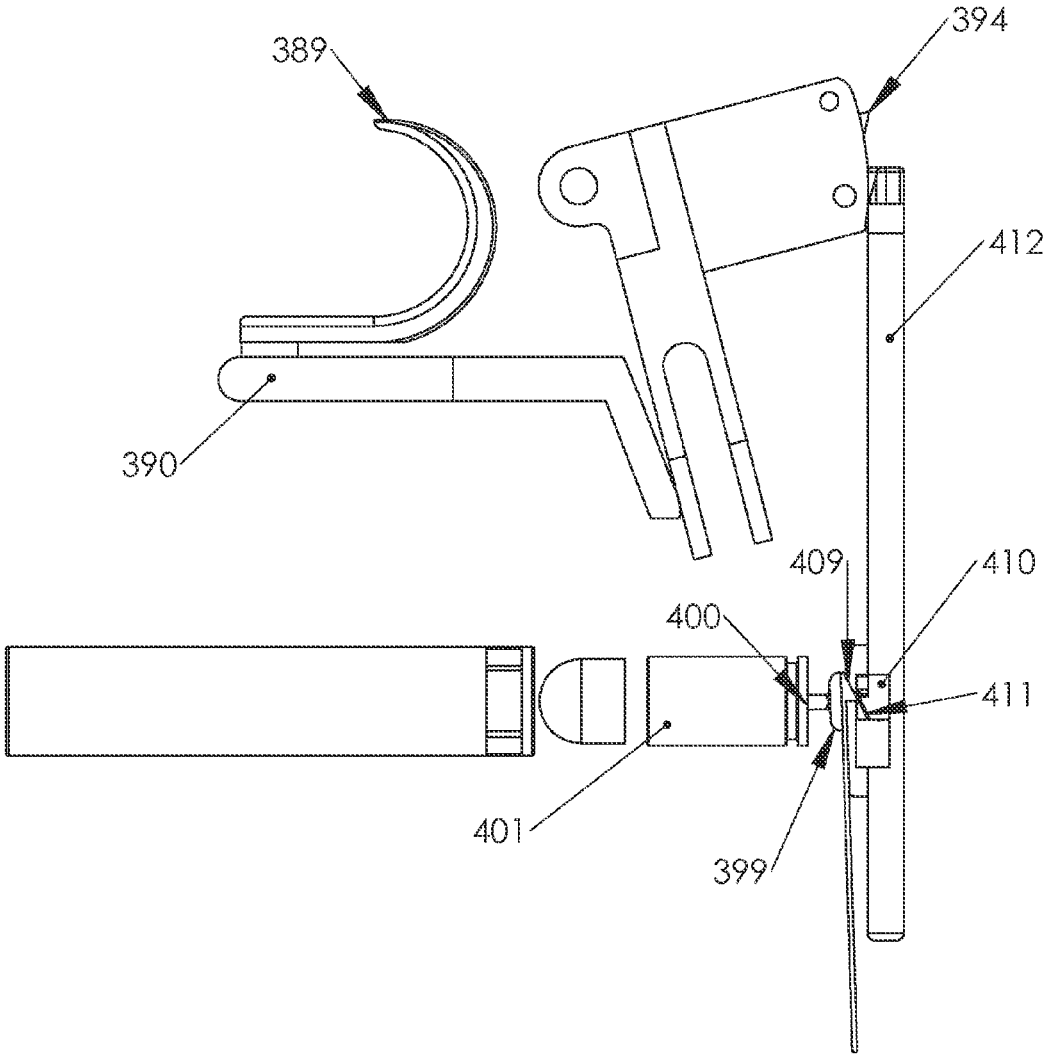
FIG. 72 shows the same mechanism as described in FIG. 71 above but with the mechanism in its "just fired" position.

FIG. 72 shows the same mechanism as described in FIG. 71 above but with the mechanism in its "just fired" position. Hammer 412 has slipped off of sear 394 and has been driven down by its hammer spring. Inclined wedge surface 411 of rotating firing wedge 410 has engaged inclined wedge surface 409 of firing pin 399 and driven firing pin 399 forward causing firing pin 399 to strike cartridge firing cap 400 thus firing cartridge 401. Hammer 412 will continue to travel downward driven by its hammer spring and wedge surface 411 of rotating firing wedge 410 will bypass wedge surface 409 on firing pin 399 and disengage from it thus allowing firing pin 399 to retract away from cartridge 401 (see FIG. 73).

Figure 73:
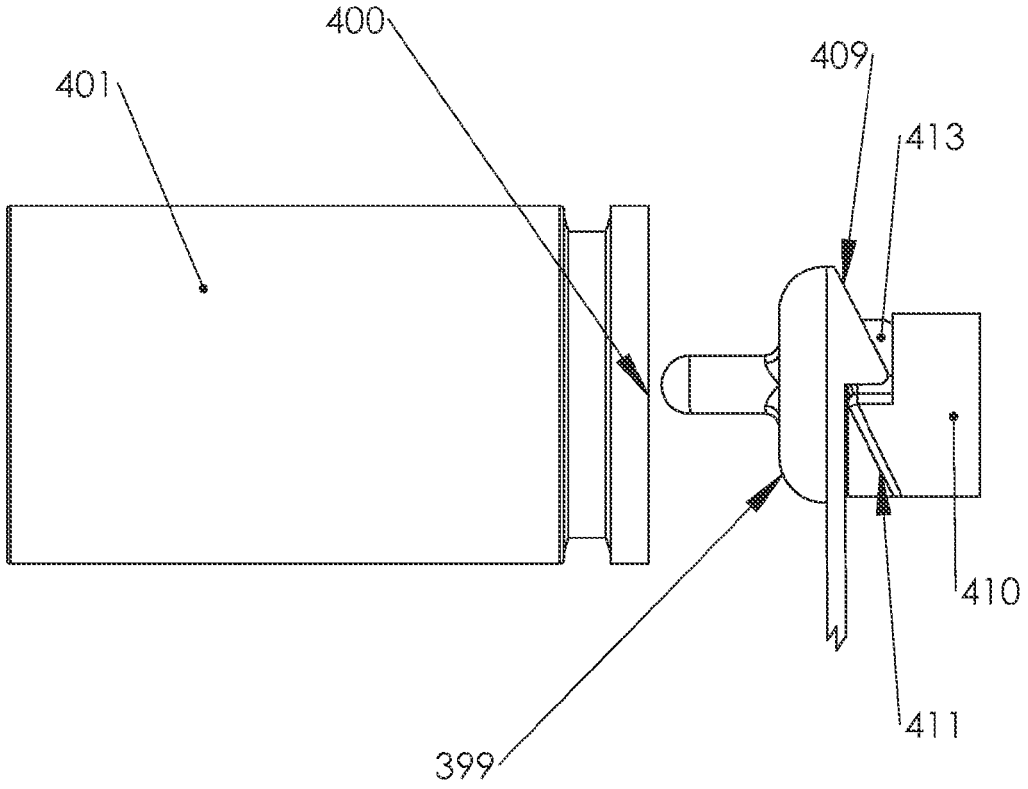
FIG. 73 is a close-up schematic drawing that illustrates the position of firing wedge and firing pin in their bypassed position at the bottom of the travel of hammer 412.

FIG. 73 is a close-up schematic drawing that illustrates the position of firing wedge 410 and firing pin 399 in their bypassed position at the bottom of the travel of hammer 412. Wedge surface 411 of rotating firing wedge 410 has gone past wedge surface 409 of firing pin 399 and allowed wedge surface 409 to fall into the hollow pocket 413 cut into rotating wedge 410. This condition allows firing pin 399 to retract away from cartridge 401.

Figure 74:
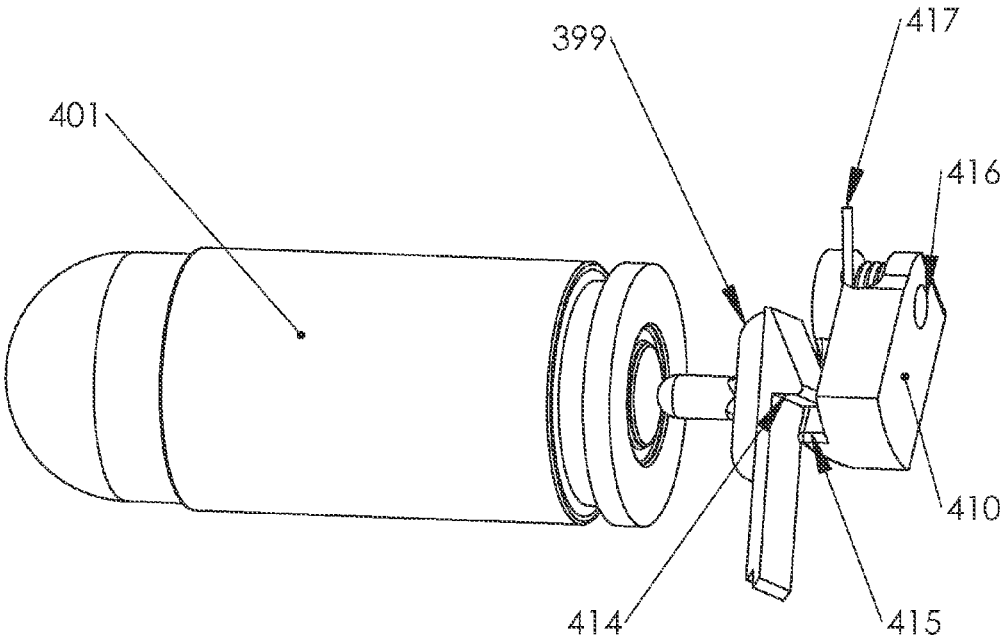
FIG. 74 is a close-up schematic drawing of the same mechanism illustrated in FIG. 71 through 73 above illustrating the firing mechanism action during the beginning of the trigger pull of the next cycle in firing the gun.

FIG. 74 is a close-up schematic drawing of the same mechanism illustrated in FIG. 71 through 73 above illustrating the firing mechanism action during the beginning of the trigger pull of the next cycle in firing the gun. As the trigger pull causes hammer 412 to rise, flat surface 414 on firing pin 399 engages flat surface 415 on rotating firing wedge 410 causing it to pivot about the transverse pivot point 416 of rotating firing wedge 410 thereby allowing rotating firing wedge 410 to slip past firing pin 399 without imparting forces in the direction of cartridge 401. As rotating firing wedge 410 continues to move upward it will slip past firing pin 399 and will be biased back to its horizontal position by torsion spring 417.

Figure 75:
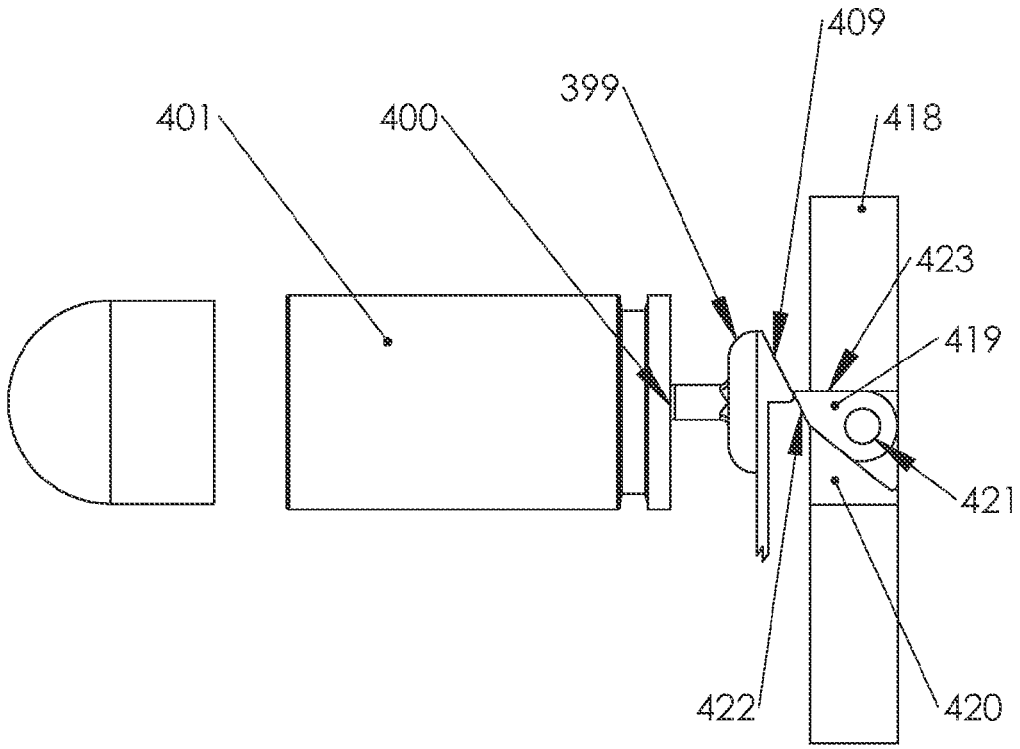
FIG. 75 is a free-floating subassembly schematic drawing that illustrates a wedge type firing mechanism.

FIG. 75 is a free-floating subassembly schematic drawing that illustrates a wedge type firing mechanism. Hammer 418 is slidably mounted in a gun housing such that it may travel vertically and may be driven downward by a hammer spring (not shown). Rotating firing wedge 419 is rotatably mounted in pocket 420 by pivoting journal 421. Rotating firing wage 419 may rotate counterclockwise but is prevented from rotating clockwise by the engagement of flat surface 423 with the surface of hammer 418. During the firing stroke, the downward motion of hammer 418 causes the inclined wedge surface 422 of rotating firing wedge 419 to engage wedge surface 409 of firing pin 399 thus driving firing pin 399 forward where it impacts cartridge cap 400 causing cartridge 401 to fire.

Figure 76:
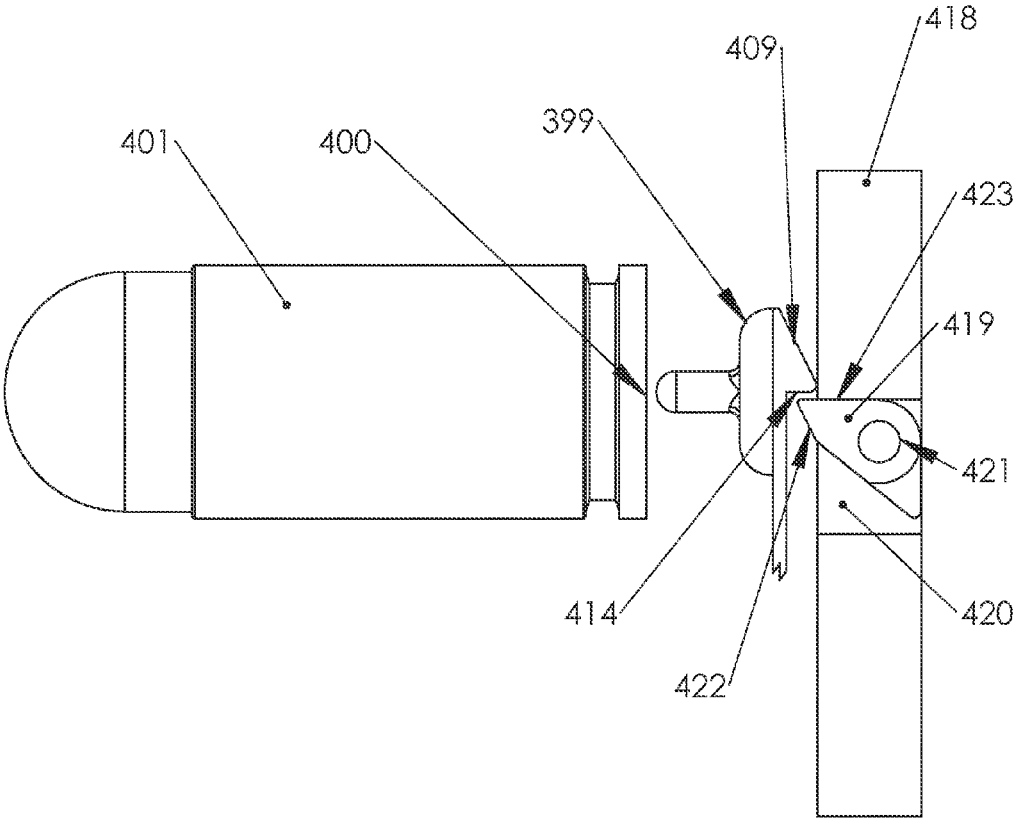
FIG. 76 illustrates the firing mechanism described in FIG. 75 above at the end of the firing stroke.

FIG. 76 illustrates the firing mechanism described in paragraph 147 above at the end of the firing stroke. Hammer 418 has traveled to the bottom limit of its stroke which has caused rotating firing hammer 419 to move past firing pin 399 allowing firing pin 399 to retract into its at rest position and clear of cartridge firing cap 400.

Figure 77:
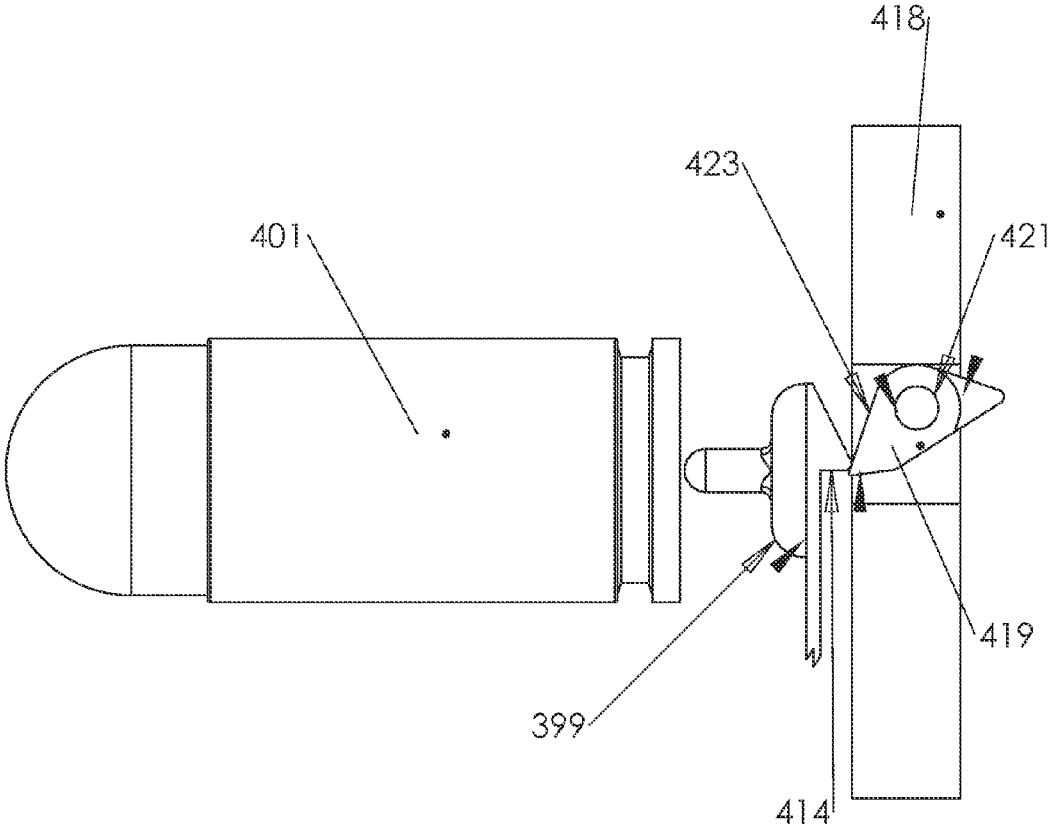
FIG. 77 illustrates the firing mechanism described in FIGS. 75 and 76 above with the mechanism in a position at the beginning of the next trigger pull.

FIG. 77 illustrates the firing mechanism described in paragraph 147 and 148 above with the mechanism in a position at the beginning of the next trigger pull. During trigger pull, hammer 418 will begin rising to start the firing stroke. As hammer 418 rises, flat surface 423 of rotating firing wedge 419 will encounter flat surface 414 of firing pin 399 which will cause rotating firing wedge 419 to rotate about journal 421 and rotating firing wedge 419 will move past firing pin 399 without imparting motion to firing pin 399.

Figure 78:
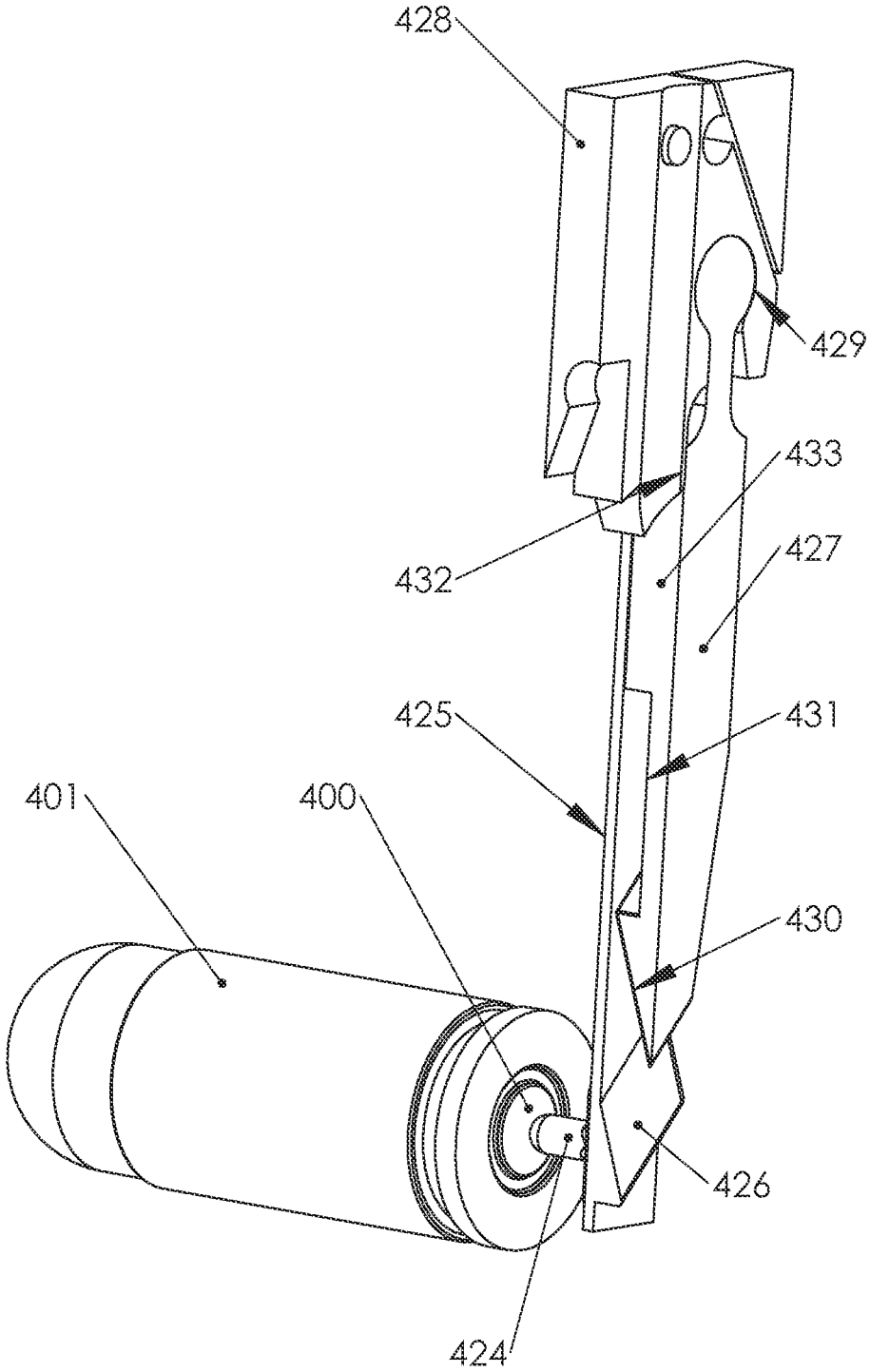
FIG. 78 is a free-floating subassembly schematic drawing of a wedge type firing mechanism.

FIG. 78 is a free-floating subassembly schematic drawing of a wedge type firing mechanism. Firing pin 424 is mounted to a gun frame by its leaf spring extension 425 and is equipped with an inclined wedge-shaped surface 426. Rotating firing wedge 427 is mounted to vertically traveling hammer 428 by means of journal section 429. Rotating firing wedge 427 has an inclined wedge surface 430 which matches and mates with inclined wedge surface 426 of firing pin 424. Rotating firing wedge 427 also has a clearance pocket 431. Rotating firing wedge 427 may rotate counterclockwise but is prevented from rotating clockwise by the engagement of flat surface 432 on hammer 428 with flat surface 433 on rotating firing wedge 427. Hammer 428 is biased downward by a strong hammer spring (not shown). Hammer 428 is raised during the firing stroke by the mechanical actions of a trigger mechanism (not shown). FIG. 78 shows the firing mechanism with the hammer and rotating wedge in their raised position just before firing.

Figure 79:
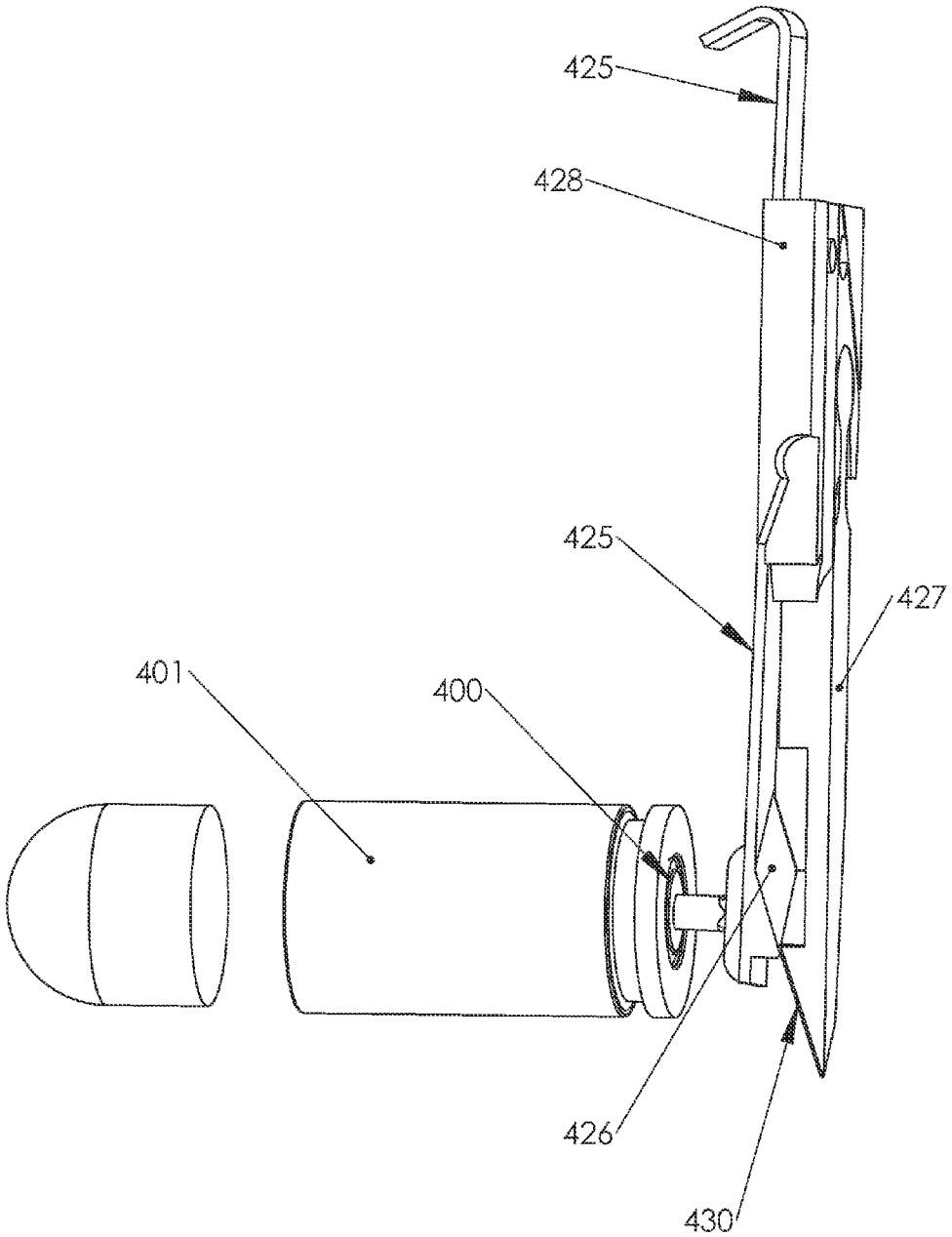
FIG. 79 shows the firing mechanism illustrated in FIG. 78 above with the mechanism in its firing position.

FIG. 79 shows the firing mechanism illustrated in FIG. 78 above with the mechanism in its firing position. Hammer 428 has traveled down under the force of the hammer spring (not shown) and inclined wedge surface 430 of rotating firing wedge 427 has engaged inclined wedge surface 426 of firing pin 424 and driven firing pin 424 forward, flexing leaf spring 425 and engaging firing pin 424 into firing cap 400 thereby firing cartridge 401.

Figure 80:
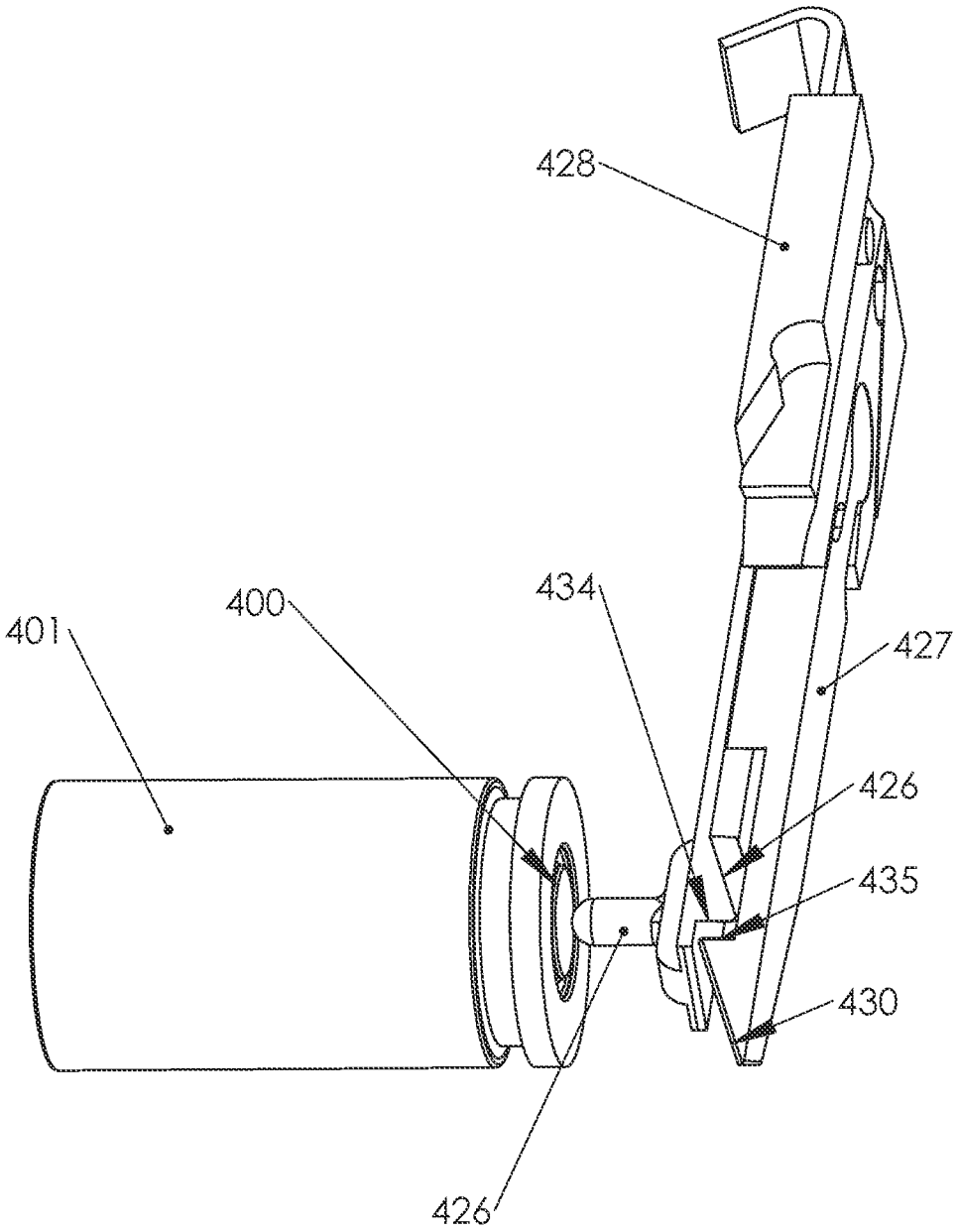
FIG. 80 shows the firing mechanism illustrated in FIGS. 78 and 79 above with the mechanism with the hammer at the bottom end of its travel at the end of the firing stroke which is the "at rest" position of the gun.

FIG. 80 shows the firing mechanism illustrated in FIGS. 78 and 79 above with the mechanism with hammer 428 at the bottom end of its travel at the end of the firing stroke which is the "at rest" position of the gun. The continued downward travel of hammer 428 has caused the wedge-shaped inclined surface 430 of rotating firing wedge 427 to bypass the inclined wedge surface 426 of firing pin 424. There is now clearance between flat surface 434 the firing pin 424 and flat surface 435 of rotating firing wedge 427. The inclined wedge surface 426 of firing pin 424 is now allowed to retract into clearance pocket 431 of rotating firing wedge 427 thereby retracting firing pin 424 clear of cartridge 401.

Figure 81:
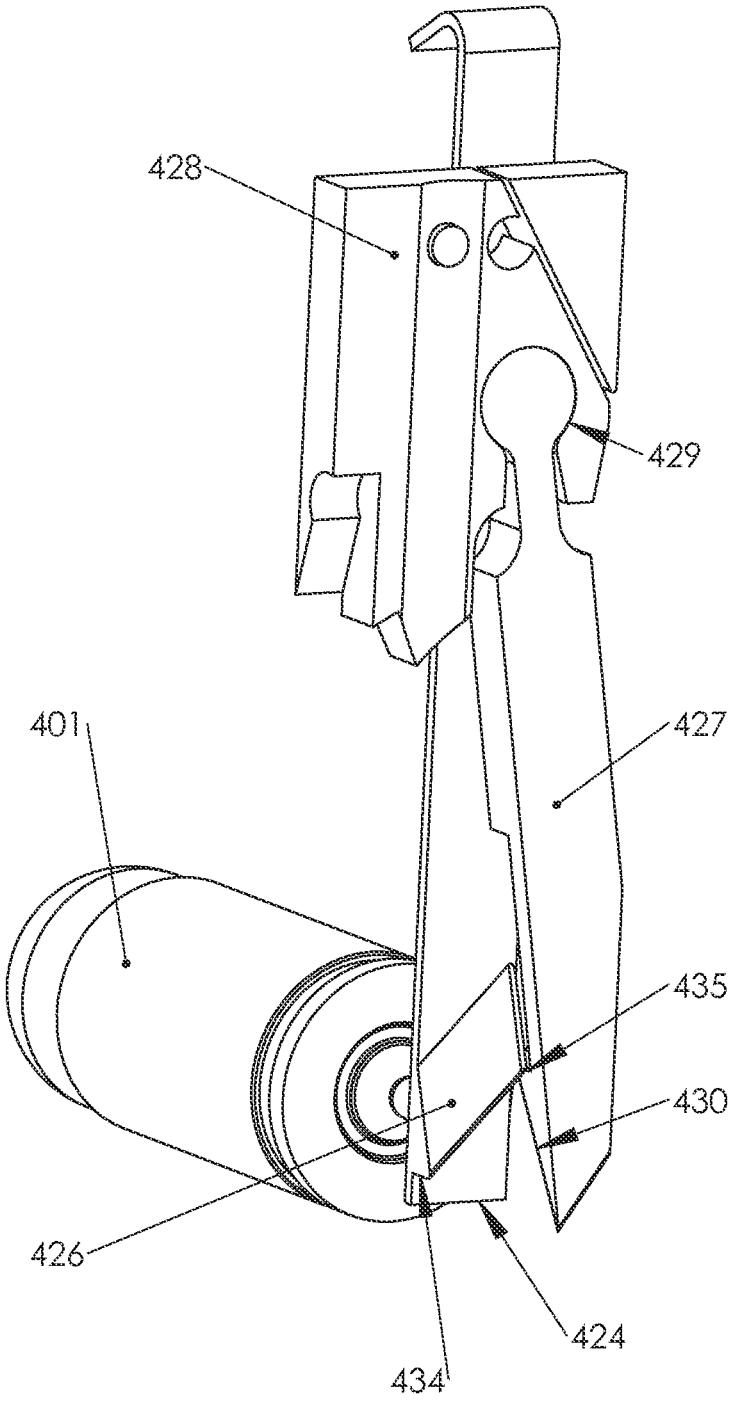
FIG. 81 shows the firing mechanism illustrated in FIGS. 78 through 80 above with the mechanism at the beginning of the next trigger pull.

FIG. 81 shows the firing mechanism illustrated in FIGS. 78 through 80 above with the mechanism at the beginning of the next trigger pull. At the beginning of the trigger pull, hammer 428 is raised by the mechanical action of the trigger mechanism (not shown). As hammer 428 and rotating firing wedge 427 begin to rise, flat surface 435 of rotating firing wedge 427 will engage flat surface 434 of firing pin 424. The angled position of flat surfaces 435 and 434 will cause rotating firing wedge 427 to rotate counterclockwise about cylindrical journal surface 429. Inclined wedge surface 430 of rotating firing wedge 427 will swing clear of wedge surface 426 of firing pin 424 without imparting motion to firing pin 424. When inclined wedge surface 430 is clear of inclined wedge surface 426, rotating firing wedge 427 will rotate back to its vertical position under the pressure of a light leaf spring (not shown) anchored in hammer 428 and will be properly aligned for the next firing sequence.

Figure 82:
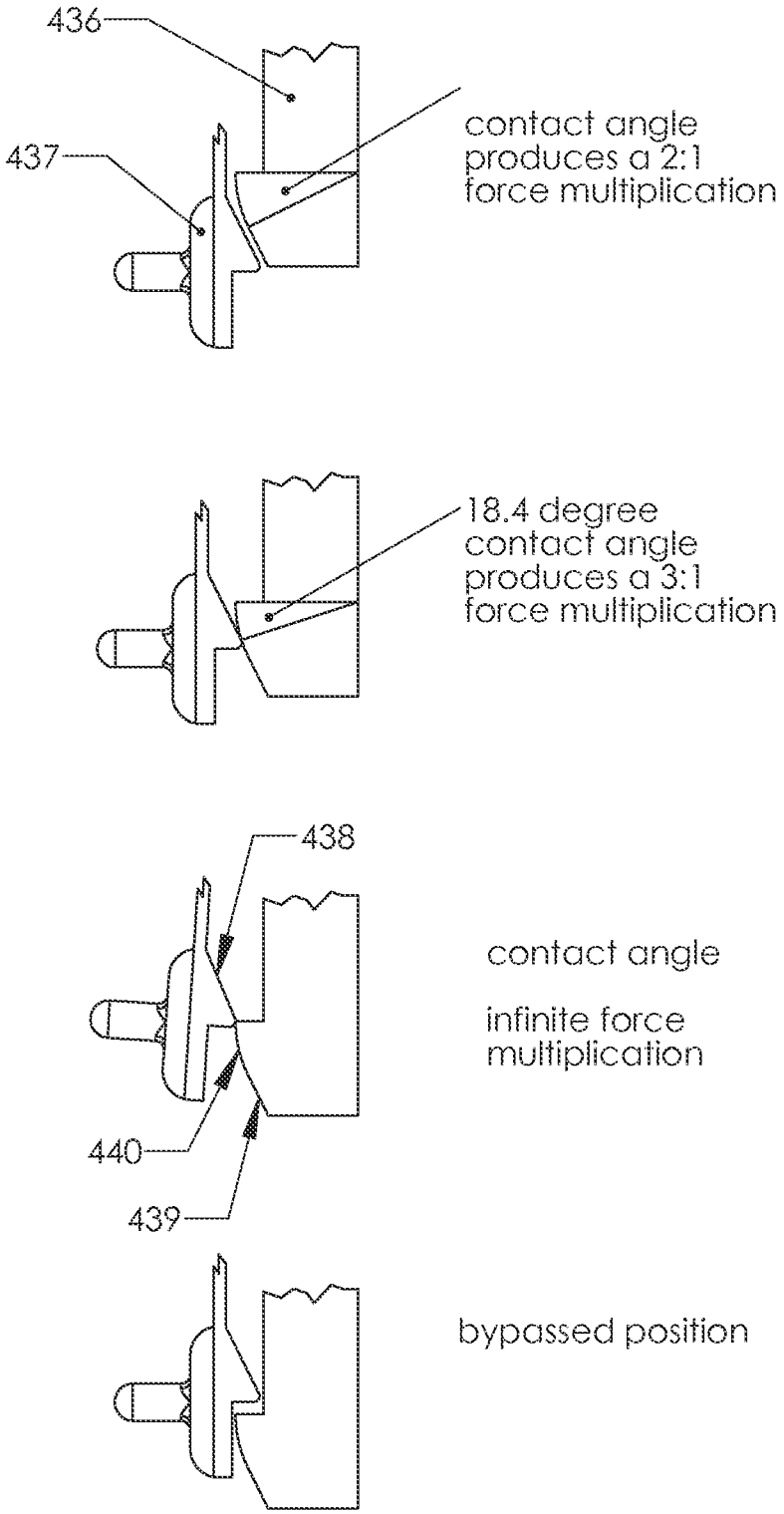
FIG. 82 is a schematic drawing that illustrates the sequential progressive movements of firing hammer striking firing pin in a firing sequence.

FIG. 82 is a schematic drawing that illustrates the sequential progressive movements of firing hammer 436 striking firing pin 437 in a firing sequence. Wedge-shaped surface 438 of firing pin 437 is inclined at an angle of approximately 26.5° from vertical which will yield a 2 to 1 force multiplication when struck by firing hammer 436 which has a corresponding angle on the straight portion 429. Firing hammer 436 also has a curved portion 440 which extends from the upper end of flat surface 439 to the end of the wedge surface on hammer 436. The top drawing in FIG. 82 shows the two components just before impact during the firing sequence. At this point, surface 438 of firing pin 337 is parallel to surface 439 on firing hammer 436. Downward pressure from hammer 436 will exert a left horizontal pressure on firing pin 437 equal to twice the force applied by hammer 436. As hammer 436 progresses in its downward movement, curved surface 440 begins contact with the end of flat surface 438 of firing pin 437. The contact angle between the two surfaces decreases as the hammer moves down past firing pin 437. As the contact angle decreases, the force multiplication increases. In the drawing second from the top of FIG. 82, the angle of contact between the curved surface 440 on hammer 436 which has now moved across the end of surface 438 of firing pin 437 is shown to be 18.4°. At a contact angle of 18.4°, the force multiplication comes 3 to 1. As firing hammer 436 continues its down stroke it will reach a point at which the contact angle between surface 440 and surface 438 becomes zero and at that point the force multiplication will be theoretically infinite. The bottom drawing in FIG. 82 shows the two components, 436 and 437, in their bypass position where hammer 436 has gone past the wedge-shaped portion of firing pin 437 and reached a relaxed or "at rest" position.

The magazine cam track is a waveform type channel in which the cam follower rides. It extends from before the first firing chamber to the last firing chamber. The waveform may have a zigzag shape. As used herein, zigzag broadly refers to a course or progression characterized by changes in direction, first to one side and then to the other. Nonlimiting examples include serpentine, sinusoidal, cycloid and triangular waveforms. However, as described herein, a cam track according to principles of the invention may combine linear and curved sections.

The magazine cam follower, also known as a track follower, is a pin, roller or needle bearing designed to follow the cam track. A cam track may have a waveform of several cycles, with at least one cycle per firing chamber. Each cycle corresponds to a firing chamber increment. Each firing chamber increment aligns the next firing chamber with the barrel for firing. For example, movement of the cam follower through a cycle of the cam track advances the magazine in the stock by one firing chamber, aligning the next firing chamber with the barrel for firing. If a magazine includes 6 firing chambers which hold one cartridge per firing chamber for a total of 6 cartridges, then six trigger pulls may cause the cam follower to progress through six cycles of the cam track waveform, with each trigger pull corresponding to one firing chamber increment. A trigger pull refers to the action of moving the trigger from an "at rest" position to a firing position and returning to its original "at rest" position. The magazine advances linearly in the stock or handle with each trigger pull. The advancement moves each firing chamber sequentially into alignment with the barrel.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A handgun comprising a magazine comprising a housing with a plurality of aligned spaced firing chambers, each firing chamber being shaped and sized to hold a cartridge with a bullet for firing, a magazine top, a magazine bottom, a magazine front and a magazine back, and an outer cam side, and a second side, a cam track on the outer cam side of the magazine between the magazine front and the magazine back, said cam track comprising a three dimensional waveform channel extending from about the magazine bottom to about the magazine top and including a waveform cycle for each firing chamber; and a stock comprising a stock bottom, a stock top, and a passage extending from the stock bottom to the stock top, said passage being shaped and sized to receive the magazine and allow the magazine to progress linearly through the passage, and said passage including a front surface, a rear surface, a first side surface and a second side surface, and a barrel opening in the front surface between the stock top and stock bottom;

a barrel through which a bullet of a cartridge fired from one of the firing chambers may travel, said barrel extending from the barrel opening in the front surface of the passage;

a trigger comprising a finger actuatable lever, said trigger being movable from an at rest position to a firing position;

a firing pin configured to strike the cartridge for firing when the firing chamber containing the cartridge is aligned with the barrel at the firing position and the trigger is moved to the firing position;

a cam follower riding in the cam track and operably coupled to the trigger, said cam follower urging the magazine towards one of the stock top and stock bottom when the trigger is moved to the firing position, and said cam follower urging the firing chamber containing the cartridge to be fired into alignment with the barrel at the barrel opening when the trigger is moved to the firing position.

2. A handgun according to claim 1, said cam track on the outer cam side of the magazine further comprising a step between each waveform cycle, said step impeding backward motion of the cam follower.

3. A handgun according to claim 2, each waveform cycle including a dwell segment, said cam follower not moving the magazine when the cam follower is riding through the dwell segment.

4. A handgun according to claim 1, said cam track defining a zigzag path of travel.

5. A handgun according to claim 1, said outer cam side including a first edge and an opposite second edge, a bottom edge and a top edge, and the cam track comprising a plurality of cycles with each cycle comprising a track segment with a bend that changes direction from the first edge to the second edge, and each cycle having a wavelength corresponding to an index distance of an associated successive firing chamber in the magazine.

6. A handgun according to claim 1, said cam track comprising a waveform path of travel from the group consisting of serpentine, sinusoidal, cycloid and triangular waveforms and a waveform comprised of adjoined straight segments.

7. A handgun according to claim 1, said cam follower comprising a protrusion sized to ride in the cam track.

8. A handgun according to claim 1, said cam follower comprising a roller sized to ride in the cam track.

9. A handgun according to claim 1, said magazine comprising a first magazine and a second magazine parallel to and abutting the first magazine, and said barrel being a first barrel and said handgun further comprising a second barrel parallel to and abutting the first barrel, and said barrel opening in the front surface of the passage being a first barrel opening in the front surface of the passage, and said stock further comprising a second barrel opening in the front surface of the passage, said second barrel opening being adjacent to and aligned with the first barrel opening.

10. A handgun according to claim 1, further comprising a cam follower arm having a terminus and being biased to urge the cam follower towards the cam track, said cam follower arm being operably coupled to the trigger, said cam follower being attached at the terminus of the cam follower arm.

11. A handgun according to claim 10, said cam follower arm comprising a spring biased to urge the cam follower towards the cam track.

12. A handgun according to claim 10, said cam follower arm further comprising a leaf spring biased to urge the cam follower towards the cam track.

13. A handgun according to claim 10, said cam follower arm comprising a pivoting joint and a spring biased to urge the cam follower arm to pivot towards the cam track thereby urging the cam follower towards the cam track.

14. A handgun according to claim 1, each cartridge comprising a case having an open front end and a substantially closed back end, with a rim at the back end, said case containing a propellant, and said case holding a bullet as a projectile at the open end, and an impact sensitive primer at the back end and in fluid communication with the propellant, and the case of each fired cartridge being a spent case, said magazine further comprising an extractor for each firing chamber, the extractor comprising a plurality of C-shaped grippers, one gripper per firing chamber, the grippers being sized and shaped to grip the rim of each cartridge in the firing chambers, the grippers being movable from a first position abutting the magazine to a position away from the magazine to eject each spent case.

15. A handgun according to claim 1, further comprising a firing anvil having a front side and an opposite back side, the front side of the firing anvil being attached to the firing pin, the back side of the firing anvil having an inclined plane striking surface, a striking lug aligned with the inclined plane striking surface, said striking lug including a wedge shaped leading edge, said striking lug being movable from a position apart from the striking surface into collision with the striking surface with the wedge shaped leading edge colliding against the inclined plane striking surface and thereby drive the firing pin into the cartridge aligned with the barrel at the firing position, said striking lug being actuated by the trigger, movement of the trigger to the firing position causing the wedge shaped leading edge to collide against the inclined plane striking surface.

16. A handgun according to claim 1, further comprising a sear disposed between the trigger and striking lug, said sear holding the striking lug until the trigger reaches the firing position, upon which the sear releases the striking lug causing the wedge shaped leading edge to collide against the inclined plane striking surface.

17. A handgun according to claim 1, said trigger comprising an articulating trigger pull.

18. A handgun according to claim 17, said trigger further comprising a trigger slide, said trigger pull being connected to the trigger slide by a pivot pin, said trigger slide moving linearly along a slide axis, said trigger pull articulating about a rotational axis perpendicular to the slide axis.

19. A handgun according to claim 1, said trigger being below the top of the stock and above the barrel.

20. A handgun according to claim 1, said stock comprising a handle.

* * * * *